US006757509B2

(12) United States Patent
Shoji et al.

(10) Patent No.: US 6,757,509 B2
(45) Date of Patent: Jun. 29, 2004

(54) IMAGE FORMING APPARATUS

(75) Inventors: Hisashi Shoji, Kanagawa (JP); Tsukuru Kai, Kanagawa (JP); Kei Yasutomi, Kanagawa (JP); Nekka Matsuura, Kanagawa (JP); Nobutaka Takeuchi, Kanagawa (JP); Hirokatsu Suzuki, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/846,244

(22) Filed: May 2, 2001

(65) Prior Publication Data

US 2002/0122675 A1 Sep. 5, 2002

(30) Foreign Application Priority Data

| | | |
|---|---|---|
| May 2, 2000 | (JP) | 2000-133628 |
| May 2, 2000 | (JP) | 2000-133629 |
| May 15, 2000 | (JP) | 2000-142342 |
| May 15, 2000 | (JP) | 2000-142344 |
| Jun. 14, 2000 | (JP) | 2000-178923 |
| Jun. 19, 2000 | (JP) | 2000-183567 |
| Jul. 6, 2000 | (JP) | 2000-205494 |

(51) Int. Cl.[7] ..... G03G 13/09
(52) U.S. Cl. ..... 399/267; 399/275; 399/277
(58) Field of Search ..... 399/267, 270, 399/272, 273, 274, 275, 277

(56) References Cited

U.S. PATENT DOCUMENTS

| | | | | |
|---|---|---|---|---|
| 5,860,049 A | * | 1/1999 | Kumasaka et al. | 399/267 |
| 6,295,437 B1 | | 9/2001 | Hodoshima et al. | |
| 6,366,751 B1 | | 4/2002 | Shakuto et al. | |
| 6,385,423 B1 | | 5/2002 | Kai | |
| 6,449,452 B1 | | 9/2002 | Kai | |

FOREIGN PATENT DOCUMENTS

| | | |
|---|---|---|
| JP | 8-160725 | 6/1996 |
| JP | 2000-305360 | 11/2000 |

* cited by examiner

*Primary Examiner*—Hoang Ngo
(74) *Attorney, Agent, or Firm*—Oblon, Spivak, McCelland, Maier & Neustadt, P.C.

(57) ABSTRACT

An electrophotographic image forming apparatus of the present invention frees images from various defects including the thinning of horizontal lines, the omission of the trailing edge an image, background contamination, granularity particular to a halftone image, carrier scattering, and image noise. Further, the apparatus of the present invention solves problems ascribable to patches used to sense image density. Moreover, the apparatus of the present invention faithfully reproduces tonality and has a high developing ability.

10 Claims, 53 Drawing Sheets

*Fig. 5*

| BACKGROUND POTENTIAL (Vd-Vb) [V] | TONER CHARGE (Q/M)[μC/g] | | | | | | | | | |
|---|---|---|---|---|---|---|---|---|---|---|
| | 8 | | 10 | | 20 | | 35 | | 45 | |
| | BACK-GROUND FOG | LINE THINNING | BACK-GROUND FOG | LINE THINNING | BACK-GROUND FOG | LINE THINNING | BACK-GROUND FOG | LINE THINNING | BACK-GROUND FOG | LINE THINNING |
| 300 | ○ | ○ | ○ | ○ | ○ | ○ | ○ | ○ | ○ | ○ |
| 200 | △ | ○ | ○ | ○ | ○ | ○ | ○ | ○ | ○ | ○ |
| 110 | △ | ○ | ○ | ○ | ○ | ○ | ○ | ○ | ○ | ○ |
| 100 | △ | ○ | ○ | ○ | ○ | ○ | ○ | ○ | ○ | ○ |
| 90 | △ | ○ | △ | ○ | △ | ○ | △ | ○ | ○ | ○ |
| 50 | × | ○ | × | ○ | × | ○ | × | ○ | △ | ○ |

*Fig. 6*

| BACKGROUND POTENTIAL (Vd−Vb) [V] | TONER CHARGE (Q/M)[μC/g] | | | | | | | | | |
|---|---|---|---|---|---|---|---|---|---|---|
| | 8 | | 10 | | 20 | | 35 | | 45 | |
| | BACK-GROUND FOG | LINE THINNING | BACK-GROUND FOG | LINE THINNING | BACK-GROUND FOG | LINE THINNING | BACK-GROUND FOG | LINE THINNING | BACK-GROUND FOG | LINE THINNING |
| 300 | ○ | × | ○ | × | ○ | × | ○ | × | ○ | × |
| 200 | △ | × | ○ | × | ○ | × | ○ | × | ○ | × |
| 110 | △ | △ | ○ | △ | ○ | △ | ○ | △ | ○ | △ |
| 100 | △ | △ | ○ | △ | ○ | △ | ○ | △ | ○ | △ |
| 90 | △ | ○ | △ | ○ | △ | ○ | △ | ○ | ○ | ○ |
| 50 | × | ○ | × | ○ | × | ○ | × | ○ | △ | ○ |

Fig. 7

| DRUM CHARGE POTENTIAL (Vd) [V] | AFTER FEED OF 10,000 SHEETS | |
|---|---|---|
| | DEFECTIVE IMAGE ESTIMATION | |
| 200 | GOOD | |
| 400 | GOOD | |
| 600 | GOOD | |
| 800 | GOOD | |
| 1000 | GOOD | |
| 1200 | MANY BLACK DOTS | |

*Fig. 8*

| BIAS (Vb) [V] | TONER CHARGE (Q/M)[μC/g] | | | | |
|---|---|---|---|---|---|
| | 8 | 10 | 20 | 35 | 45 |
| | SOLID IMAGE ID | SOLID IMAGE ID | SOLID IMAGE ID | SOLID IMAGE ID | SOLID IMAGE ID |
| 400 | 1.46 | 1.45 | 1.44 | 1.37 | 1.25 |
| 300 | 1.44 | 1.42 | 1.40 | 1.35 | 1.11 |
| 200 | 1.42 | 1.39 | 1.30 | 1.24 | 0.98 |
| 100 | 1.40 | 1.32 | 1.15 | 1.11 | 0.80 |
| 50 | 1.25 | 1.10 | 0.90 | 0.79 | 0.55 |

| BIAS (Vb) [V] | RANGE [mm] |
|---|---|
| 400 | 3.2 |
| 300 | 3.0 |
| 200 | 2.6 |
| 100 | 1.8 |
| 50 | 1.0 |

*Fig. 11*

| CARRIER SATURATION MAGNETIZATION [emu/g] | MAXIMUM FLUX DENSITY OF MAIN POLE [mT] | | | | | | | | | |
|---|---|---|---|---|---|---|---|---|---|---|
| | 120 | | 90 | | 60 | | 55 | | 50 | |
| | CARRIER DEPOSITION | LINE THINNING | CARRIER DEPOSITION | LINE THINNING | CARRIER DEPOSITION | LINE THINNING | CARRIER DEPOSITION | LINE THINNING | CARRIER DEPOSITION | LINE THINNING |
| 95 | ○ | △ | ○ | ○ | ○ | ○ | △ | ○ | × | – |
| 80 | ○ | △ | ○ | ○ | ○ | ○ | △ | ○ | × | – |
| 70 | ○ | △ | ○ | ○ | ○ | ○ | △ | ○ | × | – |
| 50 | ○ | △ | ○ | ○ | ○ | ○ | △ | ○ | × | – |
| 35 | ○ | △ | ○ | ○ | ○ | ○ | △ | ○ | × | – |
| 30 | × | – | × | – | × | – | × | – | × | – |
| 25 | × | – | × | – | × | – | × | – | × | – |

Fig. 12

| CARRIER SATURATION MAGNETIZATION [emu/g] | MAXIMUM FLUX DENSITY OF MAIN POLE [mT] | | | | | | | | | |
|---|---|---|---|---|---|---|---|---|---|---|
| | 120 | | 90 | | 60 | | 55 | | 50 | |
| | CARRIER DEPOSITION | LINE THINNING | CARRIER DEPOSITION | LINE THINNING | CARRIER DEPOSITION | LINE THINNING | CARRIER DEPOSITION | LINE THINNING | CARRIER DEPOSITION | LINE THINNING |
| 95 | ○ | △ | ○ | ○ | ○ | ○ | △ | ○ | × | – |
| 80 | ○ | △ | ○ | ○ | ○ | ○ | △ | ○ | × | – |
| 70 | ○ | △ | ○ | ○ | ○ | ○ | △ | ○ | × | – |
| 50 | ○ | △ | ○ | ○ | ○ | ○ | △ | ○ | × | – |
| 35 | ○ | △ | ○ | ○ | ○ | ○ | △ | ○ | × | – |
| 30 | × | – | × | – | × | – | × | – | × | – |
| 25 | × | – | × | – | × | – | × | – | × | – |

*Fig. 13*

| CARRIER SATURATION MAGNETIZATION [emu/g] | MAXIMUM FLUX DENSITY OF MAIN POLE [mT] | | | | | | | | | |
|---|---|---|---|---|---|---|---|---|---|---|
| | 120 | | 90 | | 60 | | 55 | | 50 | |
| | CARRIER DEPOSITION | LINE THINNING | CARRIER DEPOSITION | LINE THINNING | CARRIER DEPOSITION | LINE THINNING | CARRIER DEPOSITION | LINE THINNING | CARRIER DEPOSITION | LINE THINNING |
| 95 | ○ | △ | ○ | ○ | ○ | ○ | △ | ○ | × | — |
| 80 | ○ | △ | ○ | ○ | ○ | ○ | △ | ○ | × | — |
| 70 | ○ | △ | ○ | ○ | ○ | ○ | △ | ○ | × | — |
| 50 | ○ | △ | ○ | ○ | ○ | ○ | △ | ○ | × | — |
| 35 | ○ | △ | ○ | ○ | ○ | ○ | △ | ○ | × | — |
| 30 | × | — | × | — | × | — | × | — | × | — |
| 25 | × | — | × | — | × | — | × | — | × | — |

*Fig. 14*

| CARRIER SATURATION MAGNETIZATION [emu/g] | MAXIMUM FLUX DENSITY OF MAIN POLE [mT] | | | | | | | | | |
|---|---|---|---|---|---|---|---|---|---|---|
| | 120 | | 90 | | 60 | | 55 | | 50 | |
| | CARRIER DEPOSITION | LINE THINNING | CARRIER DEPOSITION | LINE THINNING | CARRIER DEPOSITION | LINE THINNING | CARRIER DEPOSITION | LINE THINNING | CARRIER DEPOSITION | LINE THINNING |
| 95 | △ | △ | △ | ○ | △ | ○ | △ | ○ | × | – |
| 80 | △ | △ | △ | ○ | △ | ○ | △ | ○ | × | – |
| 70 | △ | △ | △ | ○ | △ | ○ | △ | ○ | × | – |
| 50 | △ | △ | △ | ○ | △ | ○ | △ | ○ | × | – |
| 35 | △ | △ | △ | ○ | △ | ○ | △ | ○ | × | – |
| 30 | × | – | × | – | × | – | × | – | × | – |
| 25 | × | – | × | – | × | – | × | – | × | – |

*Fig. 15*

| CARRIER SATURATION MAGNETIZATION [emu/g] | MAXIMUM FLUX DENSITY OF MAIN POLE [mT] | | | | | | | | | |
|---|---|---|---|---|---|---|---|---|---|---|
| | 120 | | 90 | | 60 | | 55 | | 50 | |
| | CARRIER DEPOSITION | LINE THINNING | CARRIER DEPOSITION | LINE THINNING | CARRIER DEPOSITION | LINE THINNING | CARRIER DEPOSITION | LINE THINNING | CARRIER DEPOSITION | LINE THINNING |
| 95 | △ | ○ | △ | ○ | △ | ○ | △ | ○ | × | — |
| 80 | △ | ○ | △ | ○ | △ | ○ | △ | ○ | × | — |
| 70 | △ | ○ | △ | ○ | △ | ○ | △ | ○ | × | — |
| 50 | △ | ○ | △ | ○ | △ | ○ | △ | ○ | × | — |
| 35 | △ | ○ | △ | ○ | △ | ○ | △ | ○ | × | — |
| 30 | × | — | × | — | × | — | × | — | × | — |
| 25 | × | — | × | — | × | — | × | — | × | — |

*Fig. 16*

| Gd/Gp | DEVELOPMENT GAP (Gp) [mm] | | | | | | | | | |
|---|---|---|---|---|---|---|---|---|---|---|
| | 0.2 | | 0.4 | | 0.6 | | 0.8 | | 1.0 | |
| | GRANU-LARITY | LINE THINNING | GRANU-LARITY | LINE THINNING | GRANU-LARITY | LINE THINNING | GRANU-LARITY | LINE THINNING | GRANU-LARITY | LINE THINNING |
| 1.0 | ○ | ○ | ○ | ○ | ○ | ○ | ○ | ○ | △ | ○ |
| 0.9 | ○ | ○ | ○ | ○ | ○ | ○ | ○ | ○ | △ | ○ |
| 0.8 | ○ | ○ | ○ | ○ | ○ | ○ | ○ | ○ | △ | ○ |
| 0.7 | △ | ○ | △ | ○ | △ | ○ | △ | ○ | △ | ○ |
| 0.6 | × | ○ | × | ○ | × | ○ | × | ○ | × | ○ |
| 0.5 | × | ○ | × | ○ | × | ○ | × | ○ | × | ○ |

Fig. 19

| Gd/Gp | DEVELOPMENT GAP (Gp) [mm] | | | | | | | | | |
|---|---|---|---|---|---|---|---|---|---|---|
| | 0.2 | | 0.4 | | 0.6 | | 0.8 | | 1.0 | |
| | GRANU-LARITY | LINE THINNING | GRANU-LARITY | LINE THINNING | GRANU-LARITY | LINE THINNING | GRANU-LARITY | LINE THINNING | GRANU-LARITY | LINE THINNING |
| 1.0 | △ | × | △ | × | △ | △ | △ | △ | △ | △ |
| 0.9 | △ | × | △ | × | △ | △ | △ | △ | △ | △ |
| 0.8 | △ | × | △ | × | △ | △ | △ | △ | △ | △ |
| 0.7 | △ | × | △ | × | △ | △ | △ | △ | △ | △ |
| 0.6 | △ | × | △ | × | △ | △ | △ | △ | △ | △ |
| 0.5 | △ | × | △ | × | △ | △ | △ | △ | △ | △ |

Fig. 21

| Hd/Gp | DEVELOPMENT GAP (Gp) [mm] | | | | | | | | | |
|---|---|---|---|---|---|---|---|---|---|---|
| | 0.2 | | 0.4 | | 0.6 | | 0.8 | | 1.0 | |
| | GRANU-LARITY | LINE THINNING | GRANU-LARITY | LINE THINNING | GRANU-LARITY | LINE THINNING | GRANU-LARITY | LINE THINNING | GRANU-LARITY | LINE THINNING |
| 1.0 | ○ | ○ | ○ | ○ | ○ | ○ | ○ | ○ | △ | ○ |
| 0.9 | ○ | ○ | ○ | ○ | ○ | ○ | ○ | ○ | △ | ○ |
| 0.8 | ○ | ○ | ○ | ○ | ○ | ○ | ○ | ○ | △ | ○ |
| 0.7 | △ | ○ | △ | ○ | △ | ○ | △ | ○ | △ | ○ |
| 0.6 | × | ○ | × | ○ | × | ○ | × | ○ | × | ○ |
| 0.5 | × | ○ | × | ○ | × | ○ | × | ○ | × | ○ |

Fig. 25

| IMAGE FORMING FACTORS | BIAS FOR DEVELOPMENT [V] | CHARGE POTENTIAL [V] | QUANTITY OF LIGHT [pJ] |
|---|---|---|---|
| LOWER LIMIT | -144 | -216 | 0.44 |
| | ↓ | ↓ | ↓ |
| CENTER VALUE | -400 | -600 | 3.00 |
| | ↓ | ↓ | ↓ |
| UPPER LIMIT | -656 | -984 | 5.56 |
| NUMBER OF STEPS | 256 STEPS (INTERVAL OF 2V) | 256 STEPS (INTERVAL OF 3V) | 256 STEPS (0.02 pJ) |

*Fig. 38*

| No. | 1 | 2 | 3 | 4 | 5 | 6 | 7 | 8 | 9 |
|---|---|---|---|---|---|---|---|---|---|
| DRUM DIAMETER [mm] | 30 | | | 60 | | | 90 | | |
| SLEEVE DIAMETER [mm] | 16 | | | 20 | | | 30 | | |
| DEVELOPMENT GAP [mm] | 0.4 | | | 0.4 | | | 0.4 | | |
| NIP [mm] | 4 | 2.5 | 1.5 | 4 | 3 | 2 | 6 | 4 | 3 |
| DISTANCE AT NIP BOUNDARY [mm] | 0.79 | 0.55 | 0.45 | 0.67 | 0.55 | 0.47 | 0.80 | 0.58 | 0.50 |
| RATIO IN DISTANCE | 1.97 | 1.38 | 1.13 | 1.67 | 1.38 | 1.17 | 2.00 | 1.45 | 1.25 |
| HALF WIDTH [°] | 45 | 25 | 22 | 48 | 22 | 16 | 27 | 22 | 15 |
| MAIN POLE + AUX. POLE | 1 | 1 | 3 | 1 | 1 | 3 | 1 | 1 | 3 |

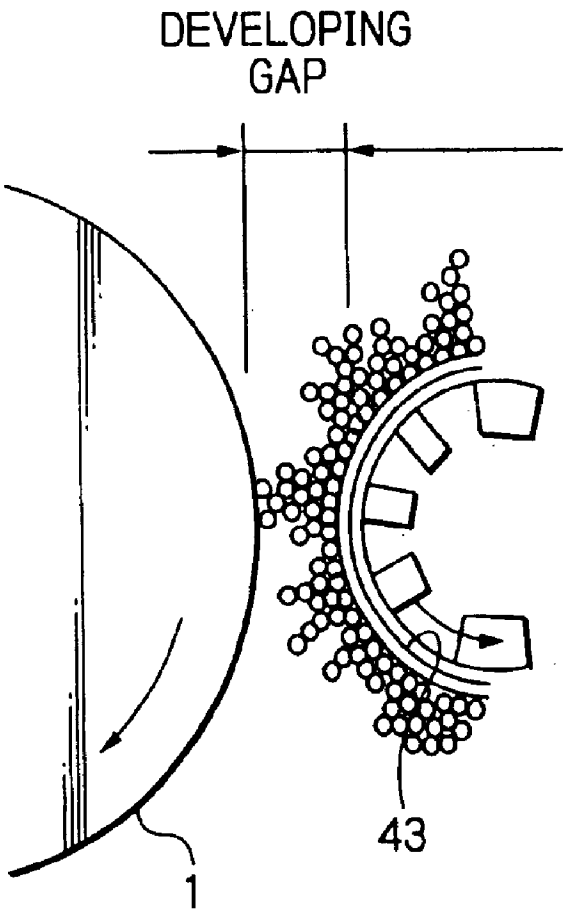
Fig. 45
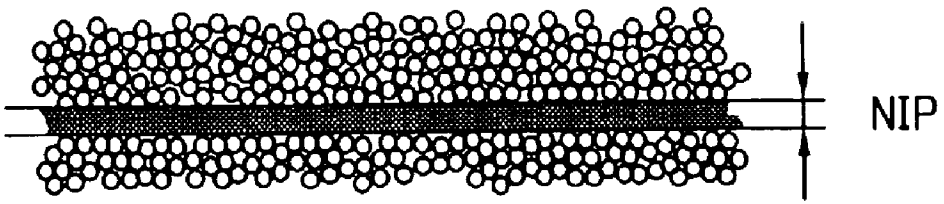

Fig. 47

| EXAMPLE 1 | | | | | | |
|---|---|---|---|---|---|---|
| POLE | P1 | P2 | P3 | P4 | P5 | P6 |
| POLARITY | N | S | S | S | N | S |
| PEAK FLUX DENSITY (mT) | 130 | 65 | 7 | 20 | 72 | 75 |
| CENTER HALF ANGLE (°) | 0 | 60 | 115 | 157 | 207 | 291 |
| CENTER HALF-POWER ANGLE | 18 | 40 | – | 35 | 34 | 29 |
| EXAMPLE 2 | | | | | | |
| POLE | P1 | P2 | P3 | P4 | P5 | P6 |
| POLARITY | N | S | S | S | N | S |
| PEAK FLUX DENSITY (mT) | 110 | 60 | 4 | 30 | 79 | 82 |
| CENTER HALF ANGLE (°) | 0 | 62 | 118 | 158 | 224 | 285 |
| CENTER HALF-POWER ANGLE | 20 | 30 | – | 30 | 47 | 41 |
| EXAMPLE 3 | | | | | | |
| POLE | P1 | P2 | P3 | P4 | P5 | P6 |
| POLARITY | N | S | S | S | N | S |
| PEAK FLUX DENSITY (mT) | 94 | 73 | 5 | 52 | 65 | 58 |
| CENTER HALF ANGLE (°) | 0 | 65 | 120 | 154 | 217 | 291 |
| CENTER HALF-POWER ANGLE | 30 | 46 | – | 35 | 55 | 40 |
| EXAMPLE 4 | | | | | | |
| POLE | P1 | P2 | P3 | P4 | P5 | P6 |
| POLARITY | N | S | S | S | N | S |
| PEAK FLUX DENSITY (mT) | 95 | 90 | 50 | 5 | 60 | 55 |
| CENTER HALF ANGLE (°) | 0 | 62 | 117 | 160 | 223 | 289 |
| CENTER HALF-POWER ANGLE | 37 | 47 | 42 | – | 45 | 59 |
| EXAMPLE 5 | | | | | | |
| POLE | P1 | P2 | P3 | P4 | | |
| POLARITY | N | S | N | S | | |
| PEAK FLUX DENSITY (mT) | 94 | 73 | 10 | 80 | | |
| CENTER HALF ANGLE (°) | 0 | 65 | – | 290 | | |
| CENTER HALF-POWER ANGLE | 25 | 46 | – | 55 | | |
| COMPARATIVE EXAMPLE 1 | | | | | | |
| POLE | P1 | P2 | P3 | P4 | P5 | P6 |
| POLARITY | N | S | S | S | N | S |
| PEAK FLUX DENSITY (mT) | 95 | 90 | 50 | 5 | 60 | 55 |
| CENTER HALF ANGLE (°) | 0 | 62 | 117 | 160 | 223 | 289 |
| CENTER HALF-POWER ANGLE | 46 | 47 | 35 | – | 37 | 55 |
| COMPARATIVE EXAMPLE 2 | | | | | | |
| POLE | P1 | P2 | P3 | P4 | P5 | P6 |
| POLARITY | N | S | S | S | N | S |
| PEAK FLUX DENSITY (mT) | 94 | 73 | 5 | 52 | 65 | 58 |
| CENTER HALF ANGLE (°) | 0 | 62 | 105 | 148 | 217 | 291 |
| CENTER HALF-POWER ANGLE | 45 | 46 | – | 35 | 55 | 40 |
| COMPARATIVE EXAMPLE 3 | | | | | | |
| POLE | P1 | P2 | P3 | P4 | P5 | P6 |
| POLARITY | N | S | S | S | N | S |
| PEAK FLUX DENSITY (mT) | 95 | 65 | 5 | 27 | 68 | 75 |
| CENTER HALF ANGLE (°) | 0 | 63 | 110 | 154 | 206 | 289 |
| CENTER HALF-POWER ANGLE | 50 | 37 | – | 30 | 40 | 52 |

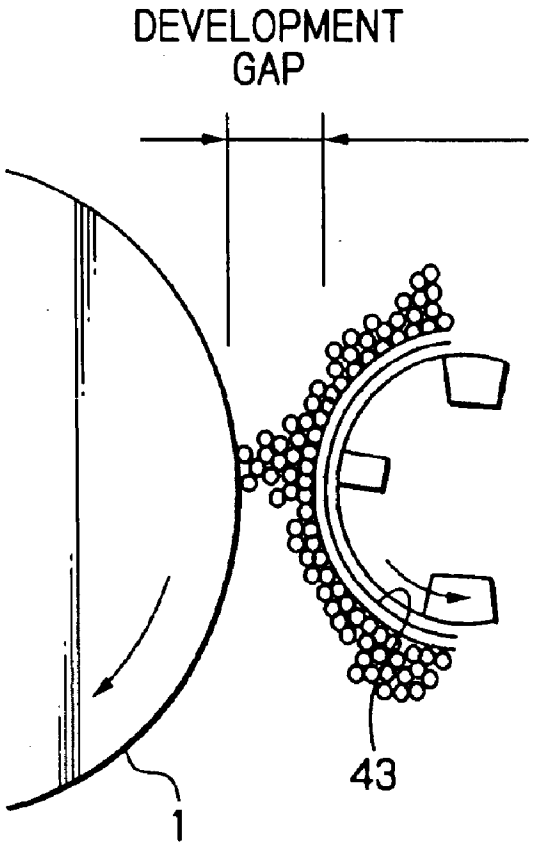
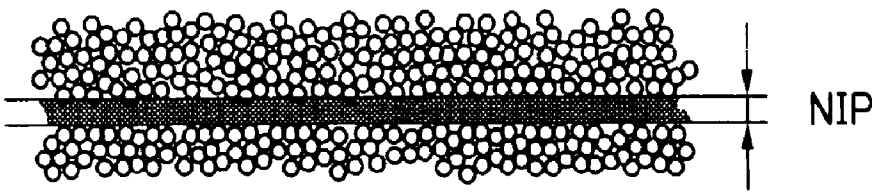
Fig. 49

Fig. 52

| No. | 1 | 2 | 3 | 4 | 5 | 6 |
|---|---|---|---|---|---|---|
| DRUM DIAMETER [mm] | 30 | | 60 | | 90 | |
| SLEEVE DIAMETER [mm] | 16 | | 20 | | 30 | |
| DEVELOPMENT GAP [mm] | 0.4 | | 0.4 | | 0.4 | |
| NIP [mm] | 4 | 1.5 | 4 | 2 | 7 | 4 |
| DISTANCE AT NIP BOUNDARY [mm] | 0.79 | 0.45 | 0.67 | 0.47 | 0.95 | 0.58 |
| RATIO IN DISTANCE | 1.67 | 1.17 | 2.38 | 1.45 | 1.97 | 1.13 |

IMAGE FORMING APPARATUS

BACKGROUND OF THE INVENTION

The present invention relates to a printer, digital copier, facsimile apparatus or similar electrophotographic image forming apparatus. More particularly, the present invention relates to a developing method for causing a developer to form a magnet brush on a developer carrier in a developing region for developing a latent image formed on an image carrier, and a device for practicing the same.

A developing device for an image forming apparatus is operable with either one of a one-ingredient type developer, or toner, and a two-ingredient type developer or toner and magnetic carrier mixture. The two-ingredient type developer allows the frictional charging of its toner to be easily controlled, causes the toner to cohere little, and therefore allows toner transfer to be effectively controlled by, e.g., a bias, compared to the one-ingredient type developer. Further, the toner of the two-ingredient type developer does not have to contain a magnetic material or needs only a small amount of magnetic material if necessary to obviate, e.g., fog. Particularly, the two-ingredient type developer insures images with clear colors. Moreover, when a developer layer contacts an image carrier in the form of a magnet brush, it sharply rises and contacts the image carrier in a desirable manner. This is why the two-ingredient type developer is predominant over the one-ingredient type toner although its toner must be controlled in amount relative to the carrier.

The two-ingredient type developer, however, brings about the following problems. A one-dot line formed in a direction perpendicular to a direction of sheet conveyance, i.e., a horizontal line is thinned, compared to a line formed in the direction of sheet conveyance (thinning of a horizontal line hereinafter). The trailing edge of, e.g., a halftone portion in the direction of sheet conveyance is lowered in density or practically lost (omission of a trailing edge hereinafter). In light of this, Japanese Patent Laid-Open Publication No. 7-140730, for example, proposes to set the angle of the main pole of a magnet roller at the upstream side or to set up a preselected relation between a distance between a metering member and a developing sleeve and a distance between the developing sleeve and a photoconductive element. This kind of method should satisfy the following conditions (1) through (5):

(1) The main pole lies in a range of from 5° to 20° upstream of the closest position in a direction or developer conveyance;

(2) A doctor gap Hcut between the metering member and the developing sleeve or developer carrier is 0.25 mm to 0.75 mm;

(3) A development gap Dsd between the developing sleeve and the photoconductive element or image carrier is 0.30 mm to 0.80 mm;

(4) A ratio Dsd/Hcut is greater than 1.20, but smaller than 1.60; and (5) A ratio of the moving speed Vs of the developing sleeve to the moving speed Vp of the photoconductive element is equal to or greater than 1.0, but equal to or smaller than 3.00.

The document mentioned above describes that when the conditions (1) through (5) are satisfied, a halftone portion or a solid portion is free from brush marks and the discontinuity of a fine line in a high copying speed range, achieving high, uniform density, and a clear-cut contour.

The method taught in the document, however, has the following problems left unsolved. As the ratio Dsd/Hcut shifts from 1, i.e., as the doctor gap Hcut becomes smaller than the development gap Dsd, the magnet brush between the developing sleeve and the photoconductive element becomes rough. The magnet brush therefore fails to uniformly contact the photoconductive element. Consequently, in a solitary dot image, in particular, in which dots with resolution of, e.g., 600 dpi (dots per inch) are recorded at the intervals of five to ten pixels, part of the dots is reduced in size or practically lost. This degrades the reproducibility and therefore tonality of a so-called high contrast portion. Further, as for a halftone image with image density ID ranging from 0.3 to 0.8, the irregular contact of the magnet brush aggravates granularity.

Japanese Patent Publication No. 2-59995 proposes to enhance a developing ability by bringing magnetic poles adjoining a main magnetic pole closer to the main magnetic pole. This document describes that although such a configuration lowers the density of a horizontal line (thinning of a horizontal line), this problem can be coped with by lowering the saturation magnetization of the carrier. However, when the saturation magnetization of the carrier is lowered, the deposition of the carrier is apt to occur. Should the amount of charge to deposit on the toner be reduced to avoid the deposition of the carrier, uncharged toner would increase and contaminate the background of an image.

Japanese Patent Laid-Open Publication No. 9-149063 teaches a non-contact type developing device using a two-ingredient type developer and arranging magnetic poles in such a manner as to prevent a magnet brush from contacting a photoconductive element. This developing device should satisfy the following conditions (1) through (3):

(1) The magnetic pole arrangement is set between a pair of N and S poles;

(2) The N and S poles make an angle of 40° to 70° therebetween, and each has a flux density of 500 mT or above; and (3) A magnet angle between a position where an image carrier and, a magnet brush roll are closest to each other and the center between the poles is between 0° and one-tenth of the angle between the poles, and a developing position is located between the poles of the magnet.

The document describes that when the conditions (1) through (3) are satisfied, a high quality image is attainable that is free from fog ascribable to the deposition of a carrier on the background of the image carrier and local omission around the deposited carrier. However, an electric field for development available with non-contact type development using the two-ingredient type developer is too weak to enhance a developing ability.

Generally, the absolute value of a difference between the charge potential of a photoconductive element and a bias for development, i.e., so-called background potential is related to the thinning of a horizontal line and the omission of a trailing edge. In the conventional developing device, the above defects can be reduced to an acceptable level it the background potential is reduced to, e.g., about 100 V or about 50 V. Such a low background potential, however, brings about background contamination or fog. This is particularly true in a hot, humid environment.

On the other hand, Japanese Patent application No. 11-318490 discloses an image forming apparatus capable of obviating the thinning of a horizontal line and the omission of a trailing edge. Further, this apparatus prevents solitary dots from being lost due to the irregular contact of a magnet brush and frees a halftone image from granularity. In addition, the apparatus obviates the deposition of the carrier to thereby maintain a high developing ability. However, a problem with this apparatus is that the magnet brush actively moves in a small gap between an image carrier and a developer carrier, causing the carrier to fly about during development and deposit on the image carrier as well as an the other members. Consequently, the image carrier is apt to convey the carrier to an image transfer position. The carrier therefore prevents toner around the carrier from being transferred to a paper sheet or similar recording medium, resulting in a defective image. Moreover, if the carrier is transferred to the paper sheet, it simply constitutes an impurity in the resulting image because it is not fixed on the paper sheet.

Granularity often appears in images, particularly halftone images, output by the conventional image forming apparatuses. Granularity is one of major causes that lower image quality.

It is a common practice with an image forming apparatus to maintain the density of a toner image by forming a particular toner image (patch hereinafter) on a photoconductive element or an intermediate image transfer body and sense the density of the patch with a density sensor. The sensed density is fed back in order to adequately control the quantity of light for exposure or a bias for development. With this scheme, it is possible to maintain images constant despite, e.g., the varying environment and aging. Because the patch is not expected to be printed by the image forming apparatus, it is simply collected by cleaning means after the sensing of the density. This wastefully consumes toner and needs replenishment of extra toner while increasing the amount of waste toner collected. Further, the patch is formed in a non-image portion not corresponding to a paper sheet and therefore smears an image transfer belt, an image transfer roller, an intermediate image transfer belt, and members contacting them. The toner deposited on such members is transferred to the back or the background of the resulting print, making the print defective Moreover, the toner forming the patch flies about to contaminate the density sensor. Particularly, a light-sensitive portion forming part of the sensor, which adjoins the patch in order to enhance accuracy, is contaminated more than the other member. The toner deposited on the sensor lowers the output of the sensor and thereby obstructs the accurate sensing of density. To solve this problem, Japanese Patent Laid-Open Publication No. 11-202696 proposes to inform the operator of the contamination of the sensor by using extra means for sensing it. This method, however, is not a drastic solution because it needs the extra means and requires the operator or a serviceman to clean the sensor. In addition, the patch size should be as small as possible because the contamination derived from the path lowers sensing accuracy.

In the conventional developing system using a magnet brush, a developing condition for increasing image density and a developing condition for rendering a low contrast image desirable are contradictory to each other. It is therefore difficult to improve both of a high density portion and a low density portion at the same time. More specifically, to increase image density, the gap between the image carrier and the developing sleeve (development gap) may be reduced, or the width of the developing region may be increased. On the other hard, to render a low contrast portion desirable, the development gap may be increased, or the developing region may be reduced. The two developing conditions are therefore contradictory. It is generally considered to be difficult to achieve an attractive image by satisfying the two conditions over the entire density range.

An increase in development gap serves to reduce the frictional force of the magnet brush acting on the image carrier, thereby reducing the omission of a trailing edge and promoting the faithful reproduction of a horizontal line. However, a greater development gap enhances an edge effect during development, i.e., develops solitary dots in a greater site than expected, thickens lines, enhances a portion around a solid image portion or a halftone image portion or causes the outside of such an image portion to be lost. As a result, sophisticated control over tonality reproduction is required, A small development gap reduces the edge effect and frees an image from noticeable granularity. A small development gap, however, intensifies the frictional force of the magnet brush and thereby aggravates the omission of trailing edge and that of dots while obstructing the reproduction of a horizontal line. The resulting image is therefore noticeably dependent on direction.

As for an electrophotographic image forming apparatus, there is an increasing demand for higher resolution and higher tonality. A problem in this respect is that high pixel density reduces the individual pixel relative to the spot diameter of a beam to issue from an exposing unit, preventing sufficient tonality from being achieved.

Tonality is dependent on the beam spot diameter, as well known in the art. A large beam spot diameter relative to pixel density degrades the reproducibility of a low density portion or highlight portion. This is because when a solitary dot is written, a latent image representative of it is shallow due to low exposure energy density, making reproduction unstable. On the other hand, in a high density portion, nearby pixels are exposed in such a manner as to overlap each other with the result that image density rapidly saturates relative to a density area ratio, causing gamma to rise, i.e., lowering tonality. While the quantity of light for a dot may be increased to reproduce a solitary dot, the solitary dot increases in size and further aggravates tonality.

Therefore, to enhance resolution while maintaining tonality, the beam spot diameter rust be reduced in accordance with pixel density. In laser optics, for example, the beam spot diameter can be reduced if the wavelength of a laser beam is reduced or if the numerical aperture (NA) of an f/θ lens is increased. On the other hand, in an LED (Light Emitting Diode) array or similar solid state optics, use may be made of a selfoc lens array (SLA), or LEDs may be reduced in size.

Today, high resolution and high tonality, which have been difficult to achieve with conventional image forming apparatuses due to accuracy and cost problems, are available with may products. However, as for exposure using a beam whose spot diameter is equivalent to a pixel size, tonality is not sufficient when it comes to recent, high density images. Particularly, reproducibility tends to decrease in a highlight portion with an increase in recording density for the following reasons. As for a latent image representative of solid dots, a charge distribution corresponding to a small dot size is attainable. However, during development, the edge effect renders the dots in a size greater than the target size. Further, the magnet brush with countercharge after development rubs itself against the toner image, so that the toner is returned to the developing roller. This aggravates irregularity in the area of the dot and thereby lowers the reproducibility of a highlight portion.

Moreover, when the recording density is as high as 1,200 dpi, solitary dots are further reduced in size and cannot be easily formed by development. In addition, the reproducibility of a highlight portion is lowered.

Technologies relating to the present invention are also disclosed in, e.g., Japanese Patent Laid-Open Publication Nos. 8-160725 and 2000-305360.

SUMMARY OF THE INVENTION

It is a first object of the present invention to provide an image forming apparatus capable of obviating the thinning of a horizontal line and the omission of a trailing edge and causing a minimum of background fog to occur, and a developing device therefore.

It is a second object of the present invention to provide an image forming apparatus capable of obviating the thinning of a horizontal line and the omission of a trailing edge, enhancing a developing ability, and causing a minimum of carrier from flying about, and a developing device therefor.

It is a third object of the present invention to provide an image forming apparatus capable not only of obviating the thinning of a horizontal line and the omission of a trailing edge but also of reducing granularity, and a developing device therefor.

It is a fourth object of the present invention to provide an image forming apparatus capable of obviating the thinning of a horizontal line and the omission of a trailing edge, obviating the omission of solitary dots and the granularity of a halftone image ascribable to the irregular contact of a magnet brush, and solving problems ascribable to a patch, and a developing device therefor.

It is a fifth object of the present invention to provide an image forming apparatus capable of obviating the omission of a trailing edge, the low reproducibility of a horizontal line and the omission of dots, obviating the omission of dots or similar noise, reducing granularity and enhancing the reproducibility of tonality even when a development gap is reduced, and a developing device therefor.

It is a sixth object of the present invention to provide an image forming apparatus capable of desirably reproducing a low contrast image, reducing image noise, and enhancing the reproducibility of tonality, and a developing device therefor, It is a seventh object of the present invention to provide an image forming apparatus capable of achieving resolution and tonality at the same time by using an adequate beam spot diameter even when recording density is high, and a developing device therefore In accordance with the present invention, in an image forming method using a developer carrier for conveying a developer, which is made up of toner and a carrier, deposited thereon, and a magnetic field generating body held stationary within the developer carrier for forming a magnet brush on the developer carrier. The magnet brush contacts an image carrier to thereby develop a latent image formed on the image carrier. An auxiliary magnetic pole exists between a main magnetic pole, which causes the developer to rise and form the magnet brush in a developing region, and a magnetic pole that conveys the developer. An amount of charge to deposit on the toner ranges from 10 $\mu$C/g to 35 $\mu$C/g. A background potential is 100 V or above.

Also, in accordance with the present invention, an image forming apparatus includes an image carrier. A developer carrier conveys a developer, which is made up of toner and a carrier, deposited thereon. A magnetic field generating body is held stationary within the developer carrier for forming a magnet brush on the developer carrier. The magnet brush contacts the image carrier for thereby developing a latent image formed on the image carrier. An auxiliary magnetic pole helps a main magnetic pole, which causes the developer to rise and form the magnet brush in a developing region, exert a magnetic force, thereby reducing the half width of the main magnetic pole. An amount of charge to deposit on the toner ranges from 10 $\mu$C/g to 35 $\mu$C/g. A background potential is 100 V or above.

Further, in accordance with the present invention, an image forming apparatus includes an image carrier and a developer carrier for conveying a developer, which is made up of toner and a carrier, deposited thereon. A magnetic field generating body is held stationary within the developer carrier for forming magnet brush on the developer carrier. The magnet brush contacts the image carrier for thereby developing a latent image formed on the image carrier. An auxiliary magnetic pole helps a main magnetic pole, which causes the developer to rise and form the magnet brush in a developing region, exert a magnetic force, thereby reducing the half width of the main magnetic pole. Assuming that the developer carrier and image carrier rotate at peripheral speeds of vd and vp, respectively, a ratio vd/vp is 2.5 or below. The main pole has a flux density whose peak value is 60 mT or above. The carrier of the developer has a saturation magnetization of 35 emu/g or above.

Moreover, in accordance with the present invention, an image forming apparatus includes an image carrier and a developer carrier for conveying a developer, which is made up of toner and a carrier, deposited thereon. A magnetic field generating body is held stationary within the developer carrier for forming magnet brush on the developer carrier. The magnet brush contacts the image carrier for thereby developing a latent image formed on the image carrier. A metering member regulates the thickness of the developer deposited on the image carrier. An auxiliary magnetic pole helps a main magnetic pole, which causes the developer to rise and form the magnet brush in a developing region, exert a magnetic force, thereby reducing the half width of the main magnetic pole. Assuming that a gap between the developer carrier and the metering member and a gap between the image carrier and the developer carrier are Gd and Gp, respectively, a ratio, Gd/Gp is between 0.8 and 1.0.

BRIEF DESCRIPTION OF THE DRAWINGS

The above and other objects, features and advantages of the present invention will become more apparent from the following detailed description taken with the accompanying drawings in which:

FIGS. 5 and 6 are tables each showing particular experimental results representative of a relation between background fog and the thinning of a horizontal line;

FIG. 7 is a table listing experimental results representative of a relation between the charge potential of the image carrier and the resulting image quality;

FIG. 8 is a table listing experimental results representative of a relation between a bias for development and the image density ID of a black solid image;

FIGS. 11 through 15 are tables listing experimental results particular to a fourth embodiment of the present invention and representative of a relation between the saturation magnetization of the carrier and the maximum flux density of a main pole and the scattering of the carrier in an image;

FIG. 16 is a table listing experimental results particular to a sixth embodiment of the present invention and representative of a relation between a development gap and the granularity of an image;

FIG. 19 is a table similar to FIG. 16;

FIG. 21 is a table listing experimental results similar to the results of FIG. 16;

FIG. 25 is a table listing image forming conditions particular to the ninth embodiment;

FIG. 38 is a table listing experimental results conducted with the fourteenth embodiment for determining the obviation of the omission of a trailing edge;

FIG. 45 is a view showing the size of the development gap and that of a nip unique to the fifteenth embodiment;

FIG. 47 is a table comparing examples and comparative examples as to a center half-power angle;

FIG. 49 is a view showing the size of the development gap and that of a nip;

FIG. 52 is a table listing the results of experiments conducted to determine the obviation of the omission of a trailing edge;

DESCRIPTION OF THE PREFERRED EMBODIMENTS

To better understand the present invention, the general construction of an image forming apparatus and that of a developing device will be described.

Figure 1:
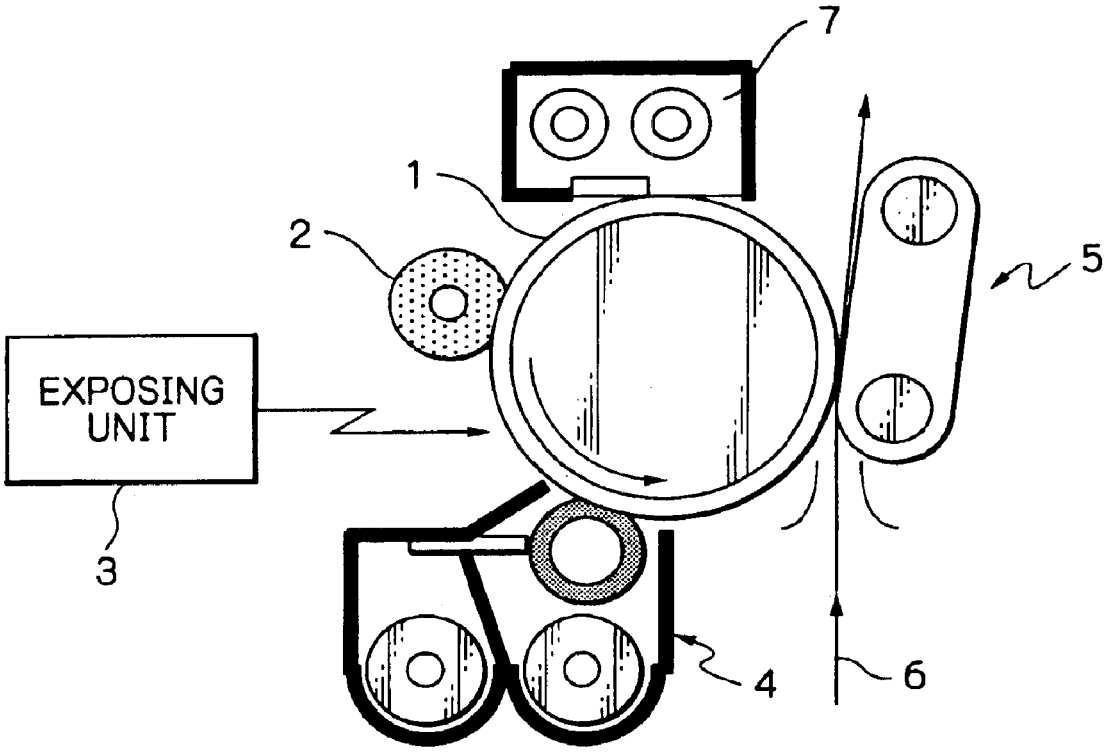
Fig. 1 PRIOR ART
FIG. 1 is a view showing a conventional image forming apparatus to which the present invention is applied.

Referring to FIG. 1 of the drawings, an image forming apparatus includes a photoconductive element 1, which is a specific form of an image carrier, rotatable in a direction indicated by an arrow (counterclockwise). A charger 2 uniformly charges the surface of the drum 1 to a preselected potential. An exposing unit 3 exposes the charged surface of the drum1 in accordance with image data to thereby form a latent image. A developing device 4 develops the latent image with toner for producing a corresponding toner image. The developing device 4 includes a casing and a developing sleeve or developer carrier. An image transferring unit 5 transfers the toner image from the drum 1 to a paper sheet or similar recording medium 6. The paper sheet 6 with the toner image is conveyed to a fixing unit, not shown, and has the toner image fixed thereby. A cleaner 7 removes toner left on the drum 1 after the image transfer. Further, a discharger, not shown, discharges the surface of the drum 1 to thereby prepare the drum 1 for the next image formation.

Figure 2:
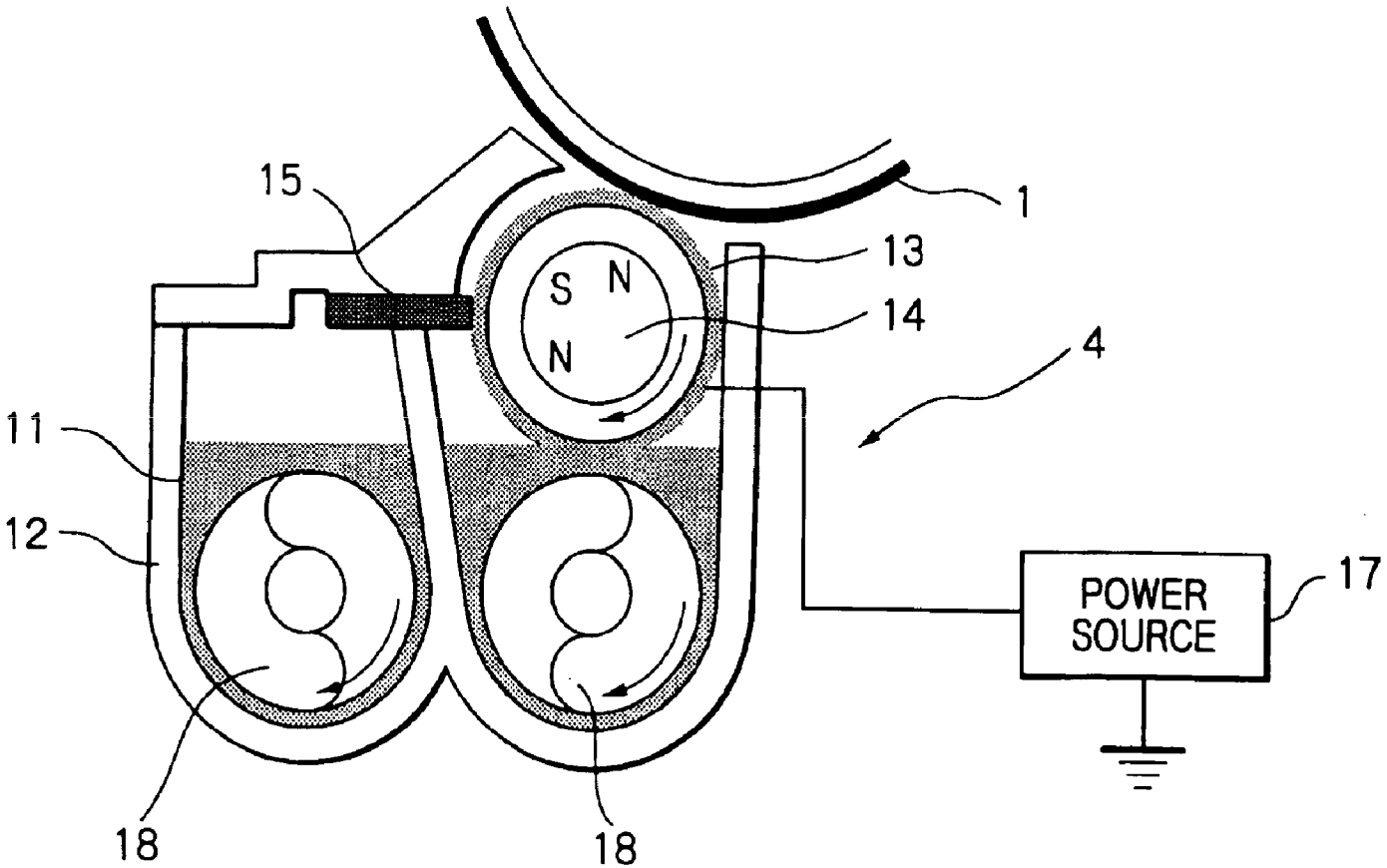
Fig. 2 PRIOR ART
FIG. 2 is a view showing a developing device included in the apparatus of FIG. 1.

As shown in FIG. 2, the developing device 4 stores a two-ingredient type developer, or toner and carrier mixture, 11 in a casing 12 thereof. A developing sleeve 13 is disposed in the opening of the casing 12 and faces the drum 1. A drive source not shown, causes the developing sleeve 13 to rotate in a direction indicated by an arrow (clockwise). A magnet roller or magnetic field forming means 14 having N and S poles is held stationary within the developing sleeve 13.

The developing sleeve 13 in rotation conveys the developer deposited thereon to a developing region. A metering member, or regulating member, 15 adjoins, but does not contact the developing sleeve 13, and regulates the amount of developer deposited on and being conveyed by the developing sleeve 13. In the developing region, the developer forming a magnet brush on the developing sleeve 13 contacts the drum 1. A power supply 17 applies a DC voltage to the developing sleeve 13. As a result, an electric field corresponding to the latent image formed on the drum 1 is formed between the drum 1 and the developing sleeve 13. The electric field causes the toner contained in the developer and charged beforehand to deposit on the drum 1.

The casing 12 accommodates a pair of parallel screws 18. A drive source, not shown, causes the screws 18 to rotate in such a manner as to convey the developer 11 in opposite directions perpendicular to the sheet surface of FIG. 2. When fresh toner is replenished from a toner container, not shown, to the casing 12, the screws 18 agitate it together with the developer 11 to thereby Maintain the toner content of the developer 11 constant.

Preferred embodiments of the image forming apparatus in accordance with the present invention will be described hereinafter.

First Embodiment

This embodiment is mainly directed toward the first object stated earlier. The illustrative embodiment is essentially identical with the image forming apparatus described with reference to FIGS. 1 and 2 as to the general mechanical structure. The structure of FIGS. 1 and 2 will be described more specifically. In FIG. 1, the drum 1 is implemented by, e.g. a conductor coated with a photoconductive material and is rotatable at a peripheral speed of, e.g., 230 mm/sec, The charger 2 includes a roller contacting the drum 1 and a power supply for applying a voltage to the roller. The charger 2 uniformly charges the surface of the drum 1 to a preselected potential, e.g., −0.6 kV. The exposing unit 3 includes a light source, e.g., a laser diode for emitting a laser beam. The laser beam scans the charged surface of the drum 1 in accordance with image data to thereby form a latent image on the drum 1.

The developing device 4 develops the latent image with toner for thereby forming a corresponding toner image. The paper sheet 6 is conveyed to the image transferring unit 6 by conveying means, not shown, at preselected timing. The toner image is transferred from the drum 1 to the paper sheet 6 and then fixed by the fixing unit. The cleaner 7 removes the toner left on the drum 1 after the image transfer. Subsequently, the discharger discharges the surface of the drum 1 to prepare it for the next image formation.

The developing sleeve 13, developer 11 and power supply 11 constitute developing means. A voltage of, e.g., −0.4 kV is applied to the developing sleeve 13. The developing device 4 develops the exposed portion of the drum 1 with the toner (so-called reversal development).

The image transferring unit 5 includes a belt by way of example. A power supply, not shown, applies a voltage to the belt by constant current control (30 $\mu$A), so that the toner image is transferred from the drum 1 to the paper sheet 6. The charge deposited on the drum 1 by the charger 2 before exposure, particularly a background potential that is a difference between a potential Vd deposited on a non-image portion and a potential Vb deposited on an image portion, forms an electric field for causing a minimum of toner to deposit on the background of an image. Stated another way, by increasing the background potential, it is possible to reduce so-called background contamination or fog. In the illustrative embodiment, the background potential is selected to be 100 V or above, e.g., 200 V. The toner contained in the developer 11 is charged to 10 $\mu$C/g to 35 $\mu$C/g.

The developing device 4 shown in FIG. 2 using a two-ingredient type developer will be described more specifically hereinafter. In the illustrative embodiment, the developing sleeve 13 is formed of, e.g., aluminum and has a diameter of 20 mm, a length of 320 mm, and a wall thickness of 0.7 mm. Axial grooves each being 0.2 mm deep by way of example are formed in the outer periphery of the developing sleeve 13 at the intervals of 1 mm in the circumferential direction of the sleeve 13. The developing sleeve 13 rotates at a peripheral speed of 460 mm/sec. The ratio of the peripheral speed of the developing sleeve 13 to that of the drum 1 is 2.0.

The toner contained in the developer 11 is nonmagnetic toner having a mean particle size of 5.0 $\mu$m and is chargeable to negative polarity. The carrier also included in the developer 11 has a mean particle size of 35 $\mu$m and a saturation magnetization of 60 emu/g. A saturation magnetization refers to a magnetic moment for a unit mass of 1 g. In the illustrative embodiment, the saturation magnetization was measured by using a multisample, rotary magnetizing device REM-1-10 available from Toei Kogyo K. K. and a magnetic field of 1,000 Oe.

By covering each carrier particle with a surface layer, the toner and carrier mixture is adjusted such that the toner is charged to the target value Q/m of 10 $\mu$C/g to 35 $\mu$C/g mentioned earlier. More specifically, when temperature for baking the carrier was varied in the range of from 250° C. to 350° C., the amount of charge to deposit on the toner was successfully adjusted in the range of from 10 $\mu$C/g to 35 $\mu$C/g. An amount of charge refers to charge deposited on the toner by friction when the toner was agitated together with the carrier. While some different methods for measuring the charge deposited on the toner are known in the art, the illustrative embodiment uses a blow-off method described in "Fundamentals and Applications of Electrophotographic Technology", Corona, page 680.

The casing 12 stores, e.g., 500 g of developer 11 having a toner content of 5 wt %. The screws 18 each have a diameter of 19 mm and a pitch of 20 mm, and each is rotated at a speed of 500 rpm while conveying the developer 11 in opposite directions to each other, as stated earlier. As a result, the developer 11 is uniformly circulated in the casing 12. At this instant, the toner and carrier are agitated with the result that the toner is charged by friction.

The power supply 17 applies a bias for development of, e.g., DC −0.4 kV. The developing sleeve 13 conveys the developer 11 deposited thereon to the developing region by way of the metering member 15. In the developing region, the drum 1 and developing sleeve 13 face each other, but do not contact each other. The electric field formed between the drum 1 and the developing sleeve 13, as stated earlier, causes the charged toner to deposit on the drum 1. In the illustrative embodiment, potentials of −0.6 kV and about −0.1 kV are deposited on the non-image area and image area of the drum 1, respectively.

Figure 3:
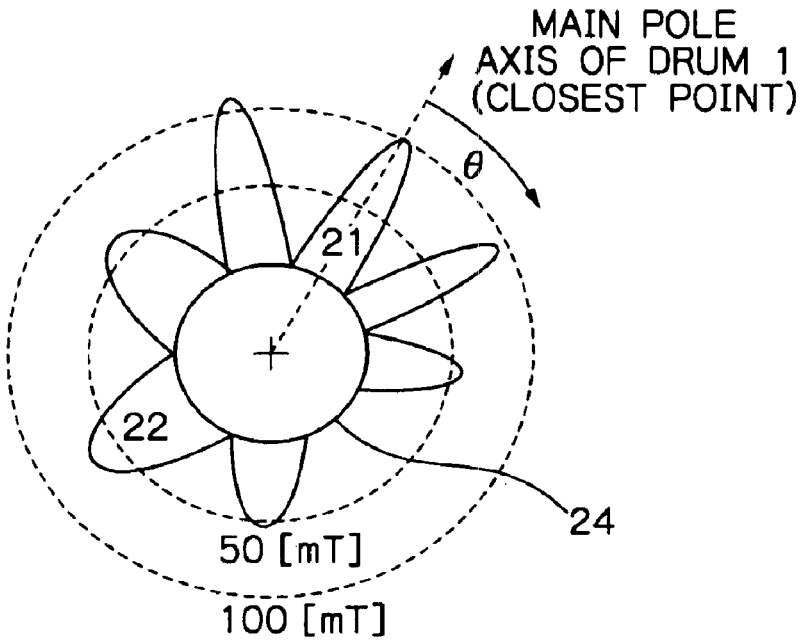
FIG. 3 is a chart showing the flux density distribution of a magnet roller included in a first embodiment of the developing device in accordance with the present invention.

As shown in FIG. 3, the magnet roller 14 disposed in the developing sleeve 13 includes a main pole or magnet 21 oriented toward the point where the drum 1 and sleeve 13 are closest to each other, as seen from the axis of the roller 14. The main pole 21 has a flux density of 90 mT to 100 mT and a half value of 20°. Other poles or magnets are positioned at both sides of the main pole 21 in order to reduce the half value. This is contrastive to a conventional magnet roller having a single pole for development. The flux density refers to the component of the flux density, as measured on the surface of the developing sleeve 13, oriented toward the axis of the magnet roller 14. As for the half value, assume a position where the flux density is one-half of the peak value of the flux density of the pole or the maximum magnetic force (peak) of a magnetic force distribution curve in the normal direction, two such positions exist at both sides of the peak. Then, the half value refers to an anglular width between the-above position and the axis of the magnet roller 13.

Figure 4:
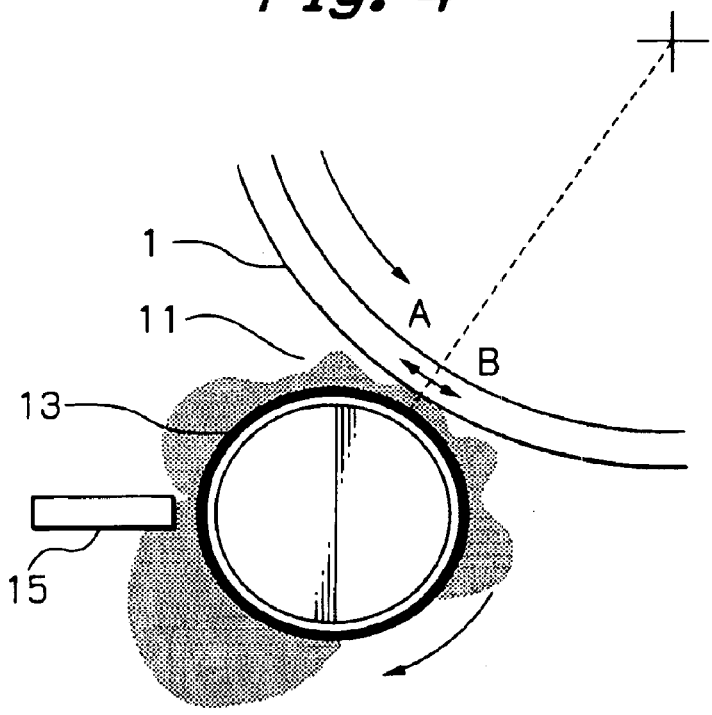
FIG. 4 is a view showing how a magnet brush unique to the illustrative embodiment contacts an image carrier.

As shown in FIG. 4, the metering member 15 is implemented by a 1.6 mm thick chrome stainless steel SUS sheet, as prescribed by JIS (Japanese Industrial Standards) and spaced from the developing sleeve 13 by a gap Gd of 0.4 mm. The developing sleeve 13 is spaced from the drum 1 by a gap Gp of 0.4 mm. The ratio between the gaps Gd and Gp is therefore 1.

To determine a relation between background contamination (fog) and the thinning of a horizontal line and the omission of a trailing edge, the amount of toner to deposit on the toner and background potential were varied. FIG. 5 list the results of measurement. The fact that the amount of charge to deposit on the toner has critical influence on background contamination was known beforehand. The experiment was therefore conducted by combining toners each being charged by a particular amount and a carrier.

Background contamination and the thinning of a horizontal line and the omission of a trailing edge shown in FIG. 5 were estimated by the following procedures. Our previous experiments showed that background contamination was susceptible to environment, particularly it was liable to occur in a hot, humid environment. We therefore estimated background contamination in two different environments, e.g., at a room temperature of 22° C. and a humidity of 50% (normal temperature, normal humidity environment) and at a room temperature of 30° C. and a humidity of 90% (hot, humid environment). In FIG. 5, circles indicate that the result of measurement was good in both of the two environments, triangles indicate that the result was good only in the normal temperature, normal humidity environment, and crosses indicate that the result was no good in both of the two environments.

Why background contamination is aggravated in the hot, humid environment is that the amount of charge to deposit on the toner decreases, compared to the normal temperature, normal humidity environment. Why the amount of charge decreases in the hot, humid environment is, e.g., that discharge occurs due to the influence of humidity, and that agitation efficiency decreases due to a decrease in the fluidity of the developer. The variation of the amount of charge in the hot, humid environment is dependent on the amount of charge in the normal temperature, normal humidity environment. It was experimentally found that the amount of charge in the hot, humid environment decreased by 10% to 30%, compared to the amount of charge in the normal temperature, normal humidity environment.

On the other hand, the thinning of a horizontal line and the omission of a trailing edge are not susceptible to environment. In FIG. 5, circles, triangles and crosses respectively show that the above defects did not occur, that some defects occurred, but were acceptable in practice, and that the defects occurred and rendered images detective. This estimation was based on Chart No. 1 proposed by the Society of Image Engineers of Japan.

As FIG. 5 indicates, when the amount of charge is 8 $\mu$C/g, background fog is noticeable, so that the background potential must be increased. Further, the above amount of charge thickened solitary dots and one-dot lines more than necessary, lowering image quality. This is because for a given latent image formed on the drum 1, the decrease in the a-mount of charge caused a greater amount of toner to deposit on the toner. This phenomenon, however, is particular to the illustrative embodiment and has not been seriously discussed in relation to a comparative configuration, which will be described later. Specifically, in a conventional image forming apparatus, toner deposited on a photoconductive drum again deposits on a magnet brush at the downstream side of a developing region. In this condition, toner deposits on solitary dots or one-dot lines in an amount smaller than in the illustrative embodiment and close to an amount necessary for image formation. This is presumably why the above problem has riot been seriously discussed in relation to the conventional image forming apparatus. In light of the above, the illustrative embodiment defines the lower limit of the amount of Charge to deposit on toner.

As FIG. 5 also indicates, when the amount of charge is about 45 $\mu$C/g, the range in which the background contamination and the thinning of a horizontal line and omission of a trailing edge both are satisfactory broadens. Such an amount of charge, however, lowered the image density ID of a black solid image to 1.25 short of a sufficient image density of 1.3 to 1.4. This is why the illustrative embodiment defines the upper limit of the amount of charge to deposit on toner.

It will be seen front FIG. 5 that for the amount of charge ranging from 10 $\mu$C/g to 35 $\mu$C/g, background potentials of 100 V and above are satisfactory as to all of the defects.

A comparative configuration will be described hereinafter. The above-described experiment was conducted with a conventional magnet roller having a diameter of 20 mm and a main pole having a half width or 50° and a flux density peak value of 90 mT. FIG. 6 shows the results of experiments. As shown, the thinning of a horizontal line and the omission of a trailing edge are more aggravated in the conventional magnet roller than in the illustrative embodiment. This is because the magnet brush ends contacting the drum at a position where the developing sleeve and drum are relatively remote from each other. As FIG. 6 indicates, a range that reduces both of background contamination and the thinning of a horizontal line and the omission of a trailing edge substantially does not exist. Although such a range exists for the amount of charge of 45 $\mu$C/g, this amount of charge is not practical, as stated earlier.

Second Embodiment

This embodiment is identical with the first embodiment except for the additional condition that the charge potential is 1,000 V or below in absolute value.

Generally, a field strength that insures insulation of OPC (Organic PhotoConductor) often used for an electrophotographic apparatus is between 30 V/$\mu$m and 40 V/$\mu$m. If the field strength exceeds such a range, then OPC itself looses its function (insulation) or has its life shortened in a long term.

FIG. 7 shows the results of image estimation conducted by passing 10,000 paper sheets and varying the potential to deposit on a photoconductive element over the range of from 200 V to 1,200 V. The photoconductive element was implemented by OPC and made up of a co-called CTL (Charge Transport Layer) and a CGL (Charge Generating Layer) that were 27 $\mu$m thick and 1 $\mu$m thick, respectively. A color copier imagio MF4570 available from Ricoh Co., Ltd. was used to print a test chart whose image area ratio was 5%.

As shown in FIG. 7, when the potential deposited on the photoconductive element was 1,200 V, a number of black dots having a diameter of 5 $\mu$m to 20 $\mu$m appeared in images after the feed of 10,000 paper sheets. This is because the photoconductive element locally lost insulation due to breakdown and was lowered in potential to cause toner to deposit thereon. By contrast, when the charge potential was 200 V to 1,000 V, such defective images did not occur. In the illustrative embodiment, considering the life of the photoconductive element, it is necessary to maintain the charge potential of the photoconductive element below 1,000 V inclusive.

Third Embodiment

This embodiment is identical with the first embodiment except for the additional condition that the charge potential is 100 V or below in absolute value.

FIG. 8 lists the density of black solid images measured by using a developer whose toner was charged to 10 $\mu$C/g to 35 $\mu$C/g and by varying the bias for development. As FIG. 8 indicates, when the amount of charge to deposit on toner is 10 $\mu$C/g to 35 $\mu$C/g that reduces both of background contamination and the thinning of a horizontal line omission of a trailing edge, a bias of 100 V or above is necessary for the image density of 1.3 or above to be attained.

Further, in electrophotographic image forming apparatuses in general, the charge potential and bias for development vary by 20 V to 30 V. Specifically, the charge potential varies due to the wear, i.e., variation in the film thickness of a photoconductive element ascribable to aging and due to the varying environment, particularly humidity. The bias for development varies due to the current capacity and accuracy of a power supply. In light of this, a bias of about 100 V or above is necessary to prevent the above variations from effecting the tonality images.

In the illustrative embodiment, toner is caused to deposit on the exposed portion of the photoconductive drum. In a digital copier or a digital printer, in particular, the exposure is effected on a dot basis and varies the density of dots for implementing tonality. To cause toner to deposit on the exposed portion, an electric field for development is formed by a difference between the bias for development and the potential of the exposed portion, which is 0 V to about 30 V. The bias should be at least 100 V it order to enlarge the electric field to such a degree that the variation of the charge potential and that of the bias do not effect the electric field.

The prerequisite with the illustrative embodiment is that the magnet brush rises and then falls within a range allowing the electric field for development to separate the toner from the carrier. Therefore, if the bias for development is low, then the above range must be reduced. In the illustrative embodiment, the following scheme is used to define the range that allows the electric field to separate the toner from the carriers For the scheme to be described, use was made of an image forming apparatus including a developing sleeve having a diameter of 20 mm, a photoconductive element having a diameter of 60 mm, and a gap Gp for development of 0.4 $\mu$m, as in the illustrative embodiment. Further, the apparatus used a developer made up of a carrier having a mean particle size of 35 $\mu$m and toner having a mean particle size of 5 $\mu$m and having a toner content of 5 wt %.

Figures 9, 10:
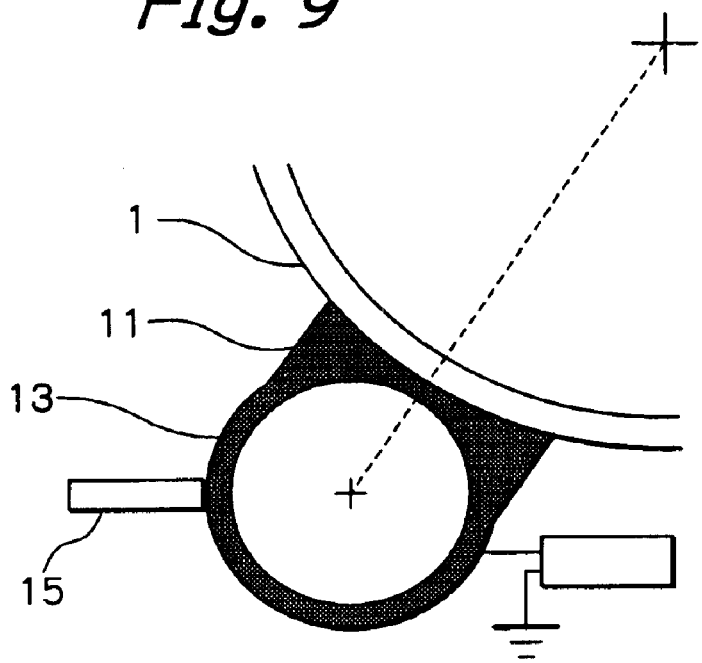
FIG. 9 is a view showing a specific configuration for determining a range in which an electric field for development can separate toner and carrier.
FIG. 10 is a table listing experimental results representative of the bias or development and the range in which the electric field can separate toner and carrier.

As shown in FIG. 9, the developer 11 is deposited on the developing sleeve 13 in a great amount such that the developer 11 fills up the portion where sleeve 13 and drum 1 face each other. This condition does not occur during usual image formation. The magnet roller 14 is removed because a magnet brush to be formed thereon would disturb steps to follow. Subsequently, various biases for development are sequentially applied to the developing sleeve 13 with both of the sleeve 13 and drum 1 being held stationary. At this instant, assume that the potential of the drum 1 is equal to the potential of a black solid image. When the drum 1 is pulled out with any one of the biases being applied, the toner of the developer 11 is found deposited on the portion of the drum 1 that has faced the sleeve 13. This toner is one that has been separated from the carrier by the electric field for development. FIG. 10 shows the results of measurement.

As FIG. 10 indicates, when the bias for development is low, the range that allows the electric field to separate the toner from the carrier decreases. While such a narrow range may be coped with if the half width of the main pole of the magnet roller is further reduced, further reducing the half with is not desirable from the standpoint of the production of the magnet roller. Therefore the bias should preferably be 100 V or above, more preferably 300 V or above.

As stated above, the first to third embodiments obviate the thinning of a horizontal line and the omission of a trailing edge. Further, by defining a particular range of charge to deposit on toner and a particular range of background potential, the illustrative embodiments obviate background contamination in a hot, humid environment, among others while obviating the above defects at the same time. This is successful to insure attractive images free from defects.

Moreover, by limiting the charge potential to 1,000 V or below, the illustrative embodiments reduce the load on the drum 1 and thereby extend the life of the drum 1. More specifically, the illustrative embodiments free images from black dote even when 10,000 paper sheets are fed. A bias for development of 100 V or above provides a black solid image with sufficient image density ID of 1.3. In addition, images are free from the influence of variation in charge potential and variation in bias for development.

Fourth Embodiment

This embodiment, as well as a fifth embodiment to be described later, is mainly directed toward the second object stated earlier. The illustrative embodiment is essentially similar to the first embodiment, so that the following description will concentrate on differences.

In the illustrative embodiment, the developing sleeve 13 rotates at a peripheral speed of 575 mm/sec. Therefore, the ratio of the peripheral speed of the developing sleeve 13 to that of the drum 1 is 2.5. The developer 11 contains nonmagnetic toner having a mean particle size of, e.g., 5.0 $\mu$m and chargeable to negative polarity. A carrier also contained in the developer 11 is a ferrite carrier having a mean particle size of 35 $\mu$m. While other various kinds of carriers including iron carrier, resin carrier and magnetite carrier are known in the art, the illustrative embodiment, as well as a fifth embodiment to be described later, use a ferrite carrier. A ferrite carrier is advantageous over an iron carrier in that it is free from degeneration and deterioration ascribable to oxidation. In addition, a ferrite carrier can be relatively easily provided with a spherical configuration and can therefore be provided with uniform particle size. By coating each carrier particle with a surface layer, the toner and carrier combination is adjusted such that the amount of toner Q/m to deposit on the toner is −15 $\mu$C/g.

The saturation magnetization of the carrier and the peak value of the flux density of a main pole for development were varied to observe how the carrier was scattered in an image. FIG. 11 shows the results of observation. In the illustrative embodiment, too, the saturation magnetization was measured by using the previously mentioned multisample, rotary magnetizing device and a magnetic field or 1,000 Oe. As for the saturation magnetization of the carrier, a plurality of carriers each being implemented by a particular magnetic material were prepared. Subsequently, part of such carriers having particular saturation magnetization values was selected. In the illustrative embodiment, use was made of a gauss meter ADS GAUSS METER MODEL HGM-8300 using a Hall element to measure the magnetic flux. The ratio of the peripheral speed vs of the developing sleeve 13 to the peripheral speed vp of the drum 1 (vd/vp) was 2.5.

The carrier scattering shown in FIG. 11 was estimated by the following procedure. The developer was introduced in the casing 12 and agitated to such a degree that the developer and toner were evenly distributed. Subsequently, there were continuously output three A3 prints each carrying an image over its entire surface. The image was implemented by solitary dots each being assigned to 2×2 pixels. In FIG. 11, circles show that carrier scattering was not observed in any one of the three prints (good). Triangles show that carriers scattering was observed in at least one-of the three prints (average), while crosses show that it was observed in two or more prints (no good).

Carrier scattering brims about the following problems. The carrier scattered during development partly deposits on the drum 1 and prevents the toner from being transferred to a paper sheet at the time of image transfer. More specifically, the carrier particles are usually greater in size than the toner particles. Therefore, the carrier particles deposited on the drum 1 intervene between the drum 1 and the paper sheet even when the paper sheet is brought into contact with the drum 1, preventing the paper sheet front closely contacting the drum 1. As a result, the toner particles around the carrier particles are prevented from being transferred from the drum 1 to the paper sheet, causing an image to be locally lost. In a halftone portion, in particular, a toner image remains simply blank at positions around the above carrier particles. Moreover, the carrier particles deposited on the drum 1 are partly transferred to the paper sheet. Such carrier particles remaining on the paper sheet are not fixed on the paper sheet at the fixing station and are simply observed as an impurity in the resulting image. In addition, the carrier flown cut of the developing section not only deposits on the drum 1, but also smears the inside of the image forming apparatus and accumulates in the apparatus. This part of the carrier effects friction and causes a paper sheet to jam a path or causes two or more paper sheets to be fed together when deposited on a pickup roller or conveyor rollers.

As FIG. 11 indicates, if the peak value of the magnetic flux of the main pole for development is 60 mT or above and if the saturation magnetization of the carrier is 35 emu/g or above, then the carrier is prevented from being scattered around. However, it the peak value of the magnetic flux is 120 mT or above, then the magnet brush rises too high. This is undesirable from the standpoint of the thinning of a horizontal line and the omission of a trailing edge. Therefore, to avoid these defects while obviating carrier scattering, the peak value of the flux density of the main pole should preferably be between 60 mT and 120 mT. Also, if the saturation magnetization of the carrier is excessive, then the magnet brush its too stiff when brought into contact with, e.g., the drum. As a result, the magnet brush strongly rubs itself against the drum 1 and aggravates the wear of the drum 1, i.e., reduces the life of the drum 1. The saturation magnetization of the carrier should therefore be between 35 emu/g and 80 emu/g.

FIGS. 12 and 13 show experimental results derived from ratios vd/vp that were 2.0 (drum speed of 230 m/sec and sleeve speed of 460 mm/sec) and 1.5 (drum speed of 230 mm/sec and sleeve speed of 345 mum/sec). It will be seen that carrier scattering is also obviated if the peak value of the flux density of the gain pole is 60 mT or above and if the saturation magnetization of the carrier is 35 emu/g or above.

Comparative experiments were conducted by selecting the ratios vd/vp of 3.0 (drum speed of 230 mm/sec and sleeve speed of 690 mm/sec) and 4.0 (drum speed of 230 mm/sec and sleeve speed of 920 mm/sec). FIGS. 14 and 15 show the results of experiments. As shown, even when the peak value of the flux density of the main pole was 60 mT or above and when the saturation magnetization of the carrier was 35 emu/g or above, toner scattering was observed on paper sheets.

How the illustrative embodiment and the above-described comparative example differ from each other as to tones scattering will be described hereinafter.

Carrier scattering differs from carrier deposition in the following respect. Carrier scattering is presumably ascribable to a centrifugal force acting when the developing sleeve 13 is in rotation and when the magnet brush rises and then falls at the main pole. Carrier scattering is therefore greatly dependent on the ratio vd/vp. By contrast, carrier deposition refers to the deposition of the carrier on the background of an image ascribable to an electric force (background potential) acting on the carrier. In this sense, carrier scattering and carrier deposition are entirely different in mechanism. Further, carrier scattering and carrier deposition are different from each other as to development observed in an image. Carrier scattering is not dependent on the kind of an image, as will be seen from the cause. On the other hand, carrier deposition is dependent on an electric field corresponding to an image, i.e., it does not occur in a black solid portion, but occurs in a white portion. Particularly, carrier deposition is conspicuous in a white portion adjoining a black portion due to the edge effect.

When a centrifugal force is assumed to bring about carrier scattering, the experimental results shown in FIGS. 11 through 15 can be well accounted for. A centrifugal force causative of carrier scattering is proportional to the square of a speed. On the other hand, a magnetic force holding the carrier on the developing sleeve 13 is considered to be proportional to the magnetic flux and the saturation magnetization of the carrier. It follows that the ratio vd/vp does not cause the carrier to be scattered if 2.5 or below, but causes it to noticeably scattered if 3.0 or above. Such noticeable toner scattering cannot be avoided even if the flux density or the saturation magnetization is increased within a practical range. That is, the experimental results shown in FIGS. 11 through 15 presumably stem from the fact that the ratio vd/vp is the major factor that determines carrier scattering.

Fifth Embodiment

This embodiment is identical with the fourth embodiment except that the particle sire of the carrier is confined in a range of from 30 μm to 75 μm. In addition, experiments were conducted with carrier particle sizes of 30 μm, 50 μm and 75 μm and each having a particular saturation magnetization. The experiments showed that carrier scattering was not dependent on the carrier particle size at all. More specifically, carrier scattering was dependent only on the ratio Vd/vp, the peak value of the magnetic flux of the magnet roller 14, and the saturation on magnetization of the carrier without regard to the carrier particle size.

We experimentally found that background contamination decreased with a decrease in carrier particle size. This is presumably because carrier particles each having a small size have a great surface area as a whole and therefore reduce their area to be occupied by the toner particles, thereby reducing the number of unstable toner particles. Moreover, if the carrier particle size is great, stresses are apt to act on the carrier particles at the so-called development gap and doctor gap, reducing the life of the carrier. However, a small carrier particle size is technically difficult to implement and must be controlled with accuracy, resulting an increase in cost. It is therefore preferable to confine the carrier particle size in the range of from 30 μm to 75 μm. This range of carrier particle successfully obviated toner scattering, The experimental results described in relation to the fourth and fifth embodiments show that carrier scattering does not occur if the carrier is a ferrite carrier, if the ratio vd/vp is 2.5 or below, if the peak value of the flux density of the main pole is 60 mT or above, and if the saturation magnetization of the carrier is 30 emu/g or above. Further, the ferrite carrier, which can be easily configured spherical, made the magnet brush more uniform and thereby protected images from brush marks.

As stated above the fourth and fifth embodiments prevent horizontal lines from being thinned and obviates the omission of a trailing edge. Further, toner scattering ascribable to a centrifugal force, as stated earlier, is reduced because the ratio vd/vp is 2.5 or below, the peak value of the flux density or the main pole is 60 mT or above, and the saturation magnetization of the carrier is 35 emu/g or above. This successfully obviates the local omission of an image, the deposition of impurities on an image, the contamination of the inside of the apparatus, paper jams, and the simultaneous feed of two or more paper sheets.

Moreover, background contamination or fog can be further reduced if the carrier particle size is confined in the range of from 30 μm to 75 μm, so that image quality is further enhanced. A ferrite carrier, which can be easily configured spherical, insures attractive images free from brush marks and toner scattering.

Sixth Embodiment

This embodiment, as well as a seventh and an eighth embodiment to follow, is mainly directed toward the third object stated earlier. The illustrative embodiment is essentially similar to the first embodiment, so that the following description will concentrate on differences.

In the illustrative embodiment, the development gap Gp was varied from 0.2 to 1.0 while the doctor gap Gd was varied such that the ratio Gd/Gp ranges from 0.5 to 1.0 in correspondence to the development gap Gp. In this condition, the granularity of halftone images was observed. Specifically, to estimate granularity, 256 consecutive patches sized 2 cm×2 cm each were developed with the quantity of writing light being sequentially varied. Subsequently, halftone portions with values of color ranging from 50° to 80° were compared condition by condition. FIG. 16 shows the results of estimation. In FIG. 16, circles, triangles and crosses respectively indicate "good", "average" and "no good".

Figure 17:
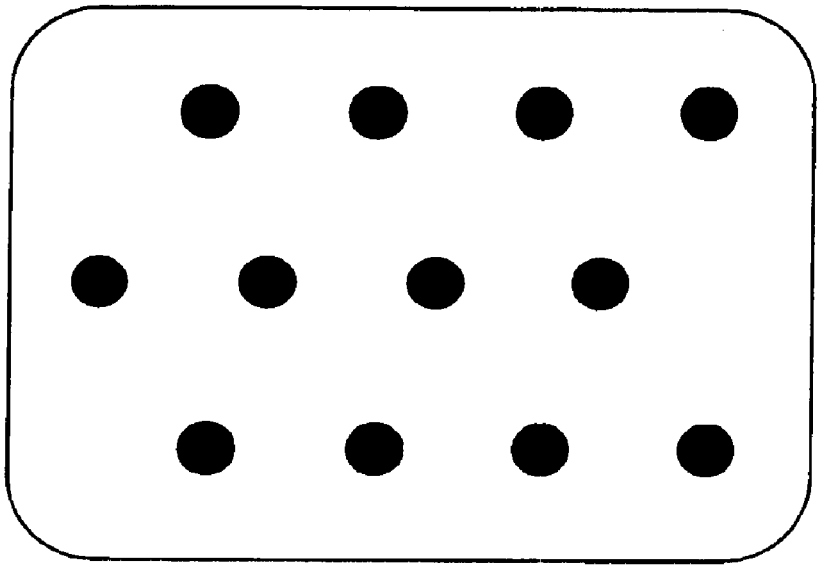
FIGS. 17 and 18 are views each showing particular dots forming a halftone image.

Granularity of an image is presumably ascribable to the deposition of toner that is irregular at a period of about 0.1 μm to 1.0 mm. Granularity is particularly conspicuous in a halftone portion, more particularly a range in which the value of color is 50° to 80°, in which the amount of toner is small. Further, granularity is a decisive factor for image quality when it comes to, e.g., a photographic image containing many halftone portions. To insure the tonality of a photographic image, for example, dot density in an image is varied with or without the area of the individual dot being varied. As shown in FIG. 17, in the halftone portion of a photographic image, dots are discrete from each other. In this condition, a factor that obstructs uniform toner deposition, which will be described later, causes the toner to irregularly deposit on the dots, resulting in granularity.

Figure 18:
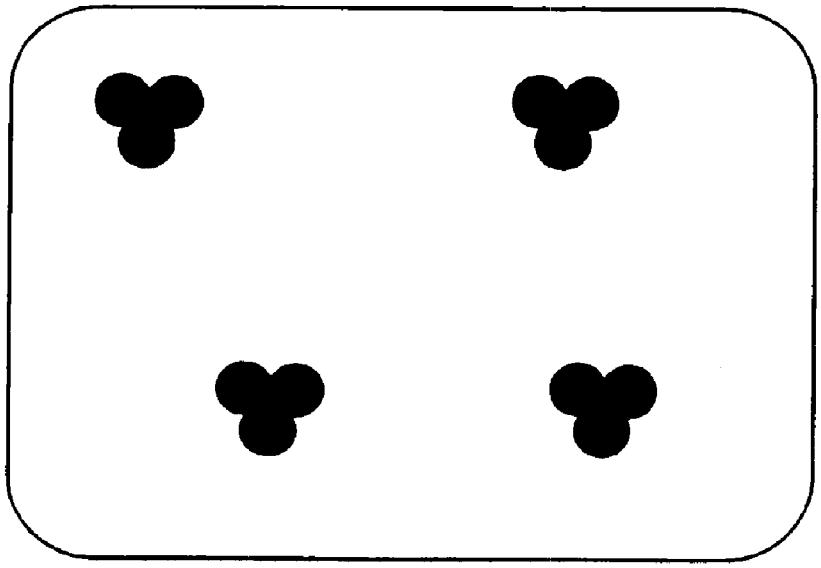

FIG. 18 shows another method of rendering halftone. As shown, several dots join each other to increase an area in which the toner is to deposit. This method is capable of reducing the influence of the factor that obstructs uniform toner deposition. However, causing several dots to join each other is equivalent to forming a large dot. This brings about another problem that the resolution of an image decreases. Granularity is not critical in a text image or similar line image because dots join each other without exception, i.e., the toner deposits in a relatively broad area.

As FIG. 16 indicates, granularity is not noticeable when the ratio Gd/Gp is between 0.8 and 1.0. Granularity begins to be conspicuous when the ratio Gd/Gp is 0.7 or below or is critically conspicuous when the ratio Gd/Gp is 0.6 or below. FIG. 16 additionally shows the results of estimation conducted under the same conditions as to the thinning of a horizontal line and the omission of a trailing edge. The results of estimation as to such additional defects are good without exception.

FIG. 19 shows the results of comparative experiments conducted by using a magnet roller having a diameter of 20 mm and a main pole having a half width of 50° and a peak flux density of 90 mT. The comparative experiments showed that granularity changed little and was average (triangles) when the ratio Gd/Gp was between 0.5 and 1.0. More specifically, granularity was not improved even when the ratio Gd/Gp was close to 1.0 or not aggravated when it was small. In this manner, the illustrative embodiment and comparative example differ from each other in the tendency of granularity. FIG. 19 further indicates that the magnet roller of the comparative example is inferior to the illustrative embodiment as to the thinning of a horizontal line and the omission of a trailing edge.

The magnet roller of the illustrative embodiment and that of the above comparative example differ from each other as to the tendency of a relation between the ratio Gd/Gp and granularity, as will be described hereinafter.

First, when the ratio Gd/Gp is small (0.5 to 0.6), granularity is aggravated in the illustrative embodiment, but not aggravated in the comparative example.

Figure 20:
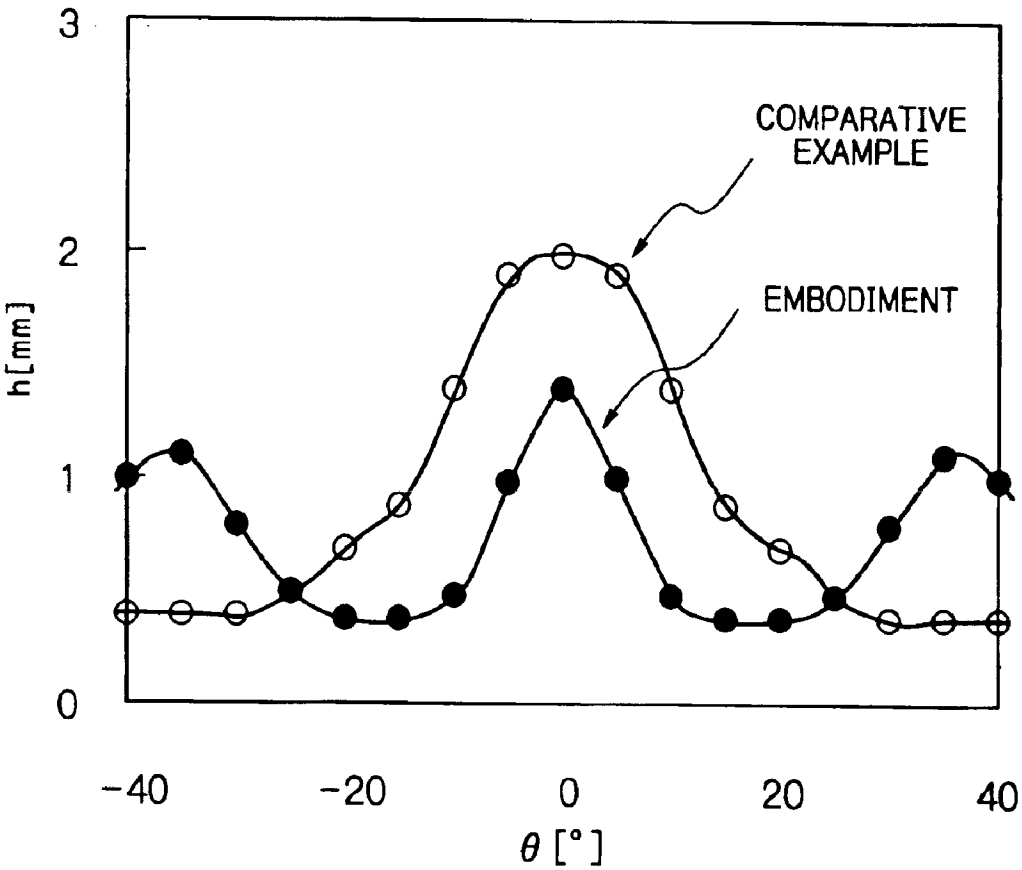
FIG. 20 is a graph comparing the sixth embodiment and a comparative example with respect to the height of the magnet brush formed by the main pole.

FIG. 20 compares the illustrative embodiment and comparative example with respect to a relation between the height of a magnet brush formed on the developing sleeve (ordinate) and the position on the sleeve (abscissa). The center angle θ of the magnet roller, which is representative of the position on the developing sleeve, is measured from the main pole 21 (θ=0°); a direction indicated by an arrow in FIG. 3 is assumed to be a positive direction. That is, in the illustrative embodiment, the position where θ is 0° is the position where the drum and developing sleeve are closest to each other. To measure the height of the magnet brush, a height gauge was brought into contact with the brush while the brush was in rotation.

As FIG. 20 indicates, the illustrative embodiment and comparative example far differ from each other as to the height of the magnet brush. Specifically, the magnet brush of the comparative example had a height about 1.5 times as high as the magnet brush of the illustrative embodiment.

During actual image formation, the drum crushes the magnet brush formed by the main pole at the position where the drum and developing sleeve are closest to each other. Therefore, when the ratio Gd/Gp was 1.0, the height of the magnet brush had no influence on an image. When the ratio Gd/Gp decreased to 0.5 to 0.6, i.e., when the gap Gd was reduced to reduce the amount of the developer on the developing sleeve, the drum crushed the magnet brush formed on the magnet roller of the comparative example in the same manner as when the ratio Gd/Gp was 1.0. Therefore, the height of the magnet brush also had no influence on an image.

On the other hand, in the illustrative embodiment, the drum crushes only the limited tip portion of the low magnet brush formed on the magnet brush. When the drum crushes the magnet brush, the toner and carrier of the developer presumably easily part from each other due to the active movement of the developer on the drum. More specifically, so far as the drum sufficiently crushes the magnet brush, the toner uniformly deposits in a sufficient amount. However, when the crush is insufficient, the toner deposition becomes irregular. The factor that obstructs uniform toner deposition mentioned earlier refers to such insufficient crush of the magnet brush by the drum. Presumably, how the drum crushes the magnet has influence on uniform toner deposition and therefore granularity in an image.

When the ratio Gd/Gp approaches 1.00 the difference between the illustrative embodiment and the comparative example in granularity is presumably ascribable to another factor. A halftone image portion is implemented by discrete dots, as stated previously. In this case, the toner deposited on the drum again deposits on the magnet brush in the downstream portion of the developing region due to the mechanism causative of the thinning of a horizontal line and the omission of a trailing edge. Therefore, the magnet roller of the comparative example presumably does not improve granularity. By contrast, the magnet roller of the illustrative embodiment prevents the toner deposited on the drum from again depositing on the magnet brush in the above portion. This successfully insures high quality, halftone images free from granularity.

Seventh Embodiment

This embodiment is identical with the sixth embodiment except for the following. Assume that the developer conveyed by the developing sleeve past the metering member and fell down has the lowest height Hd. Then, in the illustrative embodiment, the ratio of the above height Hd to the gap Gp is selected to be between 0.8 and 1.0.

Because the gap Gd and height Hd are usually almost the same as each other, the illustrative embodiment is precisely identical in configuration with the sixth embodiment. However, the gap Gd and height Hd sometimes differ from each other, e.g., when the metering member is implemented by a magnetic blade. In the illustrative embodiment, use is made of a 1.0 mm thick, magnetic metering blade formed of chrome stainless steel mentioned earlier. In this case, because the metering blade itself is magnetized by the magnet roller, the thickness of the developer deposited on the developing sleeve is smaller than the gap Gd, as determined by experiments. This is because the developer adjoining the metering blade plays the role of part of the blade because of the magnetization of the blade.

FIG. 21 shows experimental results showing how granularity varies in accordance with the development gap Gp and the ratio Hd/Gp. The gap Gd and height Hd were found to have the following relation:

$$Gd=Hd—0.3 \text{ mm}$$

Eight Embodiment

This embodiment is identical in configuration with the sixth embodiment except for an additional limitation that the gap Gp is 0.8 mm or below. As FIGS. 16 and 21 relating to the sixth and seventh embodiments indicate, granularity is more conspicuous when the gap Gp is 1.0 mm than when it is 0.8 mm or below.

Why granularity was aggravated when the gap Gp was increased in the sixth and seventh embodiments will be described hereinafter, Generally, in an electrophotographic image forming apparatus, a greater gap Gp tends to enhance, e.g., solitary dots for a given latent image. This tendency is ascribable to the electric field between the developing sleeve and the drum that has not only a component perpendicular to the surface of the drum but also a component parallel to the same. Such an edge effect causes a greater amount of toner to deposit on solitary dots, e.g., discrete dots forming a halftone image to a substantial height. The toner piled up in a small area is undesirable from an image quality standpoint because it is melted and crushed by a heat roller later. As a result, granularity is conspicuous in an image coming out of a fixing unit. The mechanism that aggravates granularity ascribable to the edge effect is entirely different from the mechanism that aggravates granularity ascribable to the unstable toner deposition stated earlier. However, the aggravation appears almost the same in an image.

Before development with the main pole whose halt width is reduced (comparative example), granularity remains average (triangle) even if the gap Gp is increased to 1.0 mm. This is because in the comparative example, too, the retransfer of the toner from the drum to the magnet brush obviates the occurrence that as the half width of the main pole decreases, the toner deposits on solitary dots to a greater height. More specifically, although the toner piles up on solitary dots due to the edge effect in the same manner as during development with, a reduced half width, it again deposits on the magnet brush and is collected thereby in the downstream portion of the developing region.

As stated above, in the sixth to eighth embodiments, the crush of the magnet brush by the drum occurring between the developing sleeve and the drum is made most of to output a halftone image or similar dot image free from granularity.

Further, the gap Gp is selected to be 0.8 mm or below. This successfully reduces granularity particular to development using a main pole having a small half width. This is also successful to output a halftone image or similar dot image free from granularity.

Ninth Embodiment

This embodiment, as well as a tenth to a thirteenth embodiment to follow, is mainly directed toward the fourth embodiment stated earlier.

Figure 22:
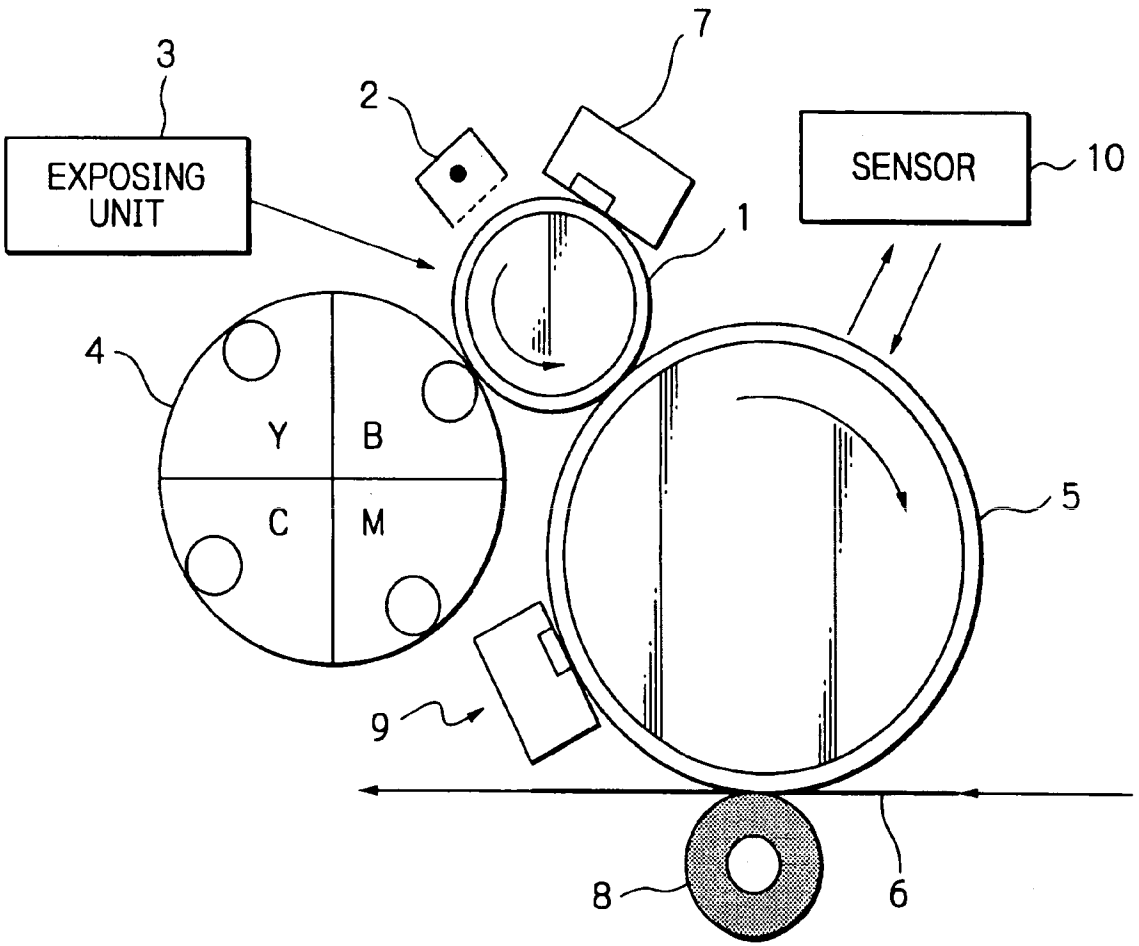
FIG. 22 is a view showing an image forming apparatus to which a ninth embodiment of the present invention is applied.

FIG. 22 shows the general construction of a color image forming apparatus representative of the illustrative embodiment. The construction shown in FIG. 22 is basically identical with a conventional construction. As shown, the image forming apparatus includes a photoconductive drum 1 including, e.g., a conductor coated with a photoconductive substance. The drum 1 has a diameter of 90 mm and is rotatable at a peripheral speed of, e.g., 200 mm/sec in a direction indicated by an arrow in FIG. 22. A charger 2 is implemented by a scorotron charger and uniformly charges the surface of the drum 1 to a desired potential, e.g., −0.6 kV. An exposing unit 3 includes a laser diode or similar light source and scans the charged surface of the drum 1 image-wise via a polygonal mirror not shown, thereby forming a latent image an the drum 1. A laser beam to issue from the laser diode has a diameter of 50 $\mu$m in the main scanning direction and a diameter of 60 $\mu$m in the subscanning direction.

A revolver or developing device 4 for developing the latent image includes four developing units each storing one of yellow (Y) toner, cyan (c) toner, magenta (M) toner, and black (B) toner: The revolver 4 is rotatable to bring one of the four developing units to a position where the developing unit faces the drum 1. More specifically, the revolver 4 brings one developing unit matching in color with the latent image formed on the drum 1 to the above position, thereby developing the latent image. This operation is repeated to sequentially transfer the resulting toner images from the drum 1 to an intermediate image transfer belt 5 one above the other (primary image transfer hereinafter). The revolver 4 stores two-ingredient type developers, i.e., toner and carrier mixtures of different colors. A voltage is applied between the drum 1 and the developing unit of the revolver 4 facing the drum 1 in order to develop the latent image. The voltage may be a DC voltage or an AC-biased DC voltage. After the primary image transfer, a drum cleaner 7 removes the toner left on the drum 1 to thereby prepare the drum 1 for the next image formation.

The procedure beginning with charging and ending with cleaning described above is repeated with all of the four colors Y, C, M and B. The resulting toner images are transferred from the drum 1 to the image transfer belt 5 one above the other, forming a full-color color image. The belt 5 is formed of a conductive elastic material and has a circumferential length of 450 mm. A power supply, not shown, applies a bias for image transfer to a secondary image transfer device 8, which is implemented as a roller by way of example. The secondary Image transfer device 8 transfers the color image from the belt 5 to a paper sheet or similar recording medium 6 fed from a sheet feeder not shown (secondary image transfer). After the secondary image transfer, a belt cleaner 9 cleans the surface of the belt 5. The paper sheet 6 with the color image is conveyed to a fixing unit, not shown, and has the color imaged fixed thereby. The paper sheet 6 is then driven out of the apparatus.

The revolver 4 basically has a conventional configuration. The four developing units of the revolver 4 are identical in configuration except for the color of the developer, and each is identical with the monochromatic developing unit shown in FIG. 2. Differences between the individual developing unit of the revolver 4 and the developing device of FIG. 2 will be described hereinafter.

In the developing unit, the developing sleeve 13 rotates at a peripheral speed of 400 mm/sec, which is two times as high as the peripheral speed of the drum 1. By covering each carrier particle with a surface layer, the toner and carrier mixture is adjusted such that the toner is charged to a target value Q/m of −15 $\mu$C/g. The casing 12 stores, e.g., 500 g of developer having a toner content of 5 wt %. The screws 18 each has a diameter of 19 mm and a pitch of 20 mm, and each is rotated at a speed of 500 rpm while conveying the developer 11 in opposite directions to each other, as stated earlier. As a result, the developer is uniformly circulated in the casing 12. At this instant, the toner and carrier are agitated with the result that the toner is charged by friction. Therefore, even when fresh toner is replenished from a toner container, not shown, to the casing, 12, the screws 18 maintain the toner content of the developer constant.

FIG. 4 shows how a magnet brush formed in each developing unit contacts the drum 1. In FIG. 4, a developing region A-B is representative of a range in which an electric field formed between the drum 1 and the developing sleeve 13 is stronger than an electric field that causes the toner and carrier to part from each other. In the developing region A-B, the magnet brush rises, contacts the drum 1, and then falls down. In the illustrative embodiment, the peak value of the flux density available with the magnet roller is selected to be 90 mT. However, experiments showed that the contact condition shown in FIG. 4 was available even if the peak value was as low as about 60 mT. The arrangement of the poles of the magnet roller and the resulting magnetic fields shown in FIG. 4 are only illustrative. The crux is that a magnetic field capable of causing the magnet brush to rise, contact the drum 1 and then fall down is formed in a range in which the electric field between the drum 1 and the developing sleeve 13 is stronger than the electric field that causes the toner and carrier to part from each other.

To measure a flux density, a magnetic field formed by the magnet roller is measured on the surface of the developing sleeve 13. FIG. 3 shows only the components of the flux density oriented toward the axis of the magnet roller. For the measurement of the flux density, use was made of a gauss meter ADS GAUSS METER MODEL HGM-8300 using a Hall element.

Referring again to FIG. 2, an image density sensor or sensing means 10 is responsive to the density of an image. Specifically, before the formation of a desired image, the exposing unit 3 and revolver 4 are operated to form patches, or particular toner images, in the colors Y, C, M and B on the drum 1. The patches are transferred to the intermediate image transfer belt 5 by primary image transfer. The image density sensor 10 senses the density of each of the patches. The image density sensor 10 has a light emitting portion and a light-sensitive portion although not shown specifically. While the light emitting portion emits light toward the patches, the resulting reflections are incident to the light-sensitive portion. The resulting outputs of the light-sensitive portion are written to a memory, not shown, included in the apparatus. The density derived from the individual patch is then compared with a reference value or reference density stored in the apparatus beforehand. The bias for development is so controlled as to cause the sensed density to coincide with the reference density. The so controlled bias is used until the next density measurement as an optimal bias.

By measuring the density of the individual patch, it is possible to maintain the density of a desired image constant against the aging of the developers and varying environment. The aging of a developer refers to the deterioration of a carrier that reduces the amount of charge to deposit on toner and thereby effects a developing ability and aggravates fog in the background. Further, by measuring the density of the pitches, it is possible to detect various errors including errors occurred in the developing units.

In the illustrative embodiment, the patches are exposed to be charged to a potential of −100 V and then developed by a bias of −250 V. The patches each are sized 10 mm in the main scanning direction (axial direction of the belt 5) and 5 mm in the subscanning direction (circumferential direction of the belt 5). Why the patches are developed by a bias lower than the standard bias is as follows. Reflection density saturates, i.e., varies little as the amount of toner deposited on a toner image increases. In light of this, the developing ability is intentionally lowered during the development of the patches in order to reduce toner deposition. This allows the variation of the developing ability to be accurately measured. More specifically, the patches are provided with an image density ID of about 1.0.

Figure 23:
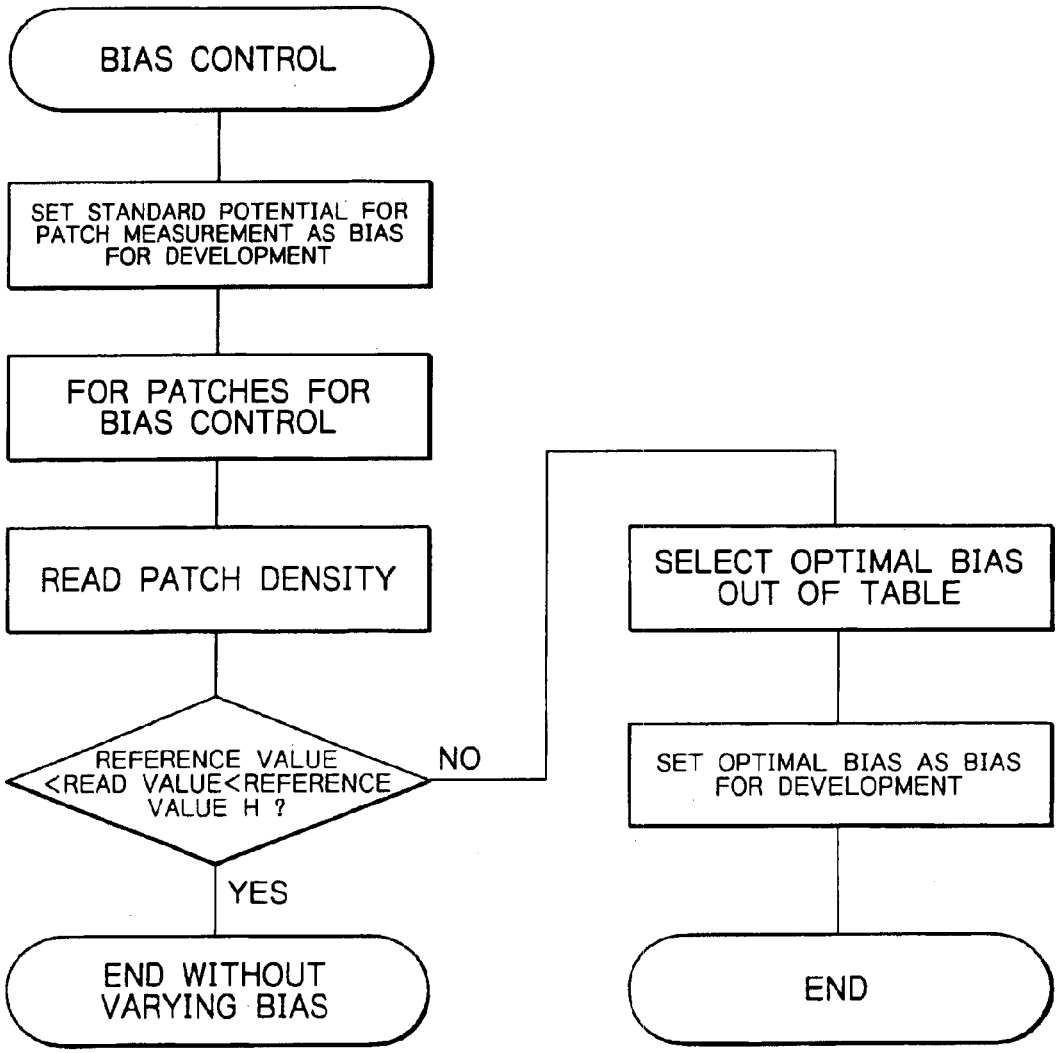
FIG. 23 is a flowchart demonstrating a specific bias control procedure unique to the ninth embodiment.

FIG. 23 demonstrates a bias control procedure unique to the illustrative embodiments The procedure shown in FIG. 23 is executed once for five prints and capable of confining the density of prints in a preselected range. A bias table shown in FIG. 23 lists 256 biases stepwise at the intervals of 2 V; the center voltage is −400 V. It follows that the bias for development can be controlled from −400 V to −656 V.

In the illustrative embodiments a developing characteristic generally referred to as a gamma characteristic is controlled in addition to the bias for development. To control the gamma characteristic, a plurality of patches each are formed in a particular condition for exposure. The resulting latent images representative of the patches are developed by a bias, which may also be selected by the above-described procedure. Toner density of the individual path is written to a memory and then compared with a reference value. Optimal conditions for exposure are selected from an image forming condition table listing biases for development, charge potentials, quantities of light, duration of illumination, and so forth.

Figure 24:
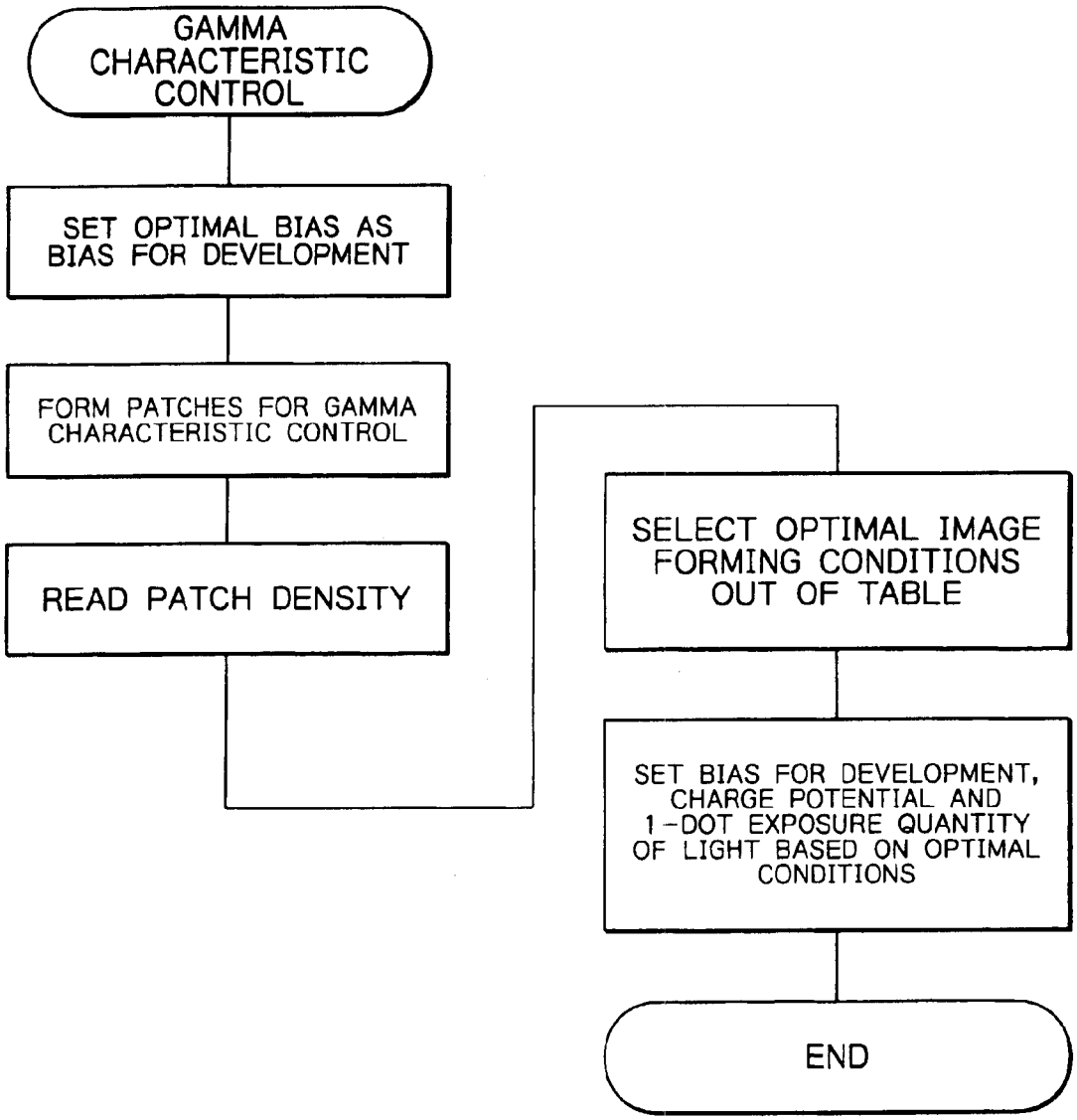
FIG. 24 is a flowchart demonstrating a specific gamma characteristic control procedure also unique to the ninth embodiment.

In the illustrative embodiment, for the gamma characteristic control, eight patches sized 10 mm in the main scanning direction and 5 mm in the subscanning direction each are formed. Assuming a resolution of 600 dpi, exposing energy of 0 pJ to 3.4 pJ for a dot is applied in eight consecutive steps to the eight patches. A bias for development is selected by the previously stated procedure. Subsequently, optimal image forming conditions are selected from the image forming condition table in accordance with the density of the individual patch. The conditions selected are used to output a desired print. FIG. 24 demonstrates the gamma characteristic control procedure specifically. The gamma characteristic control is executed once for five prints in order to maintain the gamma characteristic constant. FIG. 25 shows the contents of the image forming condition table.

We experimentally found that the bias for development, charge potential and quantity of light for exposure (including duration) each had particular influence on the gamma characteristic. The bias for development determines the maximum density or saturation density of an image, i.e., the color reproducible range of an image. The charge potential effects the gamma characteristic in a highlight portion through a difference between the charge potential and the bias for development (so-called background potential). More specifically, when the background potential increases, the slope of a gamma curve decreases in a highlight portion while the entire gamma curve sharply rises. Conversely, when the background potential increases, the slope of a gamma curve increases in a highlight portion while the entire gamma curve linearly rises. The background potential additionally has a function of avoiding background fog, which is one of image defects. In this sense, background fog may be sensed and referenced for background potential control. The quantity of light for exposure would vary the maximum image density if not optimized at the time of charge potential control.

The developing scheme unique to the illustrative embodiment effectively obviates the omission of a trailing edge, which is another image defect. This has remarkable effect when the density of the patches is to be sensed, as will be described hereinafter.

The omission or a trailing edge refers to an occurrence that the trailing edge of a halftone or a black solid image in the direction of sheet conveyance is lowered in density or not developed at all. This defect occurs with the patches as well. This defect appeared on the patches is not critical because the patches are not expected to be printed on paper sheets. However, the defect is apt to aggravate an error during density measurement.

Figure 26B:
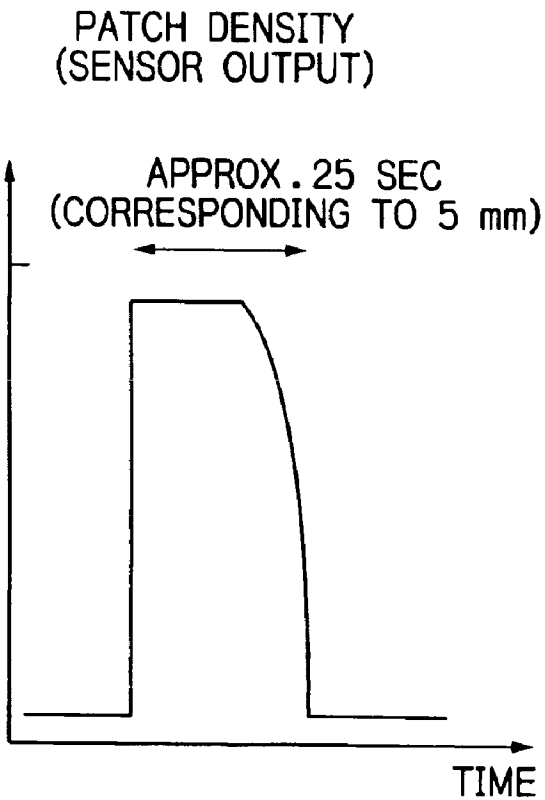
FIGS. 26A and 26B are graphs respectively showing density output in the absence of the omission of a trailing edge and density output in the presence of the same.
Figure 26A:
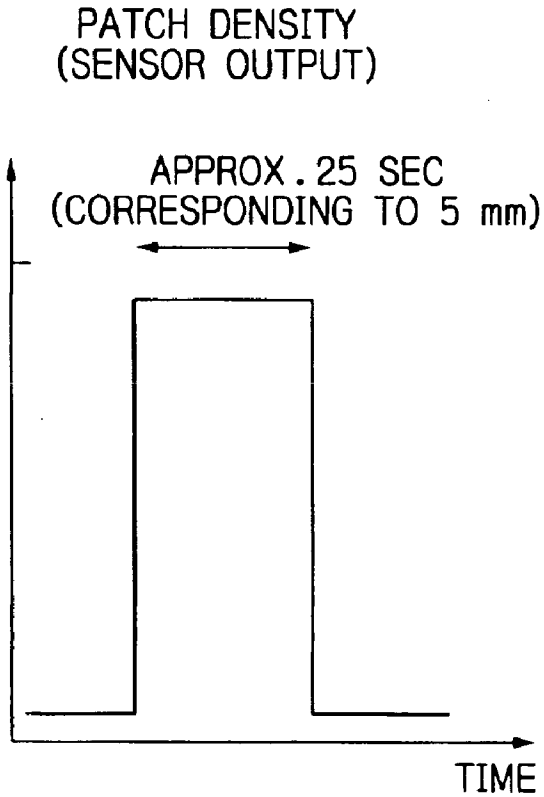

For experiment, a patch sized 10 mm in the main scanning direction and 5 mm in the subscanning direction was formed. FIGS. 26A and 26B each show a particular relation between the resulting sensor output (ordinate) and time (abscissa). FIGS. 26A and 26B are representative of the developing device of the illustrative embodiment and a conventional developing device for comparison, respectively. The conventional developing device has a main pole having a half with of 40°.

As FIG. 26A indicates, in the illustrative embodiment, the sensor output remains substantially constant over the entire patch. By contrast, as shown in FIG. 26B, the patch of the comparative example is lowered in density at the trailing edge thereof. When the density of the patch varies as in the comparative example, accurate image density is unachievable unless the patch size is increased in the subscanning direction.

In the conventional image forming apparatus or comparative apparatus, the standard size of a patch is 15 mm in both of the main and subscanning directions or 20 mm in both of the main and subscanning directions. Considering the fact that the omission of a trailing edge usually extends over 1 mm to 2 mm, it has been customary to size a patch ten times or more as great as size of the omission of a trailing edge. In this condition, a mean sensor output measured over a preselected period of time has been determined to be substantially accurate.

The illustrative embodiment is free from the influence of the omission of a trailing edge and therefore practicable with a main sensor output that can copes with the ordinary variation of the sensor outputs. Experiments showed that a patch only 5 mm long in the main scanning direction allowed its density to be accurately determined. This is why the patch of the illustrative embodiment is sized 10 mm in the main scanning direction and 5 mm in the subscanning direction. This successfully reduces the area of the patch to one-third to one-eight of the conventional area.

The smaller patch area described above derives the following advantages. The amount of toner forming the patches is reduced and makes it needless to increase the size of a toner bottle or that of a waste toner bottle. The toner deposited on the patches is prevented from smearing the intermediate image transfer belt and members contacting it as far as possible. In addition, the toner deposited on the patches is prevented from flying about and smearing the image density sensor to lower its sensing accuracy.

Figure 27:
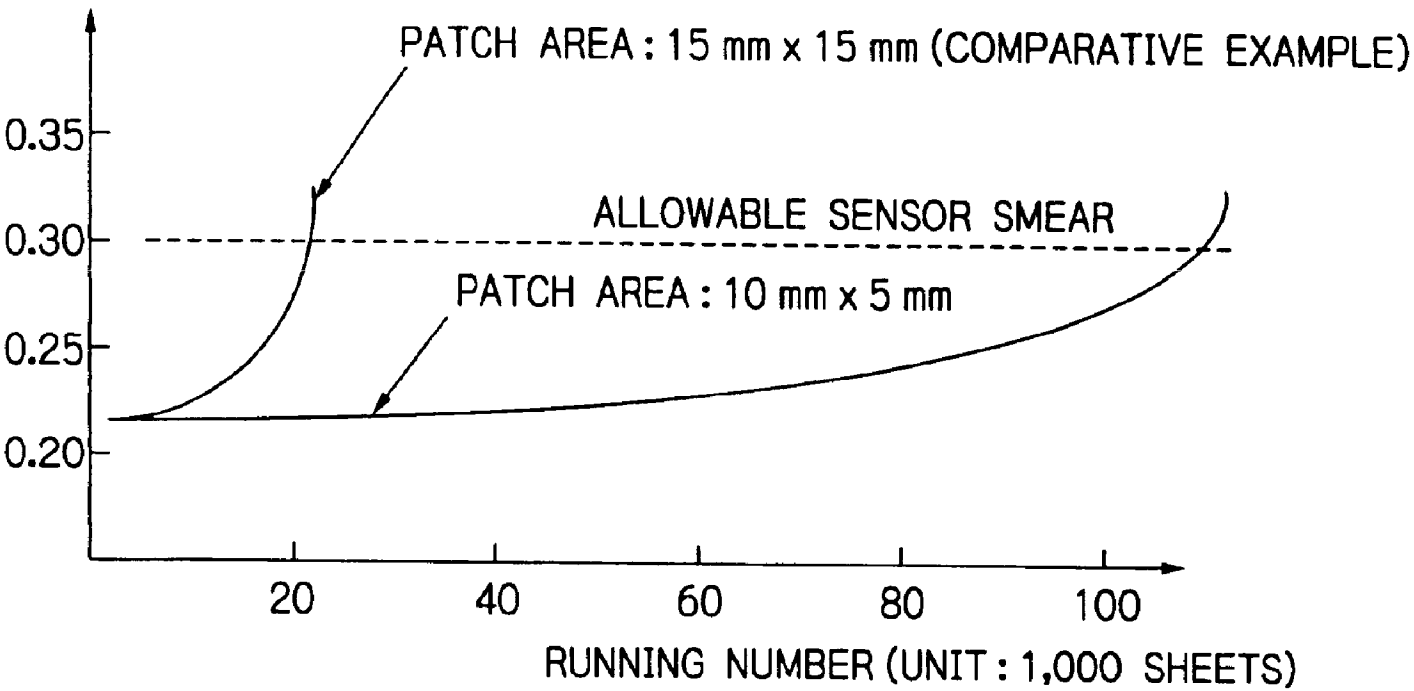
FIG. 27 is a graph showing how the contamination of a density sensor varies in accordance with the area of a patch.

FIG. 27 show the results of running tests conducted with the illustrative embodiment (10 mm×5 mm patch) and the comparative example (15 mm×15 mm patch) in order to determine the degree of smearing of the image density sensor. The degree of smearing was determined in terms of the reflection density of the background. A sensor output of 0.30 was used as the limit of smearing because sensor outputs above 0.30 obstructed accurate control. As shown in FIG. 27, the smearing of the image density sensor ascribable to the patches was acceptable over more than 100,000 paper sheets in the illustrative embodiment. However, the comparative example reached the limit of smearing when about 20,000 papers sheets were fed.

Taking account of the above advantage of the illustrative embodiment as to patch size, the following control maybe executed as well. In the conventional image forming apparatus, it is not practical to form the patches once for more than ten to fifty paper sheets because of the waste of toner and the smearing of the image density sensor. By contrast, the illustrative embodiment can form the patches once for three to fifteen paper sheets without aggravating the above problems because the patch size is only one-third to one-eight of the conventional size. This promotes accurate image density control.

Figure 28:
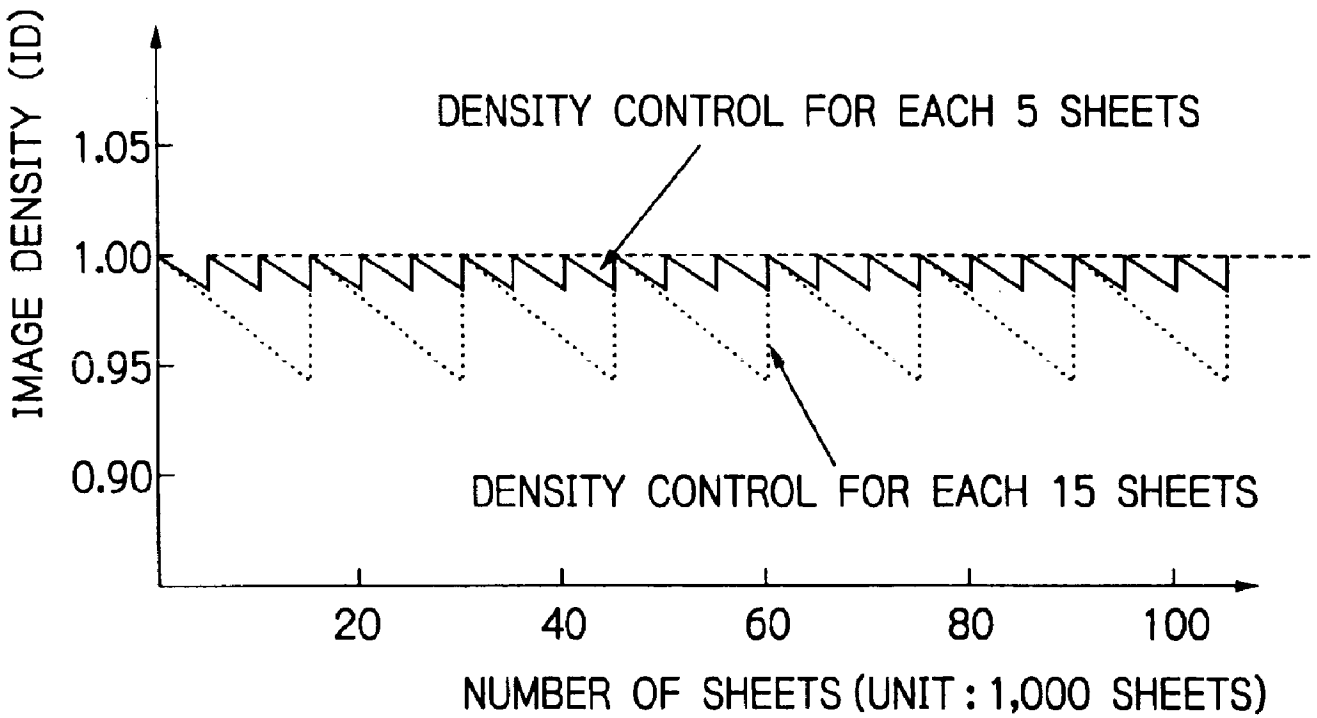
FIG. 28 is a graph showing how image density varies in accordance with a density control interval.

FIG. 28 plots the variations of image density determined when the patch density control was executed once for five paper sheets and when it was executed once for fifteen paper sheets; the control was executed over 100 paper sheets in total in each case. As shown, the image density, of course, varies more in the latter case than in the former case. In this manner, the illustrative embodiment allows the density control to be repeated at shorter intervals than conventional and causes a minimum of density variation to occur in output images.

It is a common practice with an image forming apparatus to form a plurality of patches for gamma characteristic control. This, however brings about the same problem as forming a large patch. For this reason, the number of patches is usually limited to four or so. In the illustrative embodiment, eight stepwise patches are used for gamma characteristic control.

Figure 29:
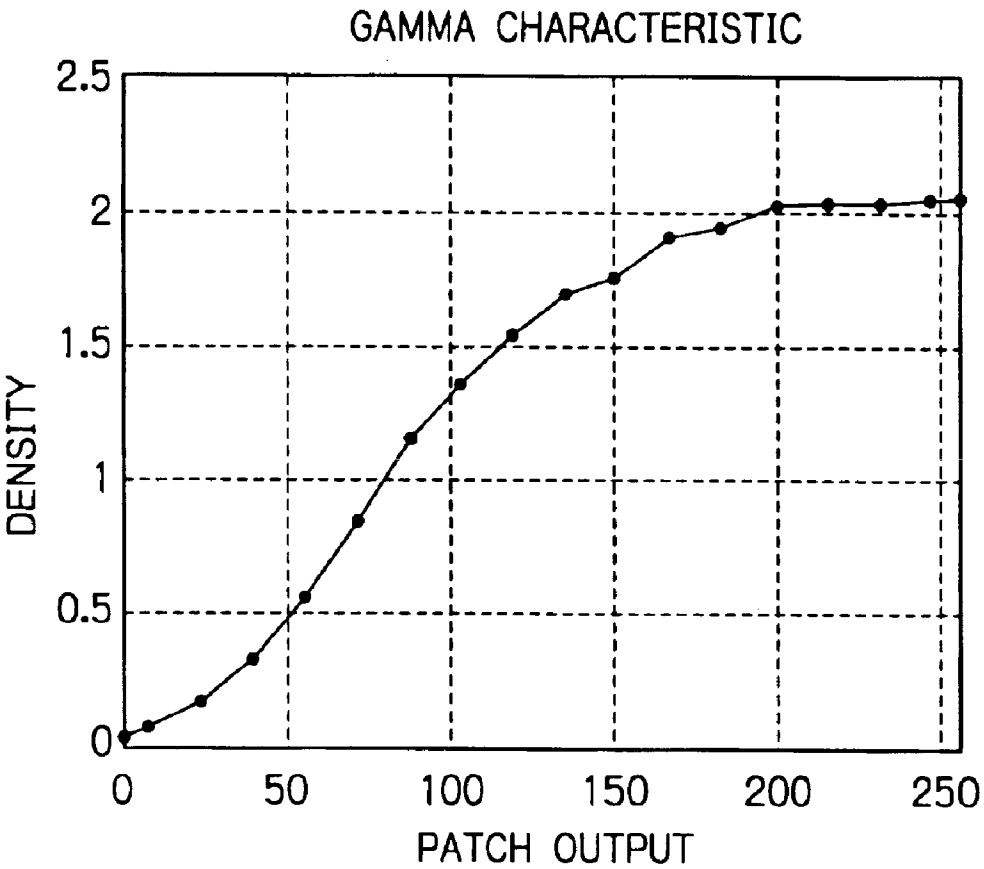
FIG. 29 is a graph representative of a gamma characteristic particular to the ninth embodiment.

Specifically, as shown in FIG. 29, the gamma characteristic of an electrophotographic image forming apparatus has a slope tending to decrease in a highlight portion and a high density portion. The curve of FIG. 29 was determined with the illustrative embodiment. Because the gamma curve is complicated, as shown in FIG. 29, it is impossible to fully grasp the gamma characteristic with only about four patches. This is why the illustrative embodiment forms eight stepwise patches. With such patches, it is possible to accurately grasp the gamma characteristic over the entire range, i.e., from the highlight portion to the high density portion. The illustrative embodiment therefore realizes faithful reproduction of an original image.

Tenth Embodiment

Figure 30:
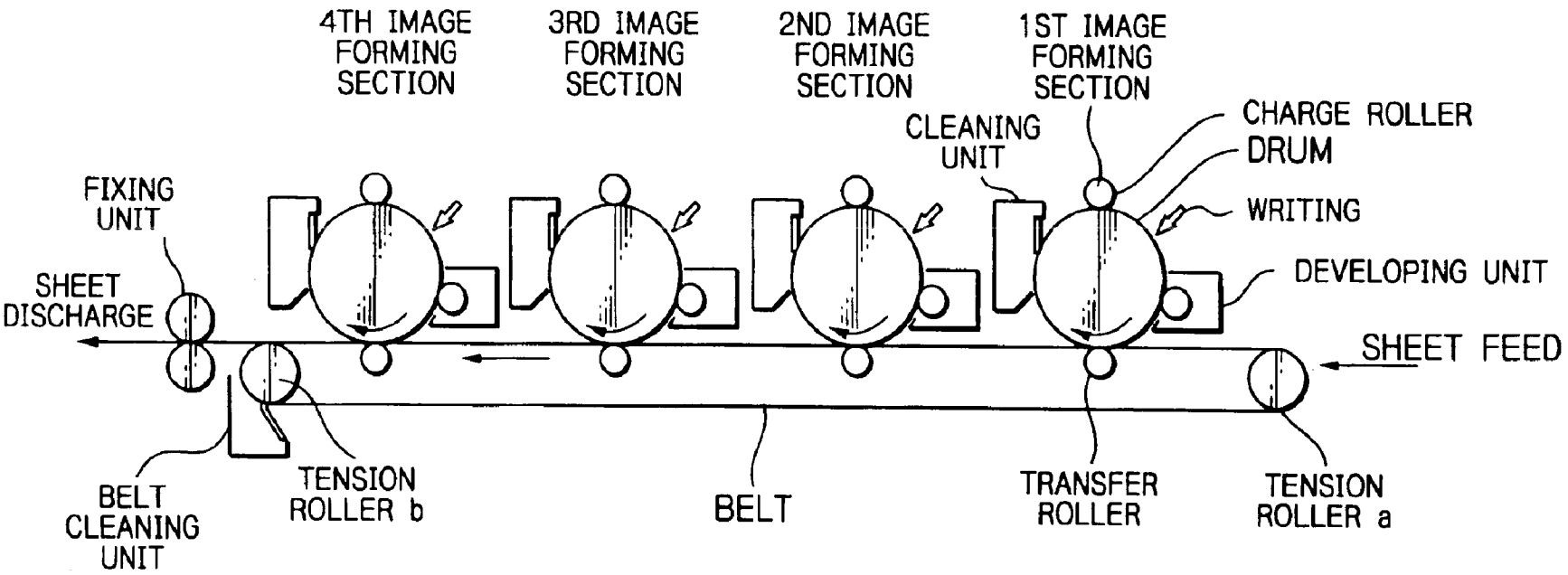
FIG. 30 is a view showing a tandem, color image forming apparatus to which a tenth embodiment of the present invention is applied.
Figure 31:
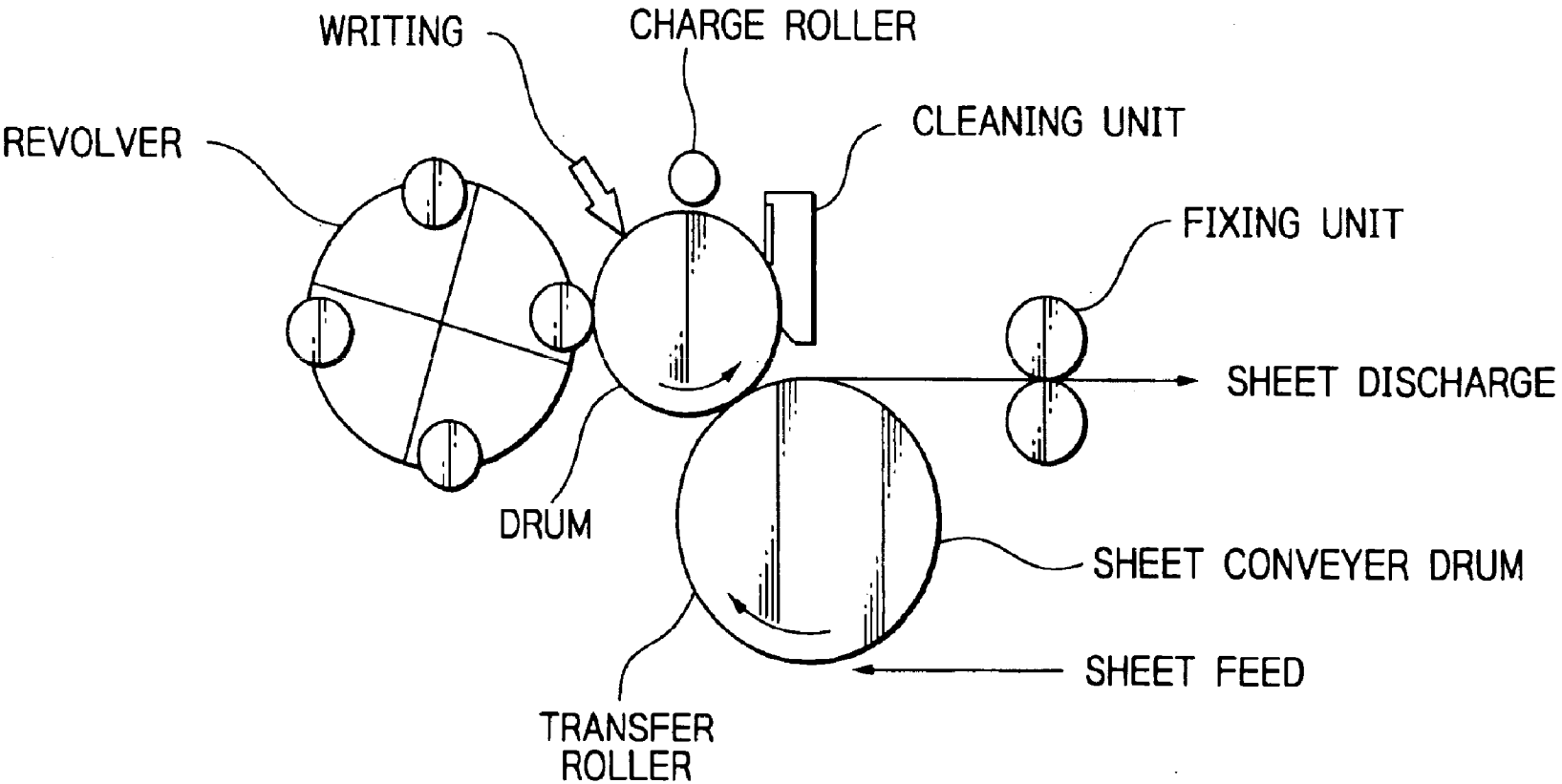
FIG. 31 is a view showing a color image forming apparatus with a revolver to which the tenth embodiment is also applied.

This embodiment is applied to a tandem, color image forming apparatus. As shown in FIG. 30, the tandem, color image forcing apparatus includes four photoconductive drums sequentially arranged in a direction of sheet conveyance. Patch density sensing means, not shown, is assigned to each photoconductive drum, FIG. 31 shows a color image foaming apparatus of the type using a revolver type developing device and sequentially transferring toner images of different color to a paper sheet, which is wound round a sheet conveying drum. Patch density sensing means is associated with the apparatus shown in FIG. 31 as well.

Figure 32:
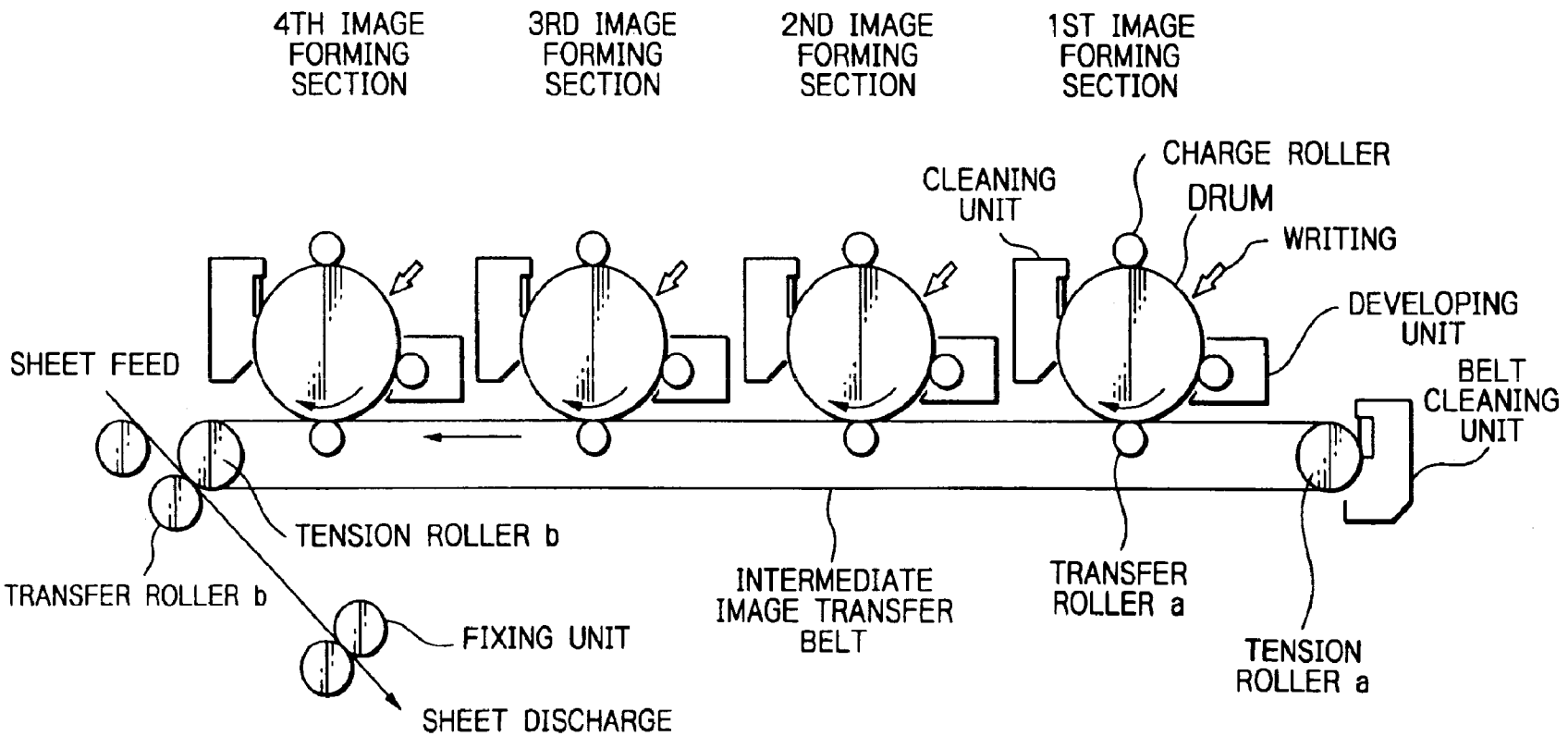
FIG. 32 is a view showing a color image forming apparatus with an intermediate image transfer belt to which the tenth embodiment is also applied.

FIG. 32 shows a tandem, color image forming apparatus including an intermediate image transfer belt. Again, image density sensing means is assigned to each photoconductive drum. Another image density sensing means may be assigned to the intermediate image transfer belt.

Figure 34:
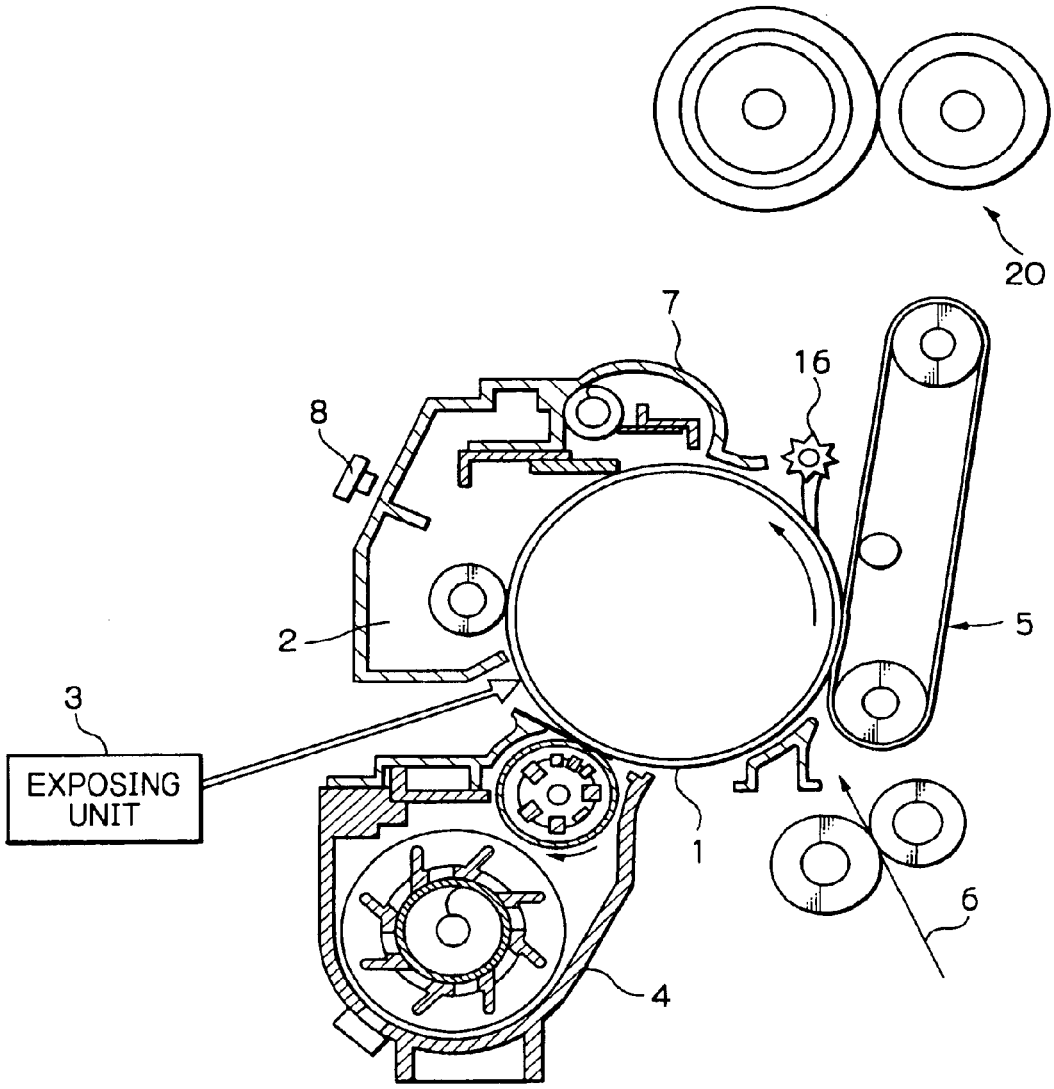
FIG. 34 is a view showing an image forming apparatus with developing device representative of a fourteenth embodiment of the present invention.

FIG. 34 shows a conventional monochromatic image forming apparatus. The illustrative embodiment is similarly applicable to this type of apparatus if the magnet roller of the illustrative embodiment mounted and if the patch density is measured on a photoconductive drum. Sensing means, not shown, may be positioned between the developing device 4 and the image transferring device 51 or between the device 5 and the drum cleaner 7.

Eleventh Embodiment

Figure 33:
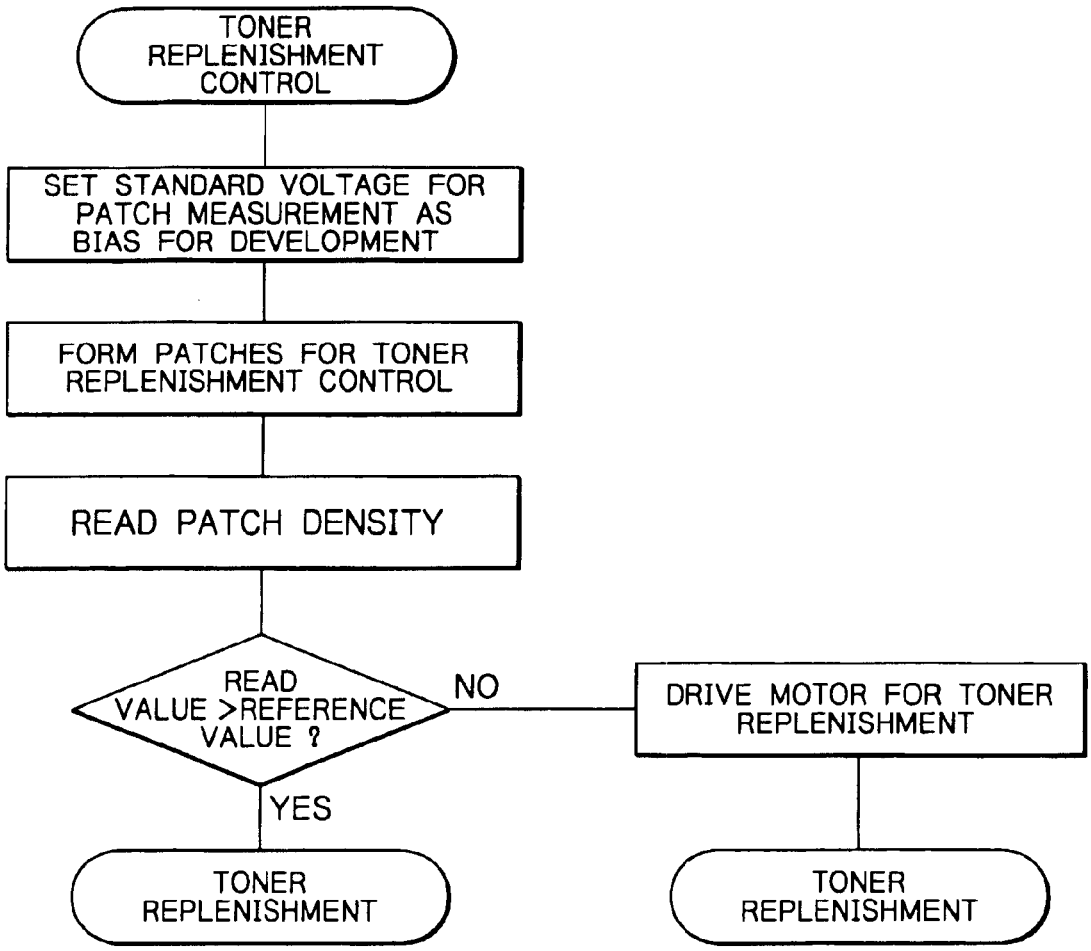
FIG. 33 is a flowchart showing a specific toner replenishment control procedure representative of an eleventh embodiment of the present invention.

In this embodiment, the image forming apparatus is constructed to maintain the toner content of the developer constant by replenishing fresh toner in accordance with the measured patch density. Specifically, patches are formed on the intermediate image transfer belt as in the ninth embodiment. At this instant, a bias for development selected in the same manner as in the ninth embodiment is applied. An optical image density sensor senses the density of the patches and sends its output to a memory. When the sensor output decreases below a reference value, a motor assigned to a toner bottle is driven by a preselected amount so as to replenish fresh toner to the developing device. FIG. 33 demonstrates such a toner replenishment control procedure.

Twelfth Embodiment

This embodiment is identical with the ninth embodiment except for the bias for developing the patches. Specifically, the illustrative embodiment, like the ninth embodiment, forms latent images representative of the patches such that the potential after exposure is −100 V. In the illustrative embodiment the bias for developing the patches is selected to be −400 V, which is the standard bias for development (−250 V in the ninth embodiment). The image density ID of the patches is therefore about 2.0 comparable with the image density ID of a black solid image.

The ninth embodiment is directed toward accurate sensing of a developing ability and, for this purpose, selects a bias for developing the patches as low as −250 V. Such a low bias, however, increases the background potential, i.e., a difference between the charge potential and the bias. When the background potential is increased, it is likely that the toner of the developer is pressed against the developing sleeve and smears the sleeve. The smear of the developing sleeve reduces the effect of the bias and therefore the developing ability during the formation of desired images. Further, a higher background potential is likely to cause the carrier to deposit on the drum due to an electric force. The carrier deposited on the drum is transferred even to a toner image or causes part of the toner image around the carrier to be lost. The illustrative embodiment, developing the patches with the standard bias, solves the above problems.

Thirteenth Embodiment

This embodiment is identical with the twelfth embodiment except for the quantity of light for forming latent images representative of the patches. Specifically, in the illustrative embodiment, the quantity of light is selected such that the potential after exposure is −250 V. The latent images are developed by the bias of −400 V as in the twelfth embodiment.

In the illustrative embodiment, the patches have image density ID of about 1.0 corresponding to that of halftone images. The patches with such medium image density promote accurate image density control, as stated in relation to the ninth embodiment. This is because image density noticeably varies in a halftone portion and causes the developing ability of the developing device to directly translate into density variation. Further, the illustrative embodiment is free from the smear of the developing sleeve and the deposition of the carrier because it does not increase the background potential.

As described above, the ninth to thirteenth embodiments have various unprecedented advantages, as enumerated below.

(1) The toner deposited on the drum again deposits on the magnet brush little. Even if such toner again deposits on the magnet brush, it can be made up for by toner existing in the magnet brush. This obviates the thinning of a horizontal line and the omission of a trailing edge. Further, the toner in the magnet brush easily moves and maintains a high developing ability. In fact, experiments showed that by bringing the position where the magnet brush rises closer to the position where the drum and developing sleeve are closest to each other, a high developing ability was achievable.

(2) Means for sensing the density of a developed image allows image forming conditions to be controlled. Therefore, images with constant quality are insured at all times without being influenced by the aging of the developer, varying environment or the thickness of the photoconductor. Further, the toner content of the developer can be controlled in accordance with the output of the sensing means, so that desired images are achievable with constant image density. In addition, the sensing means obviates an occurrence that, e.g., the operator forgets to set the developing device.

(3) To obviate the omission of a trailing, the patches can be reduced in size to one-third to one-eighth of the conventional patches. At the same time, the toner density of the patches can be sensed with accuracy. Therefore, there can be solved various problems ascribable to the patches, e.g., waste of toner, increase in the amount of waste toner, contamination of images ascribable to the smear of the image transfer roller and intermediate image transfer belt, and decrease in the accuracy of density sensing ascribable to the smear of the density sensing means. In addition, the small patches allow the image density to be controlled at short intervals. This successfully reduces the density variation of desired images as far as possible and allows the developing characteristic of images to be controlled with accuracy, thereby realizing stable reproduction of the gamma characteristic.

(4) Fresh toner is replenished to the developing device in accordance with the output of the image density sensing means, so that the toner content of the developer in the developing device remains constant. It follows that the amount of charge (Q/m) to deposit on the toner, which is apt to effect the developing characteristic, can be maintained constant, allowing the density of desired images to remain constant. In addition, the gamma characteristic for development remains constant.

(5) When image density is sensed in terms of the density of a solid image, the maximum image density available with the image forming apparatus can be sensed. Further, image density can be controlled without causing the developing sleeve to be smeared or causing the carrier to deposit on the drum. By maintaining the maximum density constant, it is possible to maximize the color reproducible range of the apparatus.

(6) When image density is sensed in terms of the density of a halftone image, the developing ability of the apparatus can be accurately sensed. Because the density of a halftone image can be sensed with higher sensitivity than the density of a solid image, accurate image density control is promoted. In addition, the smear of the developing sleeve and the deposition of the carrier are obviated.

(7) When image density is sensed by using a plurality of images different in density, the gamma characteristic of the apparatus can be sensed and allows image forming conditions to be controlled on the basis of the sensed characteristic.

(8) When image density is sensed by using a toner image formed on the drum, it is not necessary to transfer patches to, e.g., the intermediate image transfer drum. This minimizes the contamination of the inside of the apparatus ascribable to toner otherwise depositing on patches. Of course, image density can be sensed even in an image forming apparatus of the type not including the intermediate image transfer belt.

(9) When image density is sensed by using a toner image formed on the intermediate image transfer body, the image density of the patches can be measured in a condition closer to actual images to be printed. Specifically, at the time of primary image transfer from the drum to the intermediate image transfer body, some toner remains on the drum without being transferred to the intermediate body. Therefore, the toner image on the drum and the toner image on the intermediate body are subtly different from each other; the latter is presumably closer to actual images to be printed than the former. The toner image on the image transfer body is therefore advantageous over the toner image on the drum from an image quality standpoint. Moreover, in a color image forming apparatus, the patches of four different colors can be sensed at the same time, reducing the density measuring time.

(10) When use is made of a density sensor responsive to a reflection from an image (reflectance), the intermediate image transfer belt and drum are free from damage. Further, rapid response particular to such a density sensor makes it needless to glow down the rotation of the drum or that of the belt during measurement.

(11) A color image forming apparatus is lower than a monochromatic image forming apparatus as to the maximum density of images and the allowable width of gamma characteristic variation. This is because monochromatic images are mainly line images while color images are mainly photographic images. A photographic image must be accurately reproduced on a pixel basis and must have a halftone portion thereof reproduced with constant density. If any one of four colors forming a color image is deviated, then it is reproduced as another color, critically degrading image quality. In this sense, when the illustrative embodiments are applied to a case needing image forming condition control with a limited allowance, they realize an image forming condition capable of outputting high quality images.

Fourteenth Embodiment

This embodiment is mainly directed toward the fifth object stated earlier. As shown in FIG. 34, the image forming apparatus of the illustrative embodiment includes the drum 1, charger 2, exposing unit 3, developing device 4, image transferring device 5, and the cleaner 7, as in the previous embodiments. The reference numeral 8 designates a discharge lamp 8 for discharging the surface of the drum 1 after the image transfer from the drum 1 to the paper sheet 6.

After the charger 2 has uniformly charged the surface of the drum 1 with a charge roller, the exposing unit 4 exposes the charged surfaced of the drum 1 imagewise for thereby forming a latent image. The developing device 4 develops the latent image with toner to thereby form a corresponding toner image. The image transferring device including a belt by way of example, transfers the toner image from the drum 1 to the paper sheet 6. A peeler 16 peels off the paper sheet 6 electrostatically adhering to the drum 1. A fixing unit 20 fixes the toner image on the paper sheet 6. The cleaner 7 removes the toner left on the drum 1 after the image transfer. Subsequently, the discharge lams 8 initializes the surface of the drum 1 in order to prepare it for the next image formation.

Figure 35:
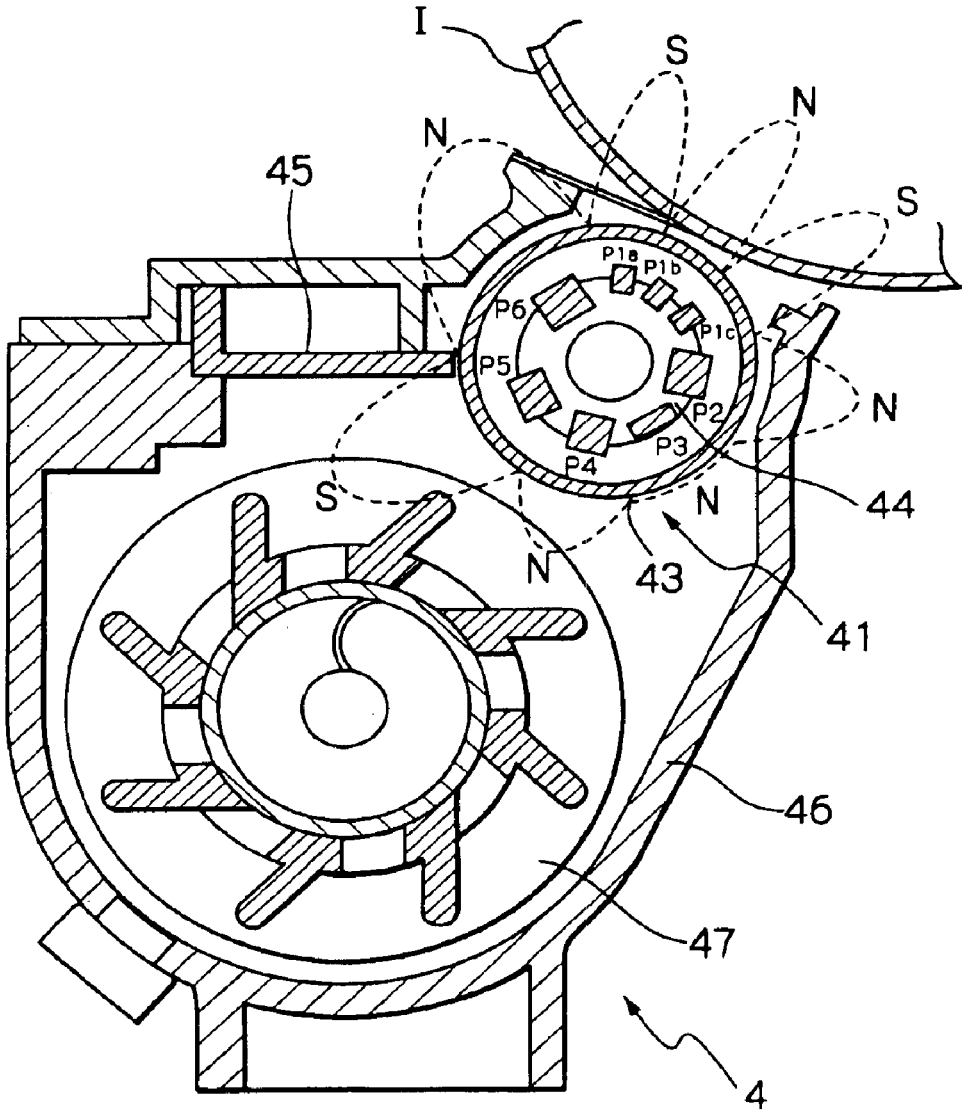
FIG. 35 is a view showing the developing device of FIG. 34 more specifically.

FIG. 35 shows a specific configuration of the developing device 4. As shown, the developing device 4 includes a developing roller 41 adjoining the drum 1. The developing roller 41 includes a cylindrical sleeve 43 formed of aluminum, brass, stainless steel, conductive resin or similar magnetic material. A drive mechanism, not shown, causes the sleeve 43 to rotate clockwise, as viewed in FIG. 35, or in a direction of developer conveyance. A doctor blade or metering member 45 is positioned upstream of a developing region in the direction of developer conveyance for regulating the height of a magnet brush formed on the sleeve 43. A doctor gap between the doctor blade 45 and the sleeve 43 is selected to be 0.4 mm. A screw 47 is positioned at the opposite side to the drum 1 with respect to the developing roller 41. The screw 47 scoops up the developer stored in a casing 46 to the developing roller 41 while agitating it.

A magnet roller 44 is held stationary within the sleeve 43 for causing the developer to form a magnet brush on the sleeve 43. Specifically, the magnet roller 44 causes the carrier of the developer to rise on the sleeve 43 in the form of chains along magnetic lines of force normal to the sleeve 43. The toner of the developer deposit on the carrier or chains, forming the magnet brush. The sleeve 43 conveys the magnet brush formed thereon in the clockwise direction.

The magnet roller 44 has a plurality of magnetic poles or magnets P1*a* through P1*b* and P2 through P6. The pole or main pole P1*b* causes the developer to wise in the developing region where the sleeve 43 and drum 1 face each other. The poles P1*a* and P1*c* help the main pole P1*b* exert such a magnetic force. The pole P4 scoops up the developer to the sleeve 43. The poles P5 and P6 convey the developer to the developing region. The poles P2 and P3 convey the developer in a region following the developing region. All of the poles of the magnet roller 44 are oriented in the radial direction of the sleeve 43. While the magnet roller 44 is shown as having eight poles, additional poles may be arranged between the pole P3 and the doctor blade 45 in order to enhance the scoop-up of the developer and the ability to follow a black solid image. For example, two to four additional poles may be arranged between the pole P3 and the doctor blade 45.

As shown in FIG. 35, the poles P1*a* through P1*c* are sequentially arranged from the upstream side to the downstream side in the direction of developer conveyance, and each is implemented by a magnet having a small sectional area. While such magnets are formed of a rate earth metal alloy, they may alternatively be formed of, e.g., a samarium alloy, particularly a samarium-cobalt alloy. An iron-neodium-boron alloy, which is a typical rare earth metal alloy, has the maximum energy product of 358 kJ/m$^3$. An ion-neodium-boron alloy bond, which is another typical rare earth metal, has the maximum energy product of 80 kJ/m$^3$ or so. Such magnets guarantee magnetic forces required of the surface of the developing roller 41 despite their small sectional area. A ferrite magnet or a ferrite bond magnet, which are conventional, respectively have the maximum energy products of about 36 kJ/m$^3$ and 20 kJ/m$^3$. If the sleeve 43 is allowed to have a greater diameter, then use may be made of ferrite magnets or ferrite bond magnets each having a relatively great size or each having a tip tapered toward the sleeve 43 in order to reduce a half width.

If desired, the magnets, particularly the magnets other than the magnets P1*a* through P1*c*, may be implemented as a single molding while the magnets P1*a* through P1*c* may be molded independently of each other and then joined together. Further, sectoral magnets may be adhered to the shaft of the magnet roller 44.

Figure 36:
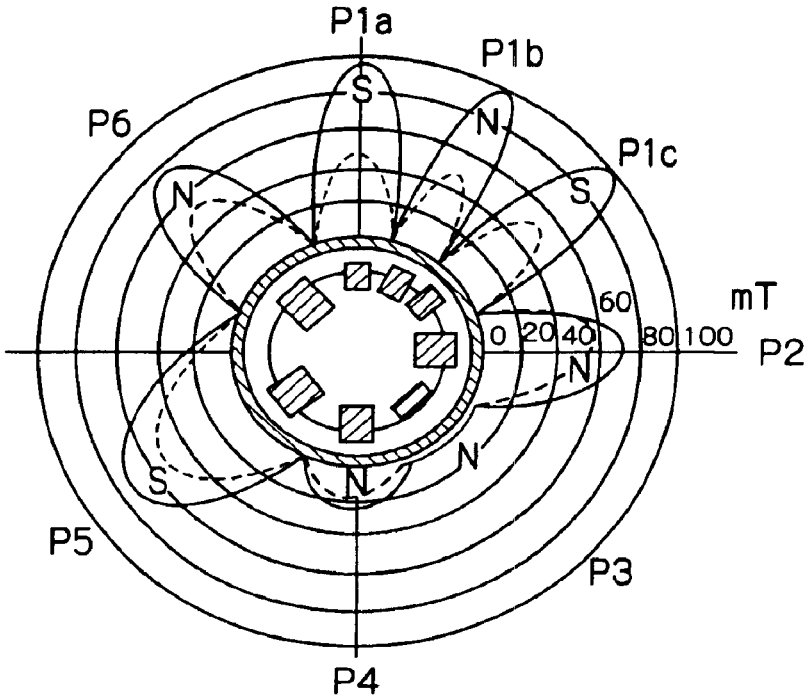
FIG. 36 is a chart showing the magnetic force distribution and its size available with a developing roller included in the fourteenth embodiment.

In the above specific configuration, the main pole P1*b* and poles P4, P6, P2 and P3 are N poles while the poles P1*a*, P1*c* and P5 are S poles. FIG. 36 shows flux density determined by measurement in the direction normal to the developing roller 41. As shown, the main pole P1*b* is implemented by a magnet exerting a magnetic force of 85 mT or above on the developing roller 41. Magnetic forces contributing to the deposition of the carrier are tangential to the developing roller 41. While the magnetic forces of the magnets P1*a* through P1*c* must be intensified to intensify the tangential magnetic forces, the deposition of the carrier can be reduced only if any one of such magnetic forces is intensified. The magnets P1*a* through P1*c* each had a width of 2 mm while the magnet P1*b* had a half width of 16°.

Figure 37:
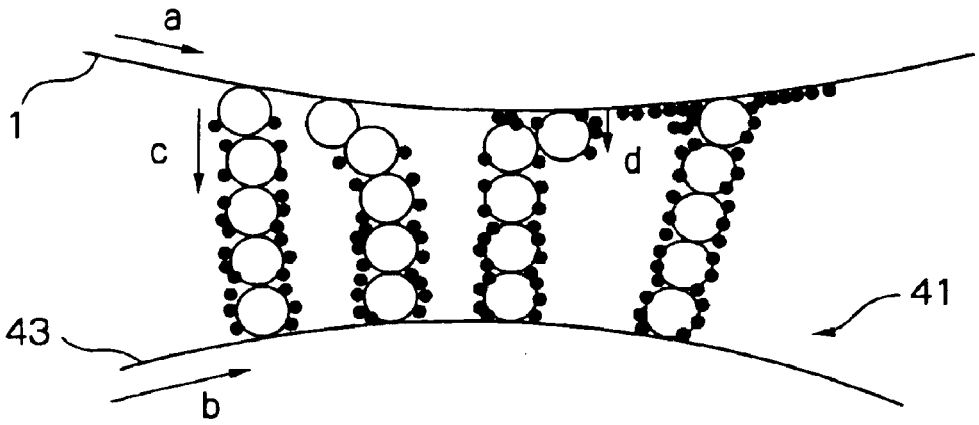
FIG. 37 is a view showing why the trailing edge of an image is lost.

The drum 1 and developing roller 41 form a nip for development therebetween. In the case of contact development, the toner moves mainly in the nip or developing region. The omission of a trailing edge is the problem that occurs due to the movement of the toner. This will be described with reference to FIG. 37. As shown, the drum 1 and developing roller 41, or sleeve 43, rotate in directions a and b, respectively. The developing roller 41 moves at a higher linear velocity than the drum 1. The magnet brush therefore always develops a latent image formed on the drum 1, outrunning the latent image. When the magnet brush contact the non-image portion or background of the drum 1, the electric field formed in the developing region exerts a force in a direction c, forcing the toner present at the tip of the magnet brush away from the drum 1. As a result, the longer time for which the magnet brush remains in contact with the non-image portion, the lower the toner concentration around the drum 1.

The magnet brush moves toward the downstream side of the developing region in accordance with the movement of the developing roller 41 and catches up with the image portion of the drum 1. At this instant, the tip of the magnet brush low in toner concentration electrostatically attracts the toner deposited on the drum 1 in a direction d. Consequently, the toner present on the drum 1 decreases while the toner present at the tip of the magnet roller again increases. If the magnet restores the toner concentration, then it does not attract the toner away from the drum 1 even when further moved to the downstream side.

However, when the magnet brush remains in contact with the drum 1 only for a short period of time, the tip of the magnet brush low in toner concentration contacts the trailing edge of the image carried on the drum 1. Consequently, the amount of the toner forming the image decreases with the result that the trailing edge of the image passed the developing region is appears blurred.

In the developing region or nip, the size of the electric field differs from the point where the drum 1 and sleeve 43 are closest to each other to the point where they are remotest frown each other, i.e., the boundary of the nip. In the illustrative embodiment, the drum 1 has a diameter of 60 mm and moves at a linear velocity of 240 mm/sec. The sleeve 43 has a diameter of 20 mm and moves at a linear velocity or 600 mm/sec. The ratio of the linear velocity of the sleeve 43 to that of the drum 1 is therefore 2.5. Further, the gap between the drum 1 and the sleeve 43 is 0.4 mm while the nip width is 4 mm. In these conditions, the distance between the drum 1 and the sleeve 43 is 0.4 mm at the center of the nip and 0.67 mm at the boundary of the nip. Assuming that the developer layer has a uniform width, then the field strength at the center of the nip and the field strength at the boundary of the nip have a ratio of about 1:0.6. Therefore, at the downstream side of the nip, opposite charge deposited on the carrier around the drum 1 collects the toner more than the electric field causes the toner to deposit on the drum 1, resulting in the omission of a trailing edge.

By contrast, by reducing the nip width such that the gap ratio between the center and the boundary approaches 1, it is possible to prevent the field strength from decreasing even at the boundary. Therefore, the carrier substantially does not collect the toner present on the drum 1, so that the omission of a trailing edge is obviated. FIG. 38 shows the results of experiments conducted to confirm the above occurrence.

Figure 39:
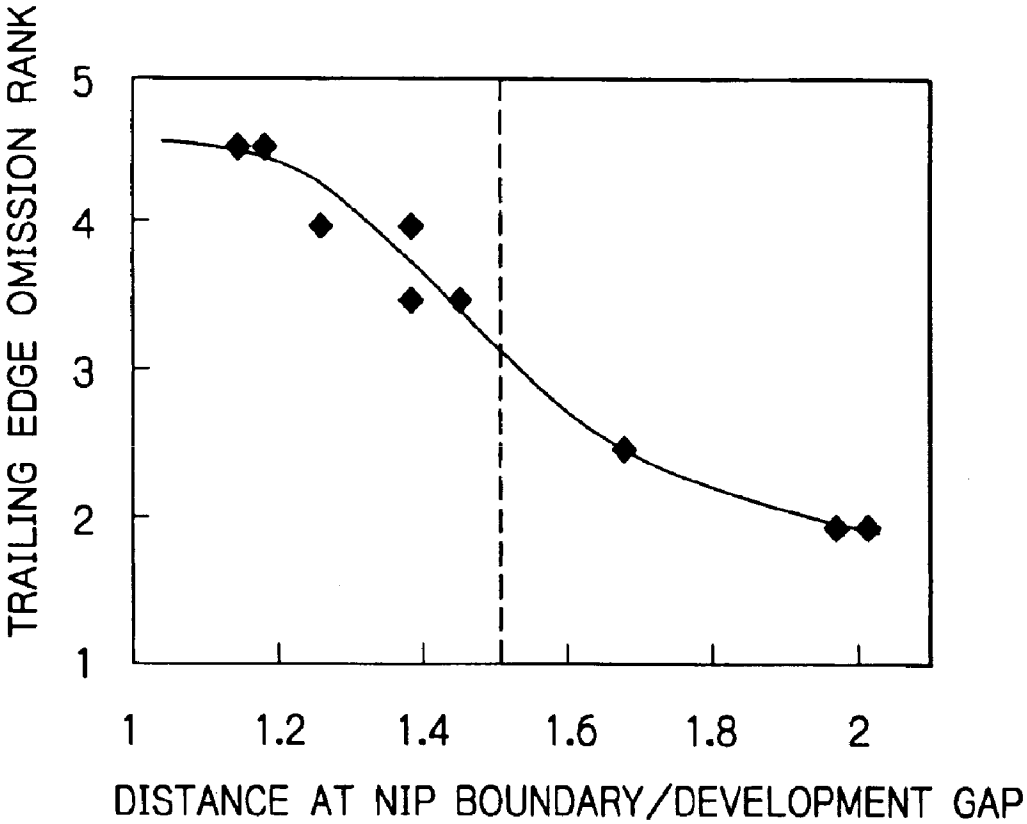
FIG. 39 is a graph showing a relation between a ratio of a distance at the boundary of a nip to the development gap and the omission of a trailing edge.

To measure the nip widths while the drum 1 and sleeve 43 were held stationary, a bias for causing the toner to migrate from the sleeve 43 toward the drum 1 was applied. In this condition, the range of the drum 1 over which the toner deposited on the drum 1 was measured as a nip. More specifically, the above bias was applied to the sleeve 43 for about 1 second without the drum 1 being charged. The drum 1 was then pulled out to measure the width over which the toner deposited on the drum 1 in the direction of movement of the drum 1. The boundary of the nip was determined by calculation using the drum diameter, sleeve diameter, development gap, and development nip. In any case, the ratio of the linear velocity of the sleeve 43 to that of the drum 1 was 2.5. FIG. 39 shows the results of measurement. In FIG. 39, the abscissa indicates a ratio of the distance between the drum 1 and the sleeve 43 at the boundary of the nip, i.e., the development gap to the distance between the same at the center of the nip. The ordinate indicates the rank of the omission level of a trailing edge observed by eye; rank 5 indicates that no omission was observed while rank 1 indicates that omission was most conspicuous.

As FIG. 39 indicates, the ratio in distance and the omission of a trailing edge are correlated, as expected. When the ratio in distance exceeds 1.5 the omission of a trailing edge is conspicuous and lowers image quality while aggravating the thinning of a horizontal line, rendering dots irregular and aggravating granularity. It follows that if the ratio in distance is 1.5 or below, then an image free from the omission of a trailing edge is attainable. By the same mechanism, there are insured the faithful reproduction of lines and stable reproduction of dots.

Figure 40:
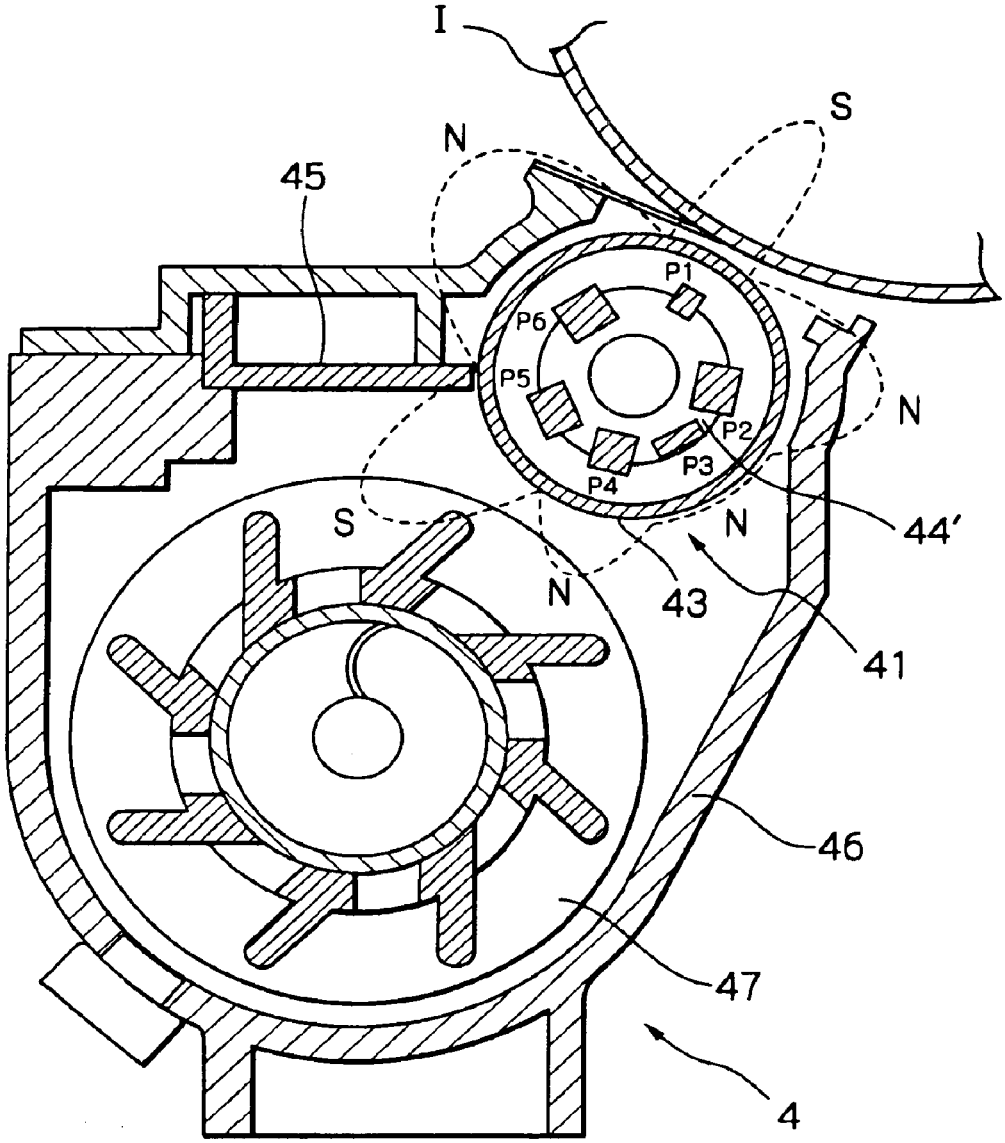
FIG. 40 is a view showing a modification of the fourteenth embodiment.

FIG. 40 shows another specific configuration of the developing device 4. As shown, a magnet roller 44' lacks auxiliary poles around a main pole P1 (Nos. 2, 5 and 8, FIG. 38). The developing device 4 of FIG. 40 is identical with the developing device 4 of FIG. 35 except for the arrangement of the magnetic poles or magnets; identical structural elements are designated by identical reference numerals. The magnet roller 44' has, in addition to the main pole P1, a pole P4 for scooping up the developer to the sleeve 43, poles P5 and P6 for conveying the developer to the developing region, and poles P2 and P3 for conveying the developer in the region following the developing region. The poles P2 through P6 are oriented in the radial direction of the sleeve 43. Again, additional poles or magnets may be arranged between the pole P3 and the doctor blade 45 for the previously stated purpose.

Figure 41:
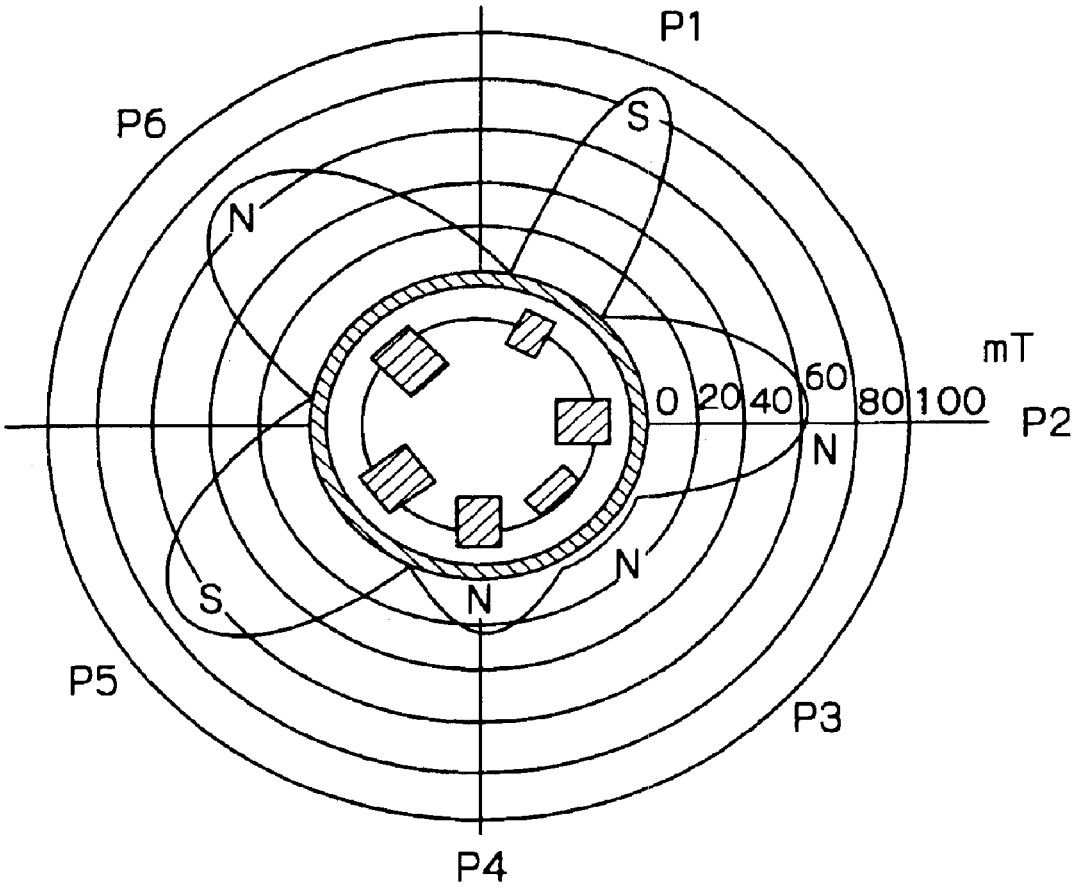
FIG. 41 is a chart corresponding to FIG. 36, showing the magnetic force distribution and its size available with a developing roller shown in FIG. 40.

The magnet P1 forming the main pole P1 is configured in the sale manner as and formed of the same material as the magnets P1*a* through P1*c* shown in FIG. 35. The poles P2, P3, P4 and P6 are N poles while the poles P1 and P5 are S poles. FIG. 41 is a chart corresponding to FIG. 36.

Experiments were conducted with the configuration of FIG. 40 to determine whether or not the omission of a trailing edge was obviated. FIG. 38 shows the results of such experiments as well.

Referring again to FIG. 36, the attenuation of the flux density in the normal direction will be described. In FIG. 36, solid lines are representative of flux density measured on the surface of the sleeve 43 while phantom lines are representative of flux density measured at a distance of 1 mm from the surface or the sleeve 43. For the measurement, use was made of a gauss meter HGM-8300 and an axial probe type A1 available from ADS. Measured data are recorded by a circle chart recorder.

In the specific configuration shown in FIG. 35, flux density of the main magnet P1*b* was 95 mT on the surface of the sleeve 43 and 44.2 mT at a distance of 1 mm from the surface of the sleeve 43. The flux density varied by 50.8 mT. In this case, the attenuation ratio of the flux density is 53.5%. The attenuation ration refers to a ratio produced by dividing a difference between the peak value at the distance of 1 mm by the peak value on the sleeve 43. When the maximum magnetic force of the main pole P1*b* is 95 mm, the half value is 7.5 mT while its half width is 22°. Half widths above 22° resulted in defective images.

The flux density of the auxiliary magnet P1*a* positioned at the upstream side of the main magnet P1*b* was 93 mT on the surface of the sleeve 43 and 439.6 mT at the distance of 1 mm. The flux density varied by 43.4 mT. The attenuation ratio of the flux density is 46.7%. The flux density of the auxiliary magnet P1*c* positioned at the downstream side of the main magnet P1*b* was 92 mT on the surface of the sleeve 43 and 51.7 mT at the distance of 1 mm. The flux density varied by 40.3 mT. The attenuation ratio of the flux density is 43.8%. Only part of the magnet brush that is formed by the main pole P1*b* contacts the drum 1 and develops a latent image formed on the drum 1. When the drum 1 did not contact the magnet brush, the brush was measured to be about 1.5 mm highs which was smaller than conventional height of about 3 mm, and was dense.

When the gap between the doctor blade 45 and the sleeve 43 was the same as the conventional gap, the magnet brush in the developing region was found to be low, or short, and dense because the gap allows the same amount of developer to pass. This phenomenon will be understood from the magnet force pattern shown in FIG. 36. At the distance of 1 mm from the surface of the sleeve 43, the flux density sharply decreases and prevents the magnet brush from forming brush chains at a position remote from the sleeve 43. The resulting brush chains are therefore short and dense. In this connection, in a conventional magnet roller, the flux density of a main pole was 73 mT on the surface of the sleeve 43 and 51.8 mT at the distance of 1 mm; the flux density varied by 21.2 mT. The attenuation ratio of the flux density was 29%.

Experimental results showed that the attenuation ratio increased with a decrease in half width. The half width can be reduced if the width of the magnet in the circumferential direction of the sleeve 43 is reduced. For example, in the specific configuration shown in FIG. 35, the magnets P1*a* through P1*c* each had a width of 2 mm while the main magnet P1*b* had a half width of 16°. A 1.6 mm wide magnet formed a main pole having a half width of 12°. As the halt width decreases, more magnetic lines of force turn round to adjoining magnets with the result that the flux density at a position remote from the sleeve surface decreases. There exist between the magnet roller 44 and the sleeve 43 a space necessary for fixing the roller 44 and allowing the sleeve 43 to rotate and a substantial gap corresponding to the wall thickness of the sleeve 43. Consequently, the flux density substantially concentrates on the sleeve side. This is why the flux density decreases with an increase in the distance from the surface of the sleeve 43.

A magnet roller with a high attenuation ratio implements a short or low, dense magnet brush while a magnet roller with a low attenuation ratio forms a long or high, rough magnet brush. Specifically, a magnet with a high attenuation ratio (P1*b*) forms a magnetic field easily attracted by the adjoining magnets (P1*a* and P1*c*) The flux density therefore turns round in the tangential direction more than it spreads in the normal direction, making it difficult for the magnet brush to extend in the normal direction. As a result, the magnet brush is short and rough. For example, the magnet brush formed by the magnet P1*b* is more stable when short and close to each other than when long and discrete from each other. Even when the amount of developer to be scooped up is increased, the conventional magnet with a low attenuation ratio cannot form a short magnet brush.

To increase the attenuation ratio, the auxiliary magnets adjoining the main magnet may be positioned closer to the main magnet in the circumferential direction of the sleeve 43. In this configuration, more magnetic lines of force issuing from the main pole tun round to the auxiliary poles, increasing the attenuation ratio.

In the illustrative embodiment, the carrier has a mean particle size of 50 $\mu$m. For comparison, images were formed under the same conditions except that use was made of carriers having mean particle sizes of 100 $\mu$m and 150 $\mu$m, respectively. The carriers having the mean particle sizes of 100 $\mu$m and 150 $\mu$m both reduced the density of the magnet brush on the sleeve 43 and caused brush marks to appear in images while lowering the developing ability. When the development gap was reduced below 150 $\mu$m, even the carrier having the mean particle size of 50 $\mu$m rendered brush marks conspicuous. By observing the nip for development, we found the following. When less than three carrier particles were stacked, even the carrier particle closest to the drum 1 was directly, strongly restrained by the magnet, extremely reducing the flexibility of the magnet brush. As a result, the individual carrier particle did not move independently of the others, but the entire brush behaved in the form of rods.

In light of the above, in the illustrative embodiment, three or more carrier particles are caused to exist between the sleeve 43 and the drum 1 when aligned perpendicularly to the sleeve 43, providing the magnet brush with flexibility. This successfully reduces the frictional force of the magnet brush and increases the density of the developer on the sleeve 43, thereby insuring a uniform image not dependent on direction.

In the illustrative embodiment, a laser beam is incident to the drum 1 via a polygonal mirror so as to scan the drum 1. Alternatively, use may be made of any other optical writing device, e.g., an LED array.

As stated above, the illustrative embodiment allows the electric field to maintain sufficient strength even at the boundary of the developing region and thereby faithfully develops a latent image. The resulting image is free from granularity as well as various defects described above.

Fifteenth Embodiment

This embodiment is mainly directed toward the sixth object stated earlier. The illustrative embodiment, like the fourteenth embodiment, is practicable with the configuration shown in FIGS. 34 and 35. The following description will concentrate on features Unique to the illustrative embodiment.

In a specific configuration of the developing device, the drum 1 had a diameter of 60 mm and moves at a linear velocity of 240 mm/sec. The sleeve 43 has a diameter of 20 mm and moves at a linear velocity of 600 mm/sec, which is 2.5 times as high as the Linear velocity of the drum 1. The development gap between the drum 1 and the sleeve 43 is 0.4 mm. For a mean carrier particle size of 50 $\mu$m, the development gap has customarily been about 0.65 mm to about 0.8 mm, which is ten times or more as great as the developer particle size. A required image density is achievable even if the ratio in linear velocity of the sleeve 43 to the drum 1 is reduced to 1.1.

Figure 42:
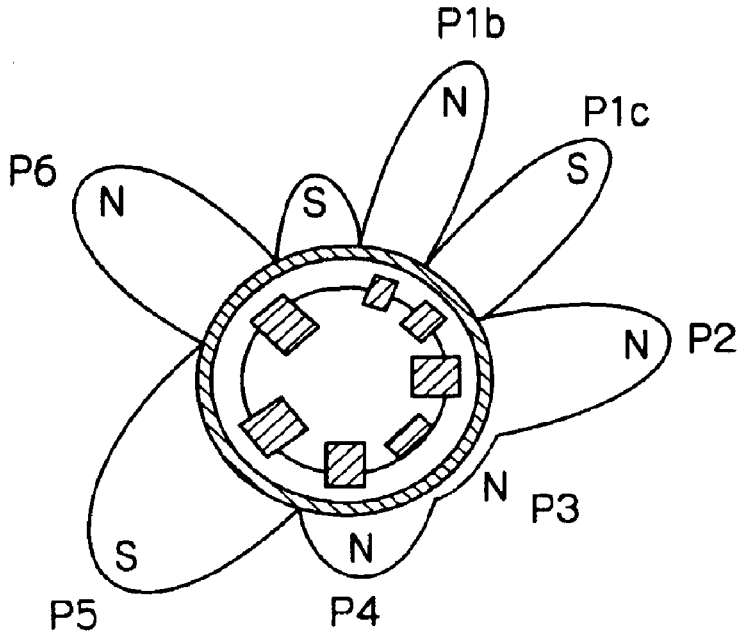
Fig. 42 PRIOR ART
FIG. 42 is a chart showing a magnetic force distribution lacing an auxiliary magnet particular to a fifteenth embodiment of the present invention.

As shown in FIG. 36, in the specific configuration, the center half-power angle does not vary whether the two auxiliary magnets P1*a* and P1*c* are arranged or whether only the auxiliary magnet P1*c* is arranged at the downstream side of the main pole P1*b*. The difference is that only the magnetic force of the main pole P1*b* decreases by several percent. In FIG. 42, the auxiliary magnet P1*a* is absent at the upstream side of the main magnet P1*b*, the magnetic force at the upstream side decreases to about 30 mT, as determined by experiments. However, this position is expected to be shielded by an inlet seal and not exposed to the image forming section, so that the developer can be fed to the main pole.

Figure 43:
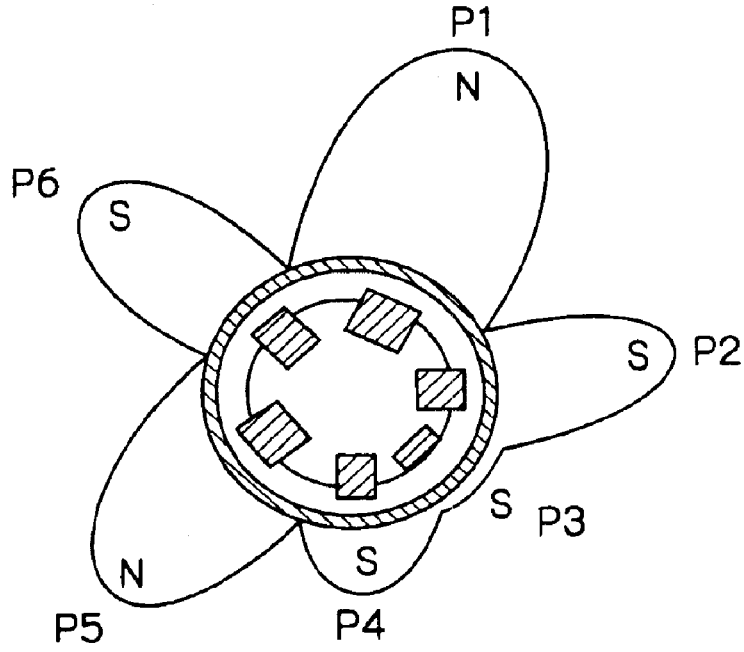
Fig. 43 PRIOR ART
FIG. 43 is a chart showing a magnetic force distribution of a conventional developing roller for comparison.

By reducing the width of the magnet, it is possible to further reduce the center half-power angle, as also determined by experiments. When the main pole was implemented by a 1.6 mm wide magnet, the center half-power angle was as small as 12°. As FIG. 36 indicates, the maximum magnetic force of the main magnet P1*b* is 90 mT. In this case, the center half-power angle is 45 mT while its angular width is 25°. Center half-power angles above 25° resulted in defective images. For comparison, FIG. 43 shows a magnetic force distribution particular to the conventional magnet roller.

Figure 44:
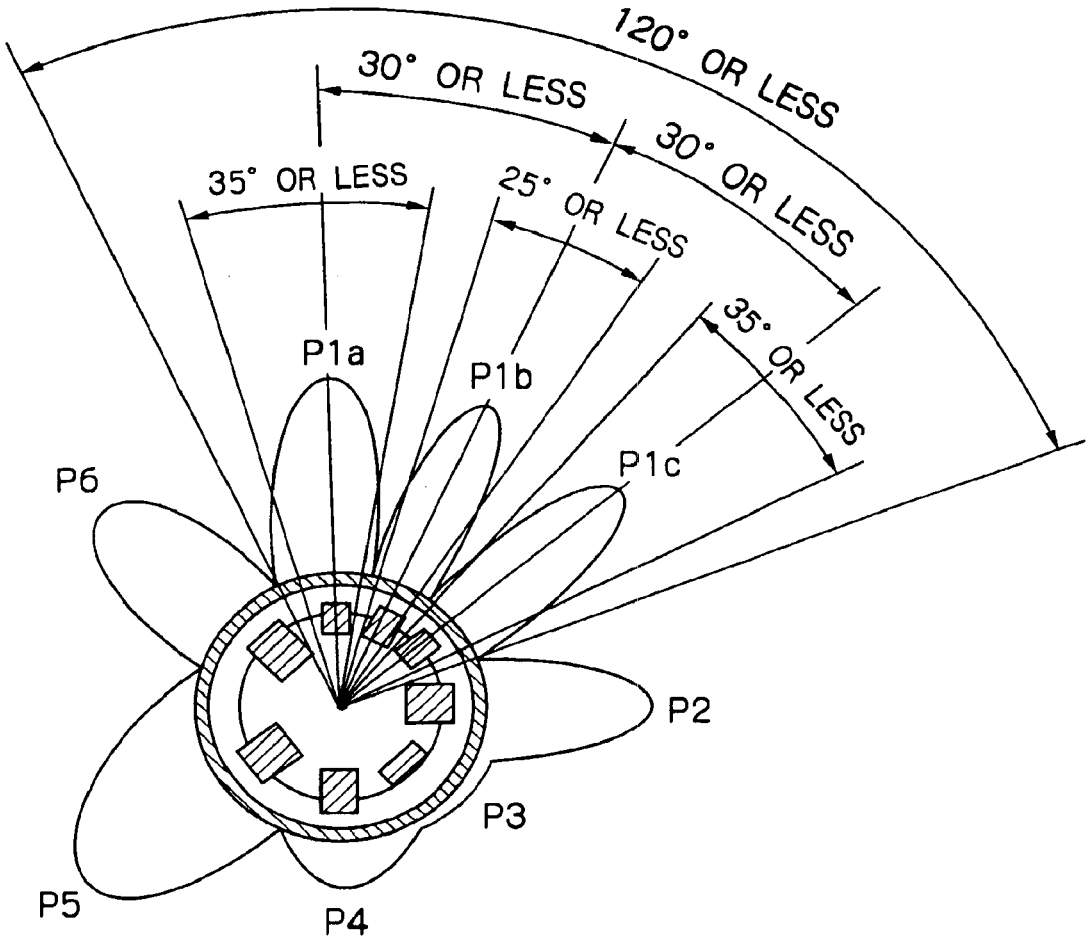
FIG. 44 is a chart showing a relation between a main magnet and auxiliary magnets.

In the specific configuration, the center half-power angle of each of the auxiliary magnets P1*a* and P1*c* is selected to be 35° or below. This center half-power angle cannot be reduced relatively because the magnets P2 and P6 positioned outside of the magnets P1*a* and P1*c* have great center half-power angles. FIG. 44 shows a positional relation between the main magnet P1*b* and the auxiliary magnets P1*a* and P1*c*. As shown, the angle between the each of the auxiliary magnets P1*a* and P1*c* and the main magnet P1*b* is selected to be 30° or below. More specifically, because the center half-power angle of the main pole P1*a* is 16°, the above angle is selected to be 25°. Further, the angle between the transition point (0 mT) between the magnets P1*a* and P6 and the transition point (0 mT) between the magnets P1*c* and P2 is selected to be 120° or below. The transition point refers to a point where the N pole and S pole replaces each other.

Figure 46:
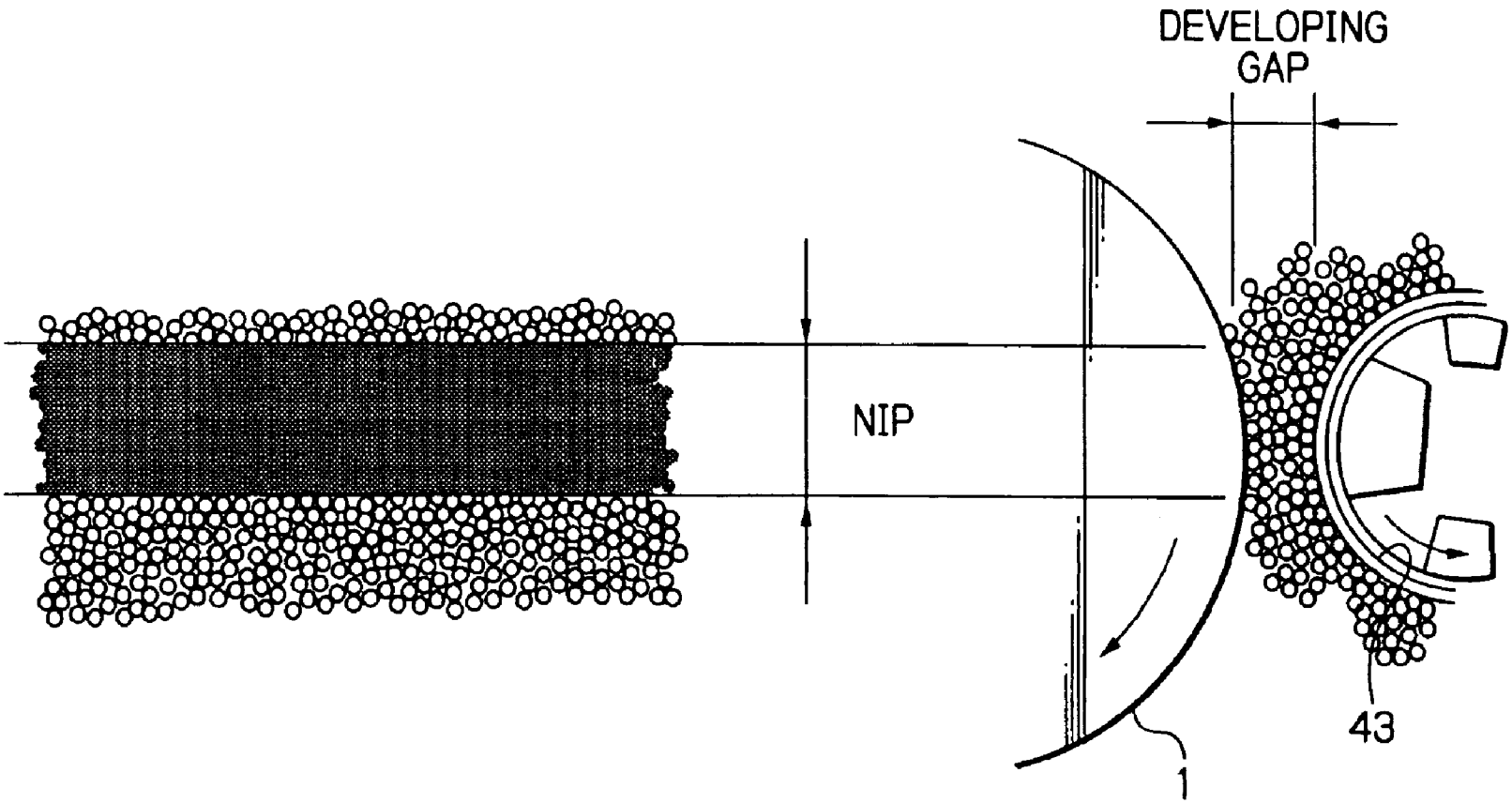
Fig. 46 PRIOR ART
FIG. 46 is a view showing the size of the development gap and that of the nip of a conventional arrangement for comparison.

So long as the magnet brush contacts the drum 1 under the above conditions, the nip is greater than or equal to the particle size of the developer, but smaller than or equal to 2 mm, obviating the omission of a trailing. In addition, even a horizontal thin line and a single dot or similar small image can be sufficiently formed. FIGS. 45 and 46 respectively show a condition particular to this specific configuration and a conventional condition for comparison.

When the root portion of the magnet brush where the brush starts rising under the action of the main magnet P1*b* is 2 mm wide or less, the nip for development can be 2 mm wide or less.

Assume that the magnet brush of the illustrative embodiment is used to develop a latent image with low image density, i.e., to be developed by a small amount of toner. Then, the small nip width particular to the illustrative embodiment reduces the duration of contact of the magnet brush with the drum 1 and therefore the amount of countercharge to occur at the tip of the brush. This successfully reduces the omission of a trailing edge ascribable to the carrier with the countercharge otherwise attracting the toner image. It is therefore possible to enhance the reproducibility of a toner image with low density.

Why the illustrative embodiment increases image density is as follows. The magnet roller of the illustrative embodiment reduces the height of the magnet brush to be formed by the main pole P1*b* and reduces the nip width for development, as stated above, Therefore, when the sleeve 43 conveys the magnet brush via the main pole P1*b*, the brush starts rising and moves away from the nip in a shorter period of time; the linear velocity ratio of the brush to the drum 1 was found higher at this position than at the other positions. As a result, the amount of developer to contact the drum 1 increases and increases the image density. Moreover, the small flip width reduces the amount of developer to stay at: a position immediately preceding the nip, thereby reducing countercharge. This prevents the image density from decreasing and thereby enhances the developing ability of the developing device.

Another specific configuration of the developing device will be described hereinafter. As shown in FIG. 40, in the specific configuration, the magnets P2, P3, 24 and P6 are N poles while the magnets P1 and P5 are S poles. As shown in FIG. 41, the main magnet P1 had a magnetic force of 85 mT or above, as measured on the developing roller 41. It was experimentally found that a magnetic force of 60 mT or above, for example, obviated defects including the deposition of the carrier. The magnet P2 downstream of the main magnet 21 presumably helps the main magnet P1 exert the main magnetic force. The magnet P2 prevented the deposition of the carrier from occurring when its magnetic force was 60 mT or above, but caused it to occur when the magnetic force was below 60 mT. The magnet P1 was 2 mm wide and had a center half-power angle of 22°. Experimental results showed that when the width of the magnet P1 was further reduced, the center half-power angle was further reduced. Specifically, when the magnet 21 was 1.6 mm wide, the center half-power angle of the main pole was 16°. Center half-power angles above 25° resulted in defective images. For comparison, FIG. 42 shows the conventional magnetic force distribution.

FIG. 47 shows examples 1 through 5 and comparative examples 1 through 3 each showing a relation between the center halt-power angles of the poles P1 through P6. The center half-power angle of the pole P1 was used as a reference. In FIG. 47, symbol "-" of indicates that a center half-power angle could not be determined. The polarities shown in FIG. 47 are only illustrative. For example, the pole P1 may be an S pole. Also, the poles P1 through PS may be an N pole, an N pole, an N pole, an S pole, and an N pole, respectively. In all of Examples 1 through 5, the pole P1 exerts a weaker magnetic force than the other poles P2 through P5 in order to obviate defective images. Comparative Examples 1 through 3 brought about defects including the omission of a trailing edge and a poor horizontal/vertical ratio.

Figure 48:
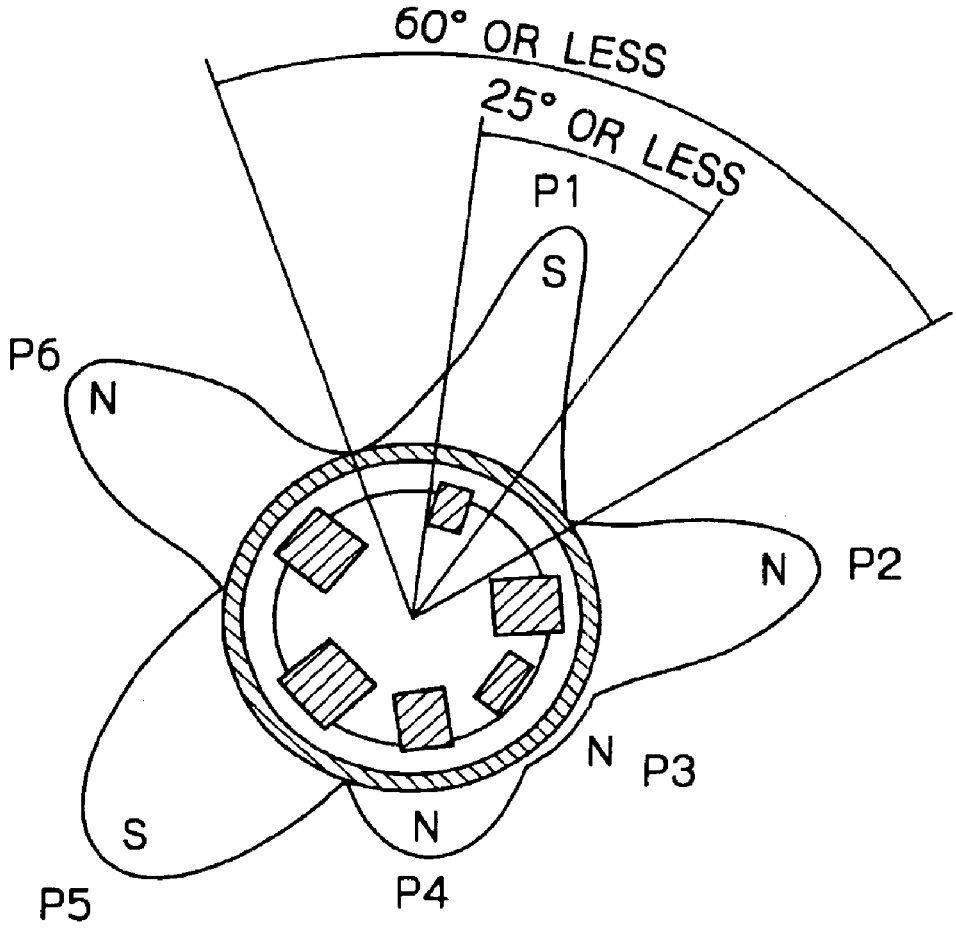
FIG. 48 is a chart showing a relation between a main magnet and magnets adjoining it.

Further, as shown in FIG. 48, the angle between the transition point between the main pole P1 and the pole P2 and the transition point between the main pole P1 and the pole 6 is selected to be 60° C. or below.

So long as the magnet brush contacts the drum 1 under the above conditions, the nip is greater than or equal to the particle size of the developer, but smaller than or equal to 2 mm obviating the omission or a trailing edge. In addition, even a horizontal thin line and a single dot or similar small image can be sufficiently formed. FIG. 49 shows a condition particular to this specific configuration. FIG. 49 is contrastive to FIG. 46.

Again, when the soot portion of the magnet brush where the brush starts rising under the action of the main magnet P1*b* is 2 mm wide or less, the nip for development can be 2 mm wide or less.

Why the illustrative embodiment increases image density is will be described hereinafter. The magnet roller of the illustrative embodiment reduces the height of the magnet brush to be formed by the main pole P1*b* and reduces the nip width for development, as stated above. Therefore, when the sleeve 43 conveys the magnet brush via the main pole P1, the brush starts rising and moves away from the nip in a shorter period of time; the linear velocity ratio of the brush to the drum 1 was found higher at this position than at the other positions. As a result, the amount of developer to contact the drum 1 increases and increases the image density. Moreover, the small nip width reduces the amount of developer to stay at a position immediately preceding the nip, thereby reducing countercharge. This prevents the image density from decreasing and thereby enhances the developing ability of the developing device.

How the illustrative embodiment obviates the various defective images by reducing the development gap will be described hereinafter. When the gap between the drum 1 and the sleeve 43 is great, various troubles occur because the edge effect is enhanced at the time of development. For example, solitary lines are thickened to an unconditional degree. Also, a portion around a high density portion is lost and left blank an image. Further, solitary dots are reproduced in a size greater than the actual size, preventing tonality from being linearly reproduced on an area ration basis. In addition, particularity, is conspicuous in a halftone portion.

By reducing the development gap, is possible to reduce the undesirable occurrence ascribable to the edge effect and therefore to output an attractive image desirable in uniformity and tonality. We experimentally found that when the gap was greater than the size of a string of carrier particles having a mean particle size, the edge effect was enhanced and make the various defects conscicuous.

For the experiments, use was made of a carrier complemented by a ferrite corner coated with silicone rubber. Assuming a string of carrier particles, then electric resistance is determined by the total thickness of the contact. A string of more than ten carrier particles increases substantial electric resistance and brings bout the same situation as when the development gap in increased. This relation holds when the carrier particle size ranges from 30 $\mu$m to 60 $\mu$m, as determined by experiments.

Figure 50:
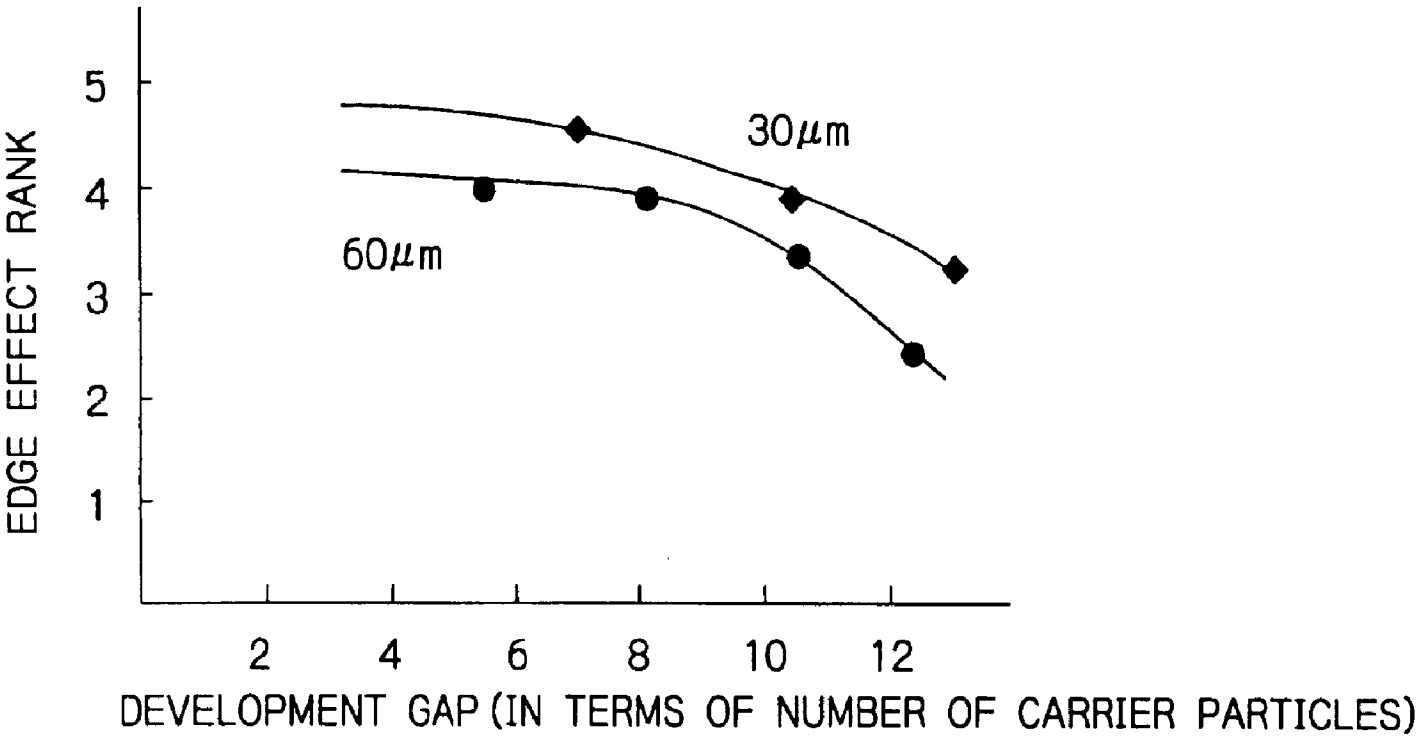
FIG. 50 is a graph showing a relation between the development gap and the edge effect.

FIG. 50 shows a relation between the development gap and the edge effect. In FIG. 50, the abscissa indicates a development gap in terms of the number of carrier particles while the ordinate indicates a rank determined by the organoleptic estimation; rank 1 shows that no edge effect was observed while rank 5 shows that the edge effect was most conspicuous. For the estimation, use was made of carrier particle sizes of 30 $\mu$m and 60 $\mu$m. As FIG. 50 indicates, the edge effect was enhanced without exception when the number of carrier particles exceeded ten.

On the other hand, assume that the development gap is sized to accommodate a string of less than three toner particles. Then, the gap obstructs the free movement or the carrier particles and thereby increases the frictional force of the magnet brush acting on the drum 1. The magnet brush is therefore likely to cause brush marks to appear in an image or to scratch the drum 1 and cause stripes to appear in an image. Moreover, such a magnet brush reduces the life of the drum 1.

Figure 51:
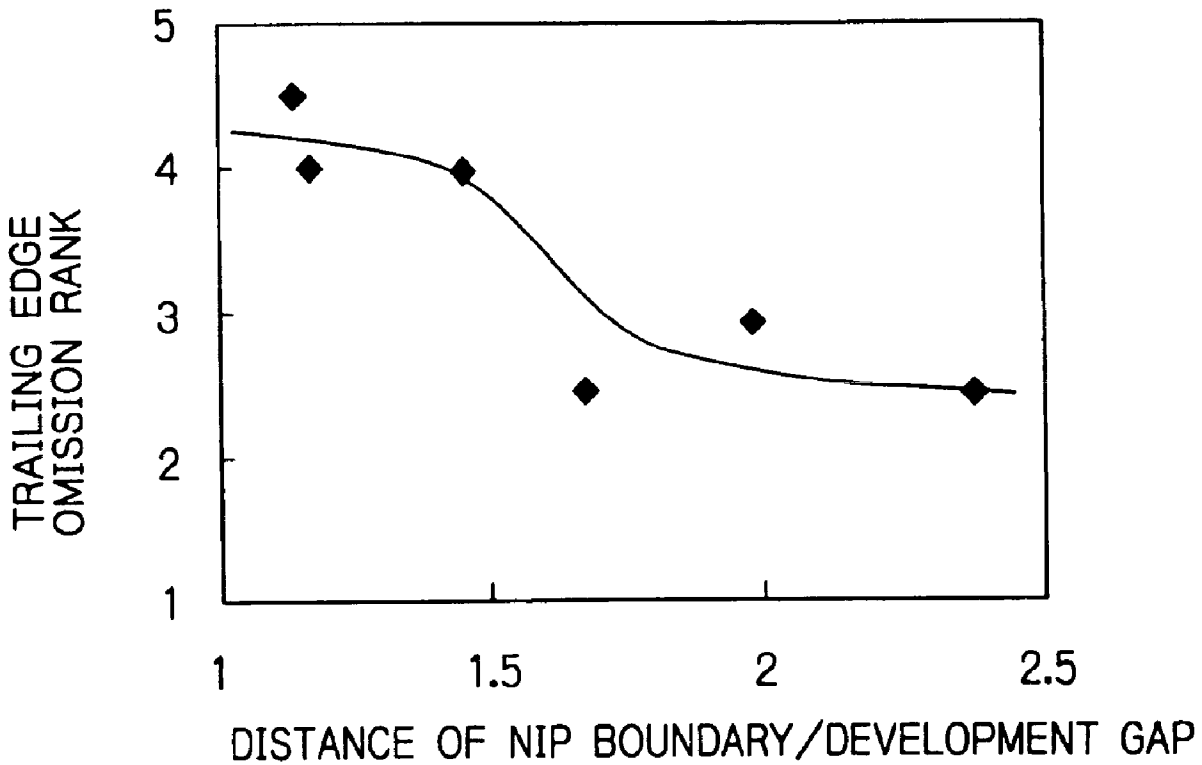
FIG. 51 is a graph showing a relation between a ratio of the distance at the boundary of the nip to the development gap and the omission of a trailing edge.

A development gap greater than a string of three or more carrier particles, but smaller than a string of ten or less toner particles, has heretofore caused the trailing edge of an image to be lost or caused a horizontal line to be disconnected, as discussed earlier. FIG. 51 plots the results of experiments conductive with the illustrative embodiment. FIG. 52 lists condition in which the above experiments were conducted.

In the illustrative embodiment, the drum 1 is an organic photoconductor having a carrier generating layer (CGL) and a carrier transport layer (CTL) sequentially laminated on an electrode portion in this order. An optical carrier generated by the CGL partly migrates to the CTL end then migrates to a surface layer due to the internal electric field. As a result, the optical carrier forms a charge density distribution or Latent image on the surface layer. When the carrier migrates in the CLT, the carrier is scattered due to a Coulomb repulsive force, lowering the resolution of the latent image. In light of this, the CTL should preferably be as thin as possible, particularly thinner than the mean carrier particle size.

An image with little granularity was achieved when the half width of the magnetic flux of the main pole was reduced, when the CTL layer was 30 $\mu$m thick, when the development gap was 400 $\mu$m, and when the carrier particle size was 50 $\mu$m. Details of an image were more faithfully reproduced when the CTL layer was 20 $\mu$m, when the development gap was 300 $\mu$m, and when the mean carrier particle size was 40 $\mu$m. In the same conditions, the omission of a trailing edge was extremely noticeable when the flux density distribution was as broad as conventional and when the above gap ratio was 1.5 or above.

As stated above, in the illustrative embodiment, the half width of the magnetic flux of the main pole and therefore the development gap is reduced. Also, the ratio of the distance at the boundary of the nip to the development gap is selected to be 1.5 or below. Further, the development gap is so sized as to accommodate a string of three or more carrier particles, but accommodate a string of ten or less carrier particles. With these conditions, the illustrative embodiment minimizes the disturbance to a toner image carried on the drum 1 by the magnet brush and reduces the edge effect. This successfully insures an image free from the omission of a trailing edge, desirable in the reproducibility of horizontal lines and the uniformity of dots, and low in granularity.

Figure 53:
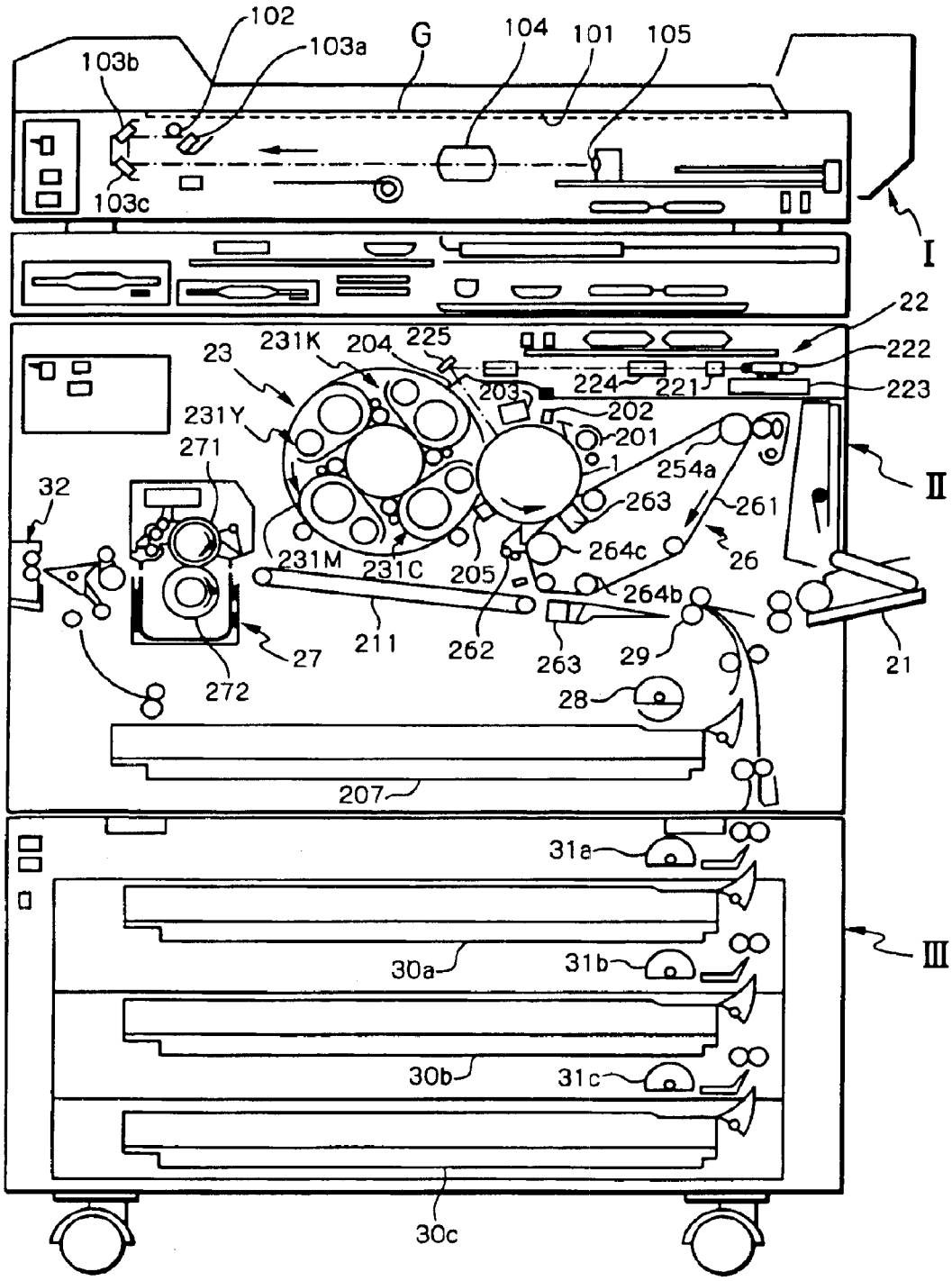
FIG. 53 is a view showing an image forming apparatus to which the present invention is applicable.

Reference will be made to FIG. 53 for describing an image forming apparatus to which the illustrative embodiment is applied and implemented as an electrophotographic color copier by way of example. As shown, the color copier includes a color scanner or image reading device I, a color printer or image recording device II, and a sheet bank III.

The color scanner I includes a lamp 102 for illuminating a document G laid on a glass platen 101. The resulting reflection from the document G is incident to a color image sensor 103 via mirrors 103*a*, 103*b* and 103*c* and a lens 104. The color image sensor 105 reads color image data representative of the document G color by color, e.g., red (R), green (G) and blue (B) while converting them to corresponding image signals. Specifically, the color image sensor 105 includes R, G and B color separating means and a CCD (Charge Coupled Device) or similar photoelectric transducer and reads three different color image data at the same tire. An image processing section, not shown, transforms the color image signals to black (Bk), cyan (C) magenta (M) and yellow (Y) color image data on the basis of a signal level.

More specifically, in response to a scanner start signal synchronous to the operation of the color printer II, optics made up of the lamp 102 and mirrors 103*a* through 103*c* sequentially scans the document G to the left, as viewed in FIG. 53. The color scanner I outputs color data of one color every time the optics scans the document. By repeating such scanning four consecutive times, the color scanner I sequentially outputs color image data of four different colors. The color printer II forms a single toner image every time it receives the color image data of one color from the color scanner I. The color printer II transfers the resulting toner images of four different colors to an intermediate image transfer belt 261, which will be described later, one above the other, thereby completing a full-color image.

The color printer II includes the drum 1, an optical writing unit 22, a revolver or developing device 23, an intermediate image transferring unit 26, and a fixing unit 27. The drum 1 is rotatable counterclockwise, as indicated by an arrow in FIG. 53. Arranged around the drum 1 are a drum cleaner 201, a discharged lamp 202, a charger 203, a potential sensor 204, one of developing units arranged in the revolver 23, a density sensor 205, and the intermediate image transfer belt 261 included in the intermediate image transferring nit 26.

The optical writing unit 22 transforms the color image data received from the color scanner I to an optical signal and scans the drum 1 in accordance with the optical signal, thereby forming a latent image on the drum 1. The writing unit 22 includes a semiconductor laser or light source 221, a laser driver, not shown, a polygonal mirror 222, a motor 223 for driving the mirror 222, an f/θ lens 224, and a mirror 225.

The revolver 23 includes a Bk developing unit 231K, a C developing unit 231C, a M developing unit 231M and a Y developing unit 231Y as well as a drive section for rotating the revolver 23 in a direction indicated by an arrow in FIG. 53. The developing units 231K through 231Y each are constructed in the same manner as the developing device 4 shown in FIGS. 34 and 35. Specifically, the developing units 231K through 231Y each include a developing sleeve rotatable with a magnet brush formed thereon contacting the surface of the drum 1 and a paddle rotatable to scoop up and agitate a developer. In each of the developing units 231K through 231Y, the toner of the developer is charged to negative polarity by being agitated together with a ferrite carrier. A negative DC voltage Vdc on which an AC voltage Vac is superposed is applied to the developing sleeve as a bias for development. The bias biases the developing sleeve to a preselected potential relative to a metallic core included in the drum 1.

While the copier is in a standby state, the revolver 23 is positioned such that the developing unit 231K is located at a developing position where it faces the drum 1. On the start of a copying operation, the color scanner I starts reading Bk color image data at preselected timing. The writing unit 22 starts forming a latent image on the drum 1 with a laser beam in accordance with the above color image data. Let this latent image be referred to as a Bk latent image for convenience. This is also true with latent images corresponding to the other colors C, M and Y.

The Bk developing sleeve starts rotating before the leading edge of the Bk latent image arrives at the developing position. As a result, the Bk latent image is developed by Bk toner to become a Bk toner image. As soon as the trailing edge of the Bk latent image moves away from the developing position, the revolver 23 is rotated to locate the next developing unit (C developing unit) at the developing position. This rotation of the revolver 23 completes at least before the leading edge of a latent image derived from the nest color data arrives at the developing position.

The intermediate image transferring unit 26 includes a belt cleaner 262 and a corona discharger 263 in addition to the intermediate image transfer belt 261. The belt 261 is passed over a drive roller 264*a*, a roller 264*b* assigned to image transfer, a roller 264*c* assigned to belt cleaning, and a plurality of driven rollers. A motor, not shown, drives the belt 261. The belt cleaner 262 includes an inlet seal, a rubber blade, a discharge coil, and a mechanism for moving the inlet seal and a rubber blade. While toner images of the second, third and fourth colors are sequentially transferred from the drum to the belt 261 after a toner image of the first color, the above mechanism maintains the inlet seal and rubber blade spaced from the belt 261. The corona discharger 263 applies either a DC voltage or an AC-biased DC voltage to the belt 261 by corona discharge, causing a full-color image to be transferred from the belt 261 to a paper sheet or similar recording medium.

The color printer II additionally includes a sheet cassette 207 in addition to the previously mentioned sheet bank II. The sheet bank II includes sheet cassettes 30*a*, 30*b* and 30*c* each being loaded with a stack of paper sheets of particular size. Pickup rollers 28, 31*a*, 31*b* and 31*c* are associated with the sheet cassettes 207, 30*a*, 30*b* and 30*c*, respectively. Paper sheets are sequentially fed from designated one of the paper cassettes 207 and 31*a* through 31*c*, by associated one of the pickup rollers 28 and 31 through 31*c* to a registration roller pair 29. If desired, an OHP (OverHedad Projector) sheet, a relatively thick sheet or similar special sheet may be fed by hand from a manual feed tray 21.

On the start of an image forming cycle, the drum 1 is caused to start rotating counterclockwise by the motor. Likewise, the belt 261 is caused to start turning clockwise by the motor. A Bk toner image, a C toner image, a M toner image and a Y toner image are sequentially formed while the belt 261 is in rotation, and sequentially transferred to the belt 261 one above the other, completing a full-color image.

More specifically, the charger 203 uniformly charges the surface of the drum 1 to about −700 V by corona discharge. The semiconductor laser 221 scans the charged surface or the drum 1 by raster scanning in accordance with Bk color image data. As a result, the scanned or exposed portion of the drum 1 looses its charge in proportion to the quantity of incident light, so that a Bk latent image is formed. Bk toner deposited on the Bk developing sleeve contacts the Bk latent image and deposits only on the exposed portion of the drum 1, thereby forming a corresponding Bk toner image. A belt transfer unit 265 transfers the Bk toner image from the drum 1 to the belt 261, which is turning at the same speed as the drum 1 in contact with the drum 1 (primary image transfer).

The drum cleaner 201 removes some toner left on the drum 1 after the primary image transfer. The toner collected by the drum cleaner 201 is stored in a waste toner tank, not shown, via a piping.

After the formation and transfer of the Bk toner image, the color scanner I starts reading C image data at preselected timing. The laser 221 forms a C latent image on the drum 1 in accordance with the C image data. After the passage of the trailing edge of the Bk latent image, but before the arrival of the leading edge of the C latent image, the revolve 23 brings its developing unit 231C to the developing position. The D developing unit 231C develops the C latent image with C toner for thereby forming a C toner image. After the trailing edge of the C latent image has moved away from the developing position, the revolver 23 is again rotated to bring the developing unit 231M to the developing position. This rotation also completes before the leading edge of a M latent image arrives at the developing position. The procedure described above is repeated with M and Y color image data to thereby form a M and a Y toner image.

The B, C, M and Y toner images sequentially transferred from the drum 1 to the belt 261 one above the other, i.e., a full-color image is transferred to a paper sheet by the corona discharger 263.

The paper sheet is fed from any one of the sheet cassettes and manual feed tray when the above-described image forming operation begins, and is waiting at the nip of the registration roller pair 29. The registration roller pair 29 conveys the paper sheet such that the leading edge of the paper sheet meets the leading edge of the toner image conveyed by the belt 261 to the corona discharger 263. The corona discharger 263 charges the paper sheet to positive polarity by corona discharge, thereby transferring the toner image from the belt 261 to the paper sheet (secondary image transfer). Subsequently an AC+DC corona discharger, not shown, located at the left-hand side of the corona discharger 263, as viewed in FIG. 53, discharges the paper sheet to thereby separate it from the belt 261.

A belt 211 conveys the paper sheet carrying the toner image thereon to the fixing unit 27. In the fixing unit 27, a heat roller 271 and a press roller 272 fix the toner image on the paper sheet with heat and pressure. An outlet roller pair 32 drives the paper sheet coming out of the fixing unit 27 out of the apparatus. The paper sheet or copy is stacked on a copy tray, not shown, face up.

After the secondary image transfer, the drum cleaner 201 cleans the surface of the drum 1 with the brush roller and rubber blade. Subsequently, the discharge lamp 202 discharges the surface of the drum 1. At the same time, the previously mentioned mechanism again presses the blade of the belt cleaner 262 against the surface of the belt 261 to thereby clean it.

As stated above, the illustrative embodiment has various unprecedented advantages, as enumerated below.

(1) The image carrier and developer carrier are spaced by a gap that is three times or more greater than a mean carrier particle size, but not greater than ten times of the same. Also, the ratio of the distance between the image carrier and the developer carrier at the boundary of the nip to the distance between the image carrier and the developer carrier at a position where they are closest to each other is selected to be 1.5 or less. Therefore, disturbance to the toner image carried on the image carrier ascribable to the magnet brush is minimized. This, coupled with the tact that the edge effect is reduced, protects the resulting image from the omission of a trailing edge, insures desirable reproduction of horizontal lines and uniform dots, and obviates granularity.

(2) The magnet roller accommodated in the developer carrier includes auxiliary poles helping a main pole exert a magnetic force. It is therefore easy to reduce the half width of the flux density distribution of the main pole. This also protects the resulting image from the omission of a trailing edge, insures desirable reproduction of horizontal lines and uniform dots, and obviates granularity.

(3) The magnet roller forms the main pole with one of its magnets that has the smallest half width of flux density. This allows the half width of the flux density distribution to be reduced by a simple configuration. This also protects the resulting image from the omission of a trailing edge, insures desirable reproduction of horizontal lines and uniform dots, and obviates granularity.

(4) The image carrier has a carrier generating layer and a carrier transport layer sequentially laminated on an electrode portion. The carrier transport layer has a thickness smaller than the mean carrier particle size. Such a configuration renders a latent image sharp and therefore insures an image with high resolution and the desirable reproduction of details. In addition, this also protects the resulting image from the omission of a trailing edge, insures desirable reproduction of horizontal lines and uniform dots, and obviates granularity.

Sixteenth Embodiment

Figure 54:
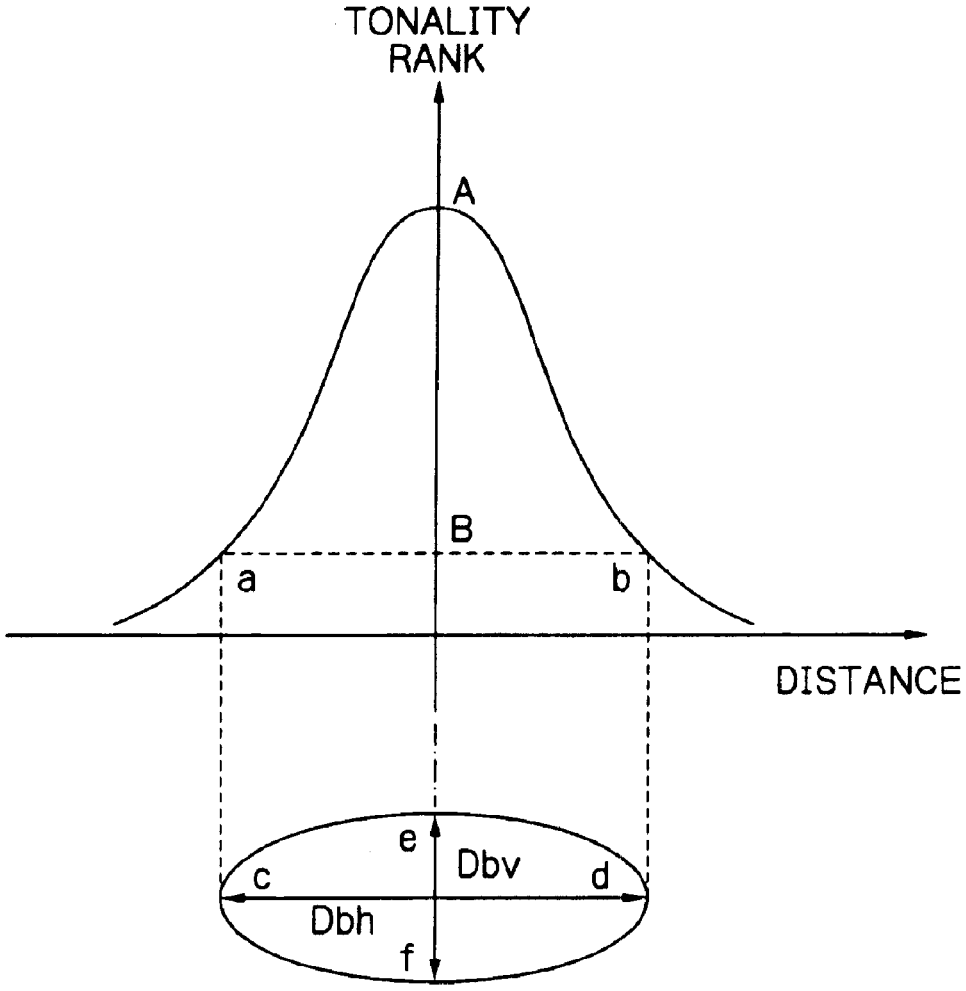
FIG. 54 is a view for describing the spot diameter of an exposing beam particular to a sixteenth embodiment of the present invention.

This embodiment is mainly directed toward the seventh object stated earlier. Generally, in an image forming apparatus, an increase in pixel density directly translates into a decrease in individual pixel relative to a beam spot diameter and thereby degrades tonality, as stated previously. As shown in FIG. 54, the spot diameter of a beam is represented by a portion B at which a peak intensity A decreases to $1/e^2$. Specifically, while the intensity distributions of light include a Gaussian distribution and Lorentz distribution, a spot diameter Db is represented by a portion ab at which the peak intensity A decreases to $1/e^2$. As shown in FIG. 54, a beam spot generally has an oval shape. A spot diameter cd in the lengthwise direction of an image carrier is referred to as a main scan spot diameter Dbh. On the other hand, a spot diameter ef in the direction of rotation of the image carrier is referred to as a subscan spot diameter Dbv. In the illustrative embodiment, the beam spot diameter Db includes both of the spot diameters Dbh and Dbv.

Figure 55:
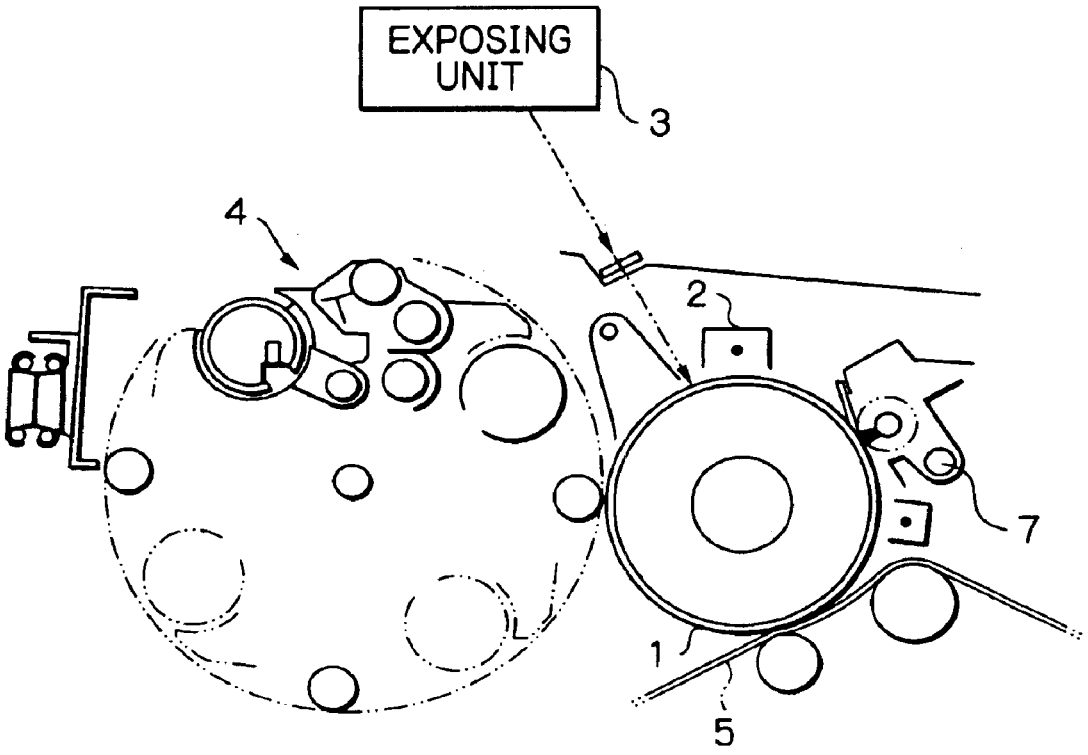
FIG. 55 is a view showing an image forming apparatus to which the sixteenth embodiment is applied.
Figure 56:
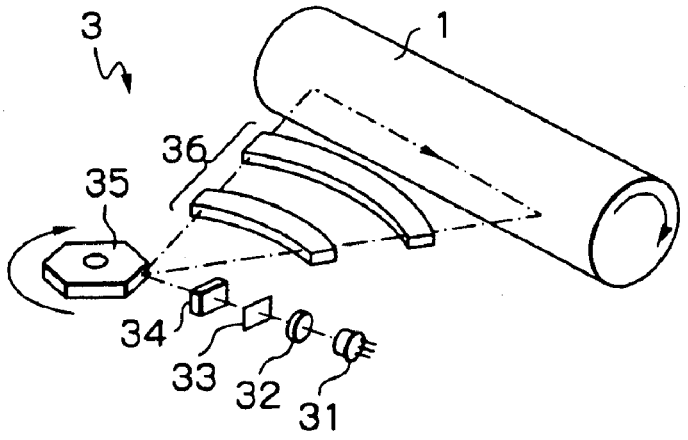
FIG. 56 is an isometric view showing an exposing device included in the sixteenth embodiment.

FIG. 55 shows a specific configuration of an image forming section included in the illustrative embodiment. As shown, the image forming section includes a drum 1, a scorotron charger or similar charger 2, an exposing unit 3, a developing device 4, an intermediate image transferring device 5, and a drum cleaner 7. In the illustrative embodiment, the developing device 4 is implemented as a revolver including a C, a M, a Y and a Bk developing unit.

In operation, toner images of different colors are sequentially formed on the drum 1 while being sequentially transferring from the drum 1 to a belt, which is included in the intermediate image transferring device 5, one above the other. The resulting full-color image is transferred from the belt to a paper sheet fed from a sheet tray. A fixing unit, not shown, fixes the full-color image on the paper sheet. On the other hand, the drum 1 is initialized by a discharge lamp to be thereby prepared for the next image formation. The drum cleaner 7 removes toner left on the drum 1 after the image transfer.

As shown in FIG. 5 specifically, the exposing unit 3 includes a laser 31, a collimator lens 32, an aperture 33, a cylindrical lens 34, a polygonal mirror 35, and an f/θ lens 36. A laser beam issuing from the laser 41 is made parallel by the collimator lens 32 and then incident to the cylindrical lens 34. The cylindrical lens 34 condenses the laser team in the subscanning direction. The condensed laser beam is incident to the polygonal mirror 35. The polygonal mirror 35 steers the laser beam in the main scanning direction parallel to the axis of the drum 1. The f/θ lens 36 adjusts the laser beam such that the scanning angle and scanning distance are proportional to each other. At the same time, the f/θ lens 36 condenses the laser beam in the subscanning direction. The laser being output from the f/θ lens 36 is incident to the drum 1.

When the above-described laser optics is used, image recording density can be easily varied if the rotation speed of the polygonal mirror 35 and a clock for main scanning are varied. The linear velocity of the drum 1 may be varied in place of the rotation speed of the polygonal mirror 35, if desired.

As shown in FIG. 55, the revolver 4 is rotatable counterclockwise to bring any one of the developing units to a developing position where the developing unit faces the drum 1. The revolver 4 is assumed to sequentially develop latent images with Bk toner, Y toner, C toner and M developers in this order. The developers each are made up of toner and carrier respectively having mean particle sizes of 6.8 $\mu$m and 50 $\mu$m.

The construction and operation of the revolver 4 are identical with the construction and operation described with reference to FIGS. 35 and 40 and will not be described specifically in order to avoid redundancy. In the illustrative embodiment, the magnet roller accommodated in the developing roller includes auxiliary poles adjoining a main pole for adjusting the magnetic force and half width of the main pole. With this configuration, it is possible to reduce the thinning of a horizontal line and the omission of a local omission of a halftone image and to enhance the developing ability. The development gap of the illustrative embodiment reduces the edge effect and thereby improves the reproducibility of the low density or highlight portion of an image and therefore tonality. A conventional image forming apparatus (magnet roller) cannot faithfully reproduce a highlight portion.

Figure 57:
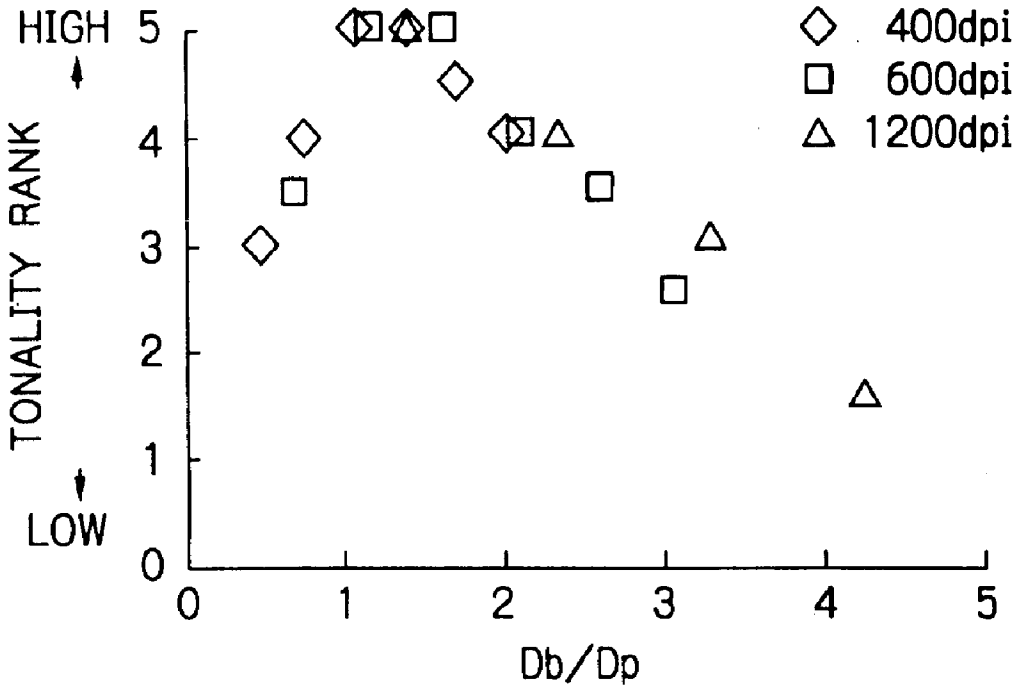
FIG. 57 is a table listing the results of experiments conducted with the sixteenth embodiment for determining the reproducibility of tonality.
Figure 58:
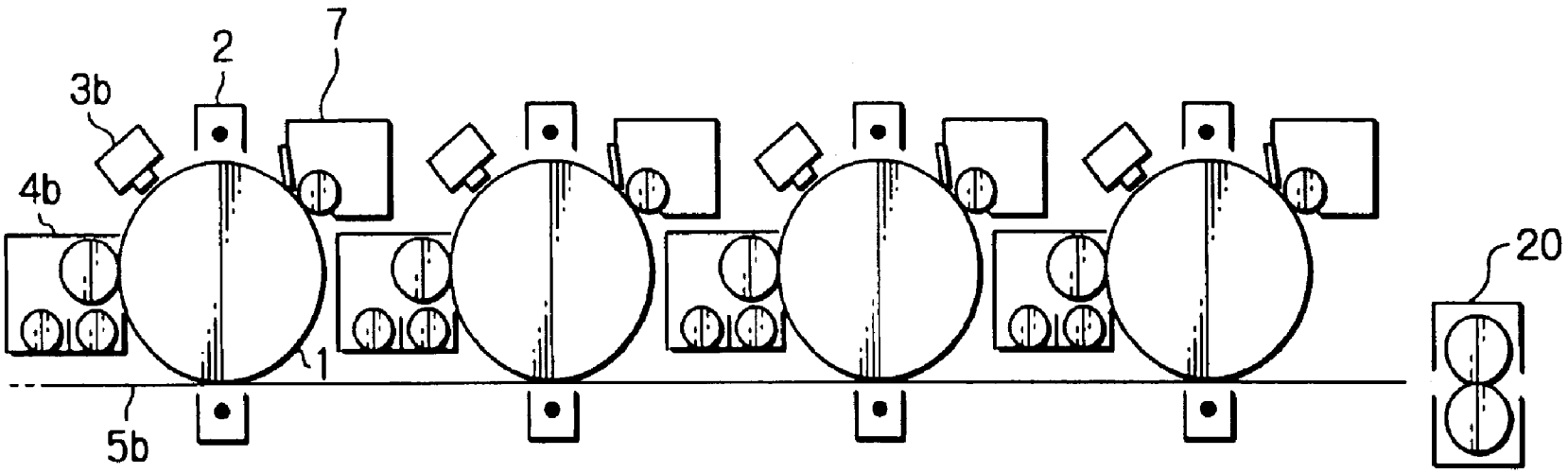
FIG. 58 is a section showing a color image forming apparatus to which a seventeenth embodiment at the present invention is applied.

FIG. 57 shows the results of experiments conducted to determine the reproducibility of tonality available with the illustrative embodiment. For the experiments, beam spot diameters Db of 30 μm, 50 μm, 70 μm, 90 μm, 110 μm and 130 μm and recording densities of 40 dpi, 600 dpi and 1,200 dpi (Dp: 63.5 μm, 42.3 μm and 21.2 μm) were used. Under these conditions, 256 stepwise patches were formed by binary error scattering. To vary the beam spot diameter, the size of the aperture 33 was varied. The pixel pitch was varied by varying the recording density. In FIG. 57, the abscissa indicates the ratio of the beam spot diameter Db to the pixel pitch, i.e., Db/Dp. The ordinate indicates a tonality rank representative of the result of total estimation of the linearity of area ratio gamma, the density reproducibility of a highlight portion, and maximum density (black solid portion); the greater the value, the better the result of estimation.

A rank above 3.5 inclusive satisfies a preselected value. The ratio Db/Dp associated with such a rank was 0.8 or above, but 3 or below. Ratios above 3 caused the area ratio gamma to rise and degraded the reproducibility of the density of a highlight portion. Consequently, the number of tones capable of being rendered decreased and rendered a phonographic image critically unsmooth. Ratios Db/Dp below 0.8 prevented a black solid portion from having sufficient density. This is presumably because despite that exposure is fully turned on in accordance with an input signal whose Image area ratio is 100%, the resulting latent image is not filled up.

Specifically, when laser optics is used for exposure, as in the illustrative embodiment, the laser beam scans the photoconductive element in the main scanning direction. When the laser is fully turned on to form a black solid image, the laser beat scans the photoconductive element over the duration of emission in the above direction. Therefore, pixels adjoining each other in the main scanning direction overlap each other. However, the overlap of pixels in the subscanning direction is determined only by the spot diameter Dvb of the laser beam in the subscanning direction. It follows that to provide a black solid image with sufficient density, the spot diameter Dvb in the subscanning direction must be greater then the pixel pitch of 0.8Dpv in the subscanning direction, which is determined by the recording density. This is a condition particular to laser optics.

As stated above, the beam spot diameter Db is selected to be smaller than 3Dp. This successfully insures an image having high resolution and desirable tonality without degrading the reproduction of a highlight portion even when the recording density is increased. Further, because the beam spot diameter Db is greater than 0.8Dp, the image density is linearly related to the image area ratio without regard to recording density when tonality is rendered. In addition, a black solid image with sufficient density is achievable.

Further, the laser optics scans the photoconductive element with a single beam in the main scanning direction and therefore with a stable beam spot diameter without regard to the position in the subscanning direction. By contrast, an LED array scans the photoconductive element with LEDs arranged in the main scanning direction. Moreover, the beam spot diameter Dbv that is greater than 0.8Dpv provides a black solid image with sufficient density.

Seventeenth Embodiment

Figure 59:
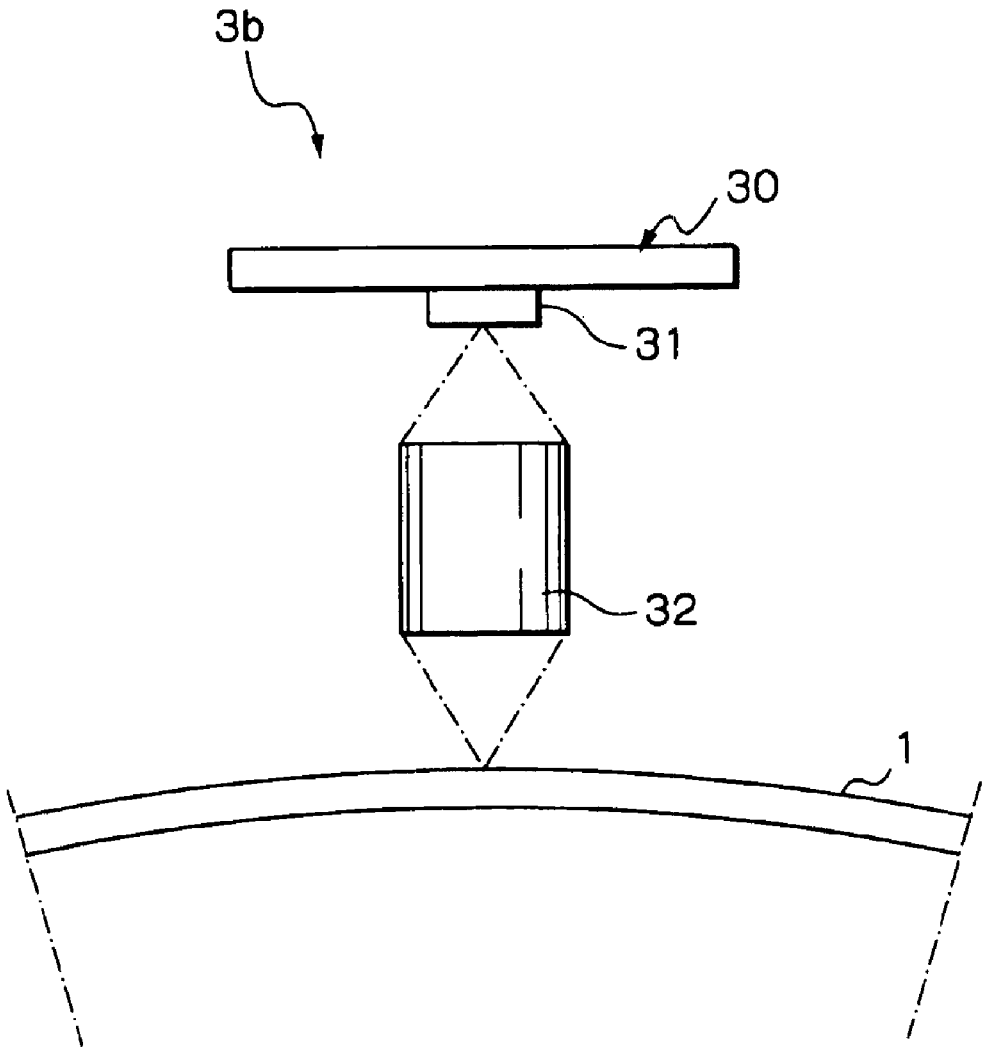
FIG. 59 is a view showing an exposing device included in the seventeenth embodiment specifically.

Referring to FIG. 59, a tandem, color image forming apparatus representative of a seventeenth embodiment of the present invention will be described. As shown, tandem, the color image forming apparatus includes four image forming sections each including the drum 1, the charger 2, an exposing unit 3*b*, a developing unit 4*b*, and the drum cleaner 7. The four image forming sections are serially arranged and assigned to C, M, Y and Bk, respectively. Toner images of different colors formed by the four image forming sections are sequentially transferred to a paper sheet being conveyed by an image transfer belt 5*b* one above the other. A fixing unit 20 fixes the resulting full-color image on the paper sheet.

The developing device 4*b* is identical with each developing unit of the developing device 4 included in the sixteenth embodiment.

FIG. 59 shows a specific configuration of the exposing unit 3*b*. In the illustrative embodiment, the exposing unit 3*b* includes a LED array head on which a number of LEDs are arranged in an array in the main scanning direction. The LEDs are selectively turned on in accordance with an image signal to thereby form a latent image on the drum 1.

Specifically, FIG. 59 shows the LED head array and drum 1 in a section in a plane perpendicular to the axis of the drum 1. As shown, a linear LED array 31 is mounted an a circuit board 30. A lens 32 is positioned between the circuit board 30 and the drum 1 for focusing light issuing from the LED array 31 on the drum 1.

The LED array 31, circuit board 30 and lens 32 constitute Major part of a LED array unit 33. For the lens 32, use is often made of a Selfoc lens array (SLA). In the illustrative embodiment, a SLA 12D having an aperture angle of 12°.

Experiments were conducted with the illustrative embodiment in the same manner as with the sixteenth embodiment in order to determine the reproducibility of tonality. The experiments showed that the data shown in FIG. 57 derived from laser optics were also achieved.

To vary the beam spot diameter, spot distance between the LED array and the drum 1 was varied while the beam was defocused. To vary the pixel pitch that is determined by recording density, the pitch of the LED arrays 31 was varied.

The LEDs are arranged in the main scanning direction (lengthwise direction of the drum 1) and selectively turned on, as stated above. This is equivalent to causing the LEDs to scan the drum 1 in the subscanning direction (direction of rotation of the drum 1). When all the LEDs are turned on to form a black solid image, they scan the drum 1 in the subscanning direction over the duration of emission. Therefore, pixels adjoining each other in the subscanning direction overlap each other. However, the overlap of pixels in the main scanning direction is determined only by the beam spot diameter Dvh in the main scanning direction. It follows that to provide a black solid image with sufficient density, the spot diameter Dvh in the main scanning direction must be greater than the pixel pitch of 0.8Dph in the main scanning direction, which is determined by the recording density. This is a condition particular to an LED array head.

As stated above, in the illustrative embodiment, too, the beam spot diameter Db is selected to be smaller than 3Dp. This successfully insures an image having high resolution and desirable tonality without degrading the reproduction of a highlight portion even when the recording density is increased. Further, because the beam spot diameter Db is greater than 0.8Dp, the image density is linearly related to the image area ratio without regard to recording density when tonality is rendered. In addition, a black solid image with sufficient density is achievable.

Further, the LED head array is capable of increasing recording density without increasing the size of the exposing unit. This also successfully insures an image having high resolution and desirable tonality without degrading the reproduction of a highlight portion even when the recording density is increased. Moreover, the beam spot diameter Dbh that is greater than 0.8Dph provides a black solid image with sufficient density.

The reproducibility of tonality of, e.g., a color photographic image is strictly required of the color image forming apparatus of the sixteenth or the seventeenth embodiment. In this case, too, the present invention can determine a beam spot diameter that provides a black solid image with sufficient density without degrading the reproduction of a highlight portion even when recording density is increased.

As stated above, the sixteenth and seventeenth embodiments have various unprecedented advantages, as enumerated below.

(1) The beam spot diameter Db on the image carrier is selected to be smaller than 3Dp where Dp is the pixel pitch determined by recording density. This successfully insures an image having high resolution and desirable tonality without degrading the reproduction of a highlight portion even when the recording density is increased. This is also true when the beam spot diameter is smaller than dDp, but greater than 0.8Dp.

(2) Because the beam spot diameter Db is selected to be greater than 0.8Dp, image density is linearly related to the image area ratio without regard to recording density when tonality is rendered. In addition, a black solid image with sufficient density is achievable.

(3) The laser optics scans the image carrier with a single laser beam in the main scanning direction, insuring a stable beam spot diameter without regard to the position in the main scanning direction.

(4) The beam spot diameter Dbv on the image carrier in the subscanning direction is selected to be 0.8Dpv where Dpv denotes the pixel pitch in the subscanning direction. Therefore, even with laser optics, it is possible to determine a condition of the beam spot diameter in the subscanning direction that provides a black solid image sufficient density. This successfully insures an image having high resolution and desirable tonality without degrading the reproduction of a highlight portion.

(5) When the exposing unit is implemented by the LED array head, the LED array head is positioned to face the image carrier. This allows recording density to be increased without increasing the size of the exposing unit.

(6) Because the beam spot diameter Dbh in the main scanning direction is selected to be greater than 0.8Dph where Dph denotes the pixel pitch in the main scanning direction. Therefore, even with an LED array head, it is possible to determine a condition of the beam spot diameter in the main scanning direction that provides a black solid image sufficient density. This successfully insures an image having high resolution and desirable tonality without degrading the reproduction of a highlight portion.

(7) Even with a color image forming apparatus needing strict reproducibility of tonality of, e.g., a color photographic image, the present invention can determine a beam spot diameter that provides a black solid image with sufficient density without degrading the reproduction of a highlight portion even when recording density is increased.

Various modifications will become possible for those skilled in the art after receiving the teachings of the present disclosure without departing from the scope thereof.

What is claimed is:

1. In an image forming method using a developer carrier for conveying a developer, which is made up of toner and a carrier, deposited thereon, and magnetic field generating means held stationary within said developer carrier for forming a magnet brush on said developer carrier, said magnet brush contacting an image carrier to thereby develop a latent image formed on said image carrier, an auxiliary magnetic pole exists between a main magnetic pole, which causes said developer to rise and form said magnet brush in a developing region, and a magnetic pole that conveys said developer, an amount of charge to deposit on the toner ranges from 10 $\mu$C/g to 35 $\mu$C/g, a background potential is 100 V or above, and auxiliary magnetic poles opposite in polarity to the main magnetic pole are positioned at sides of the main magnetic pole.

2. In an image forming method using a developer carrier for conveying a developer, which is made up of toner and a carrier, deposited thereon, and magnetic field generating means held stationary within said developer carrier for forming a magnet brush on said developer carrier, said magnet brush contacting an image carrier to thereby develop a latent image formed on said image carrier, an auxiliary magnetic pole exists between a main magnetic pole, which causes said developer to rise and form said magnet brush in a developing region, and a magnetic pole that conveys said developer, an amount of charge to deposit on the toner ranges from 10 $\mu$C/g to 35 $\mu$C/g, a background potential is 100 V or above, and the main magnetic pole has a half-width value of 20° or below.

3. An image forming apparatus comprising:

an image carrier;

a developer carrier for conveying a developer, which is made up of toner and a carrier, deposited thereon; and magnetic field generating means held stationary within said developer carrier for forming magnet brush on said developer carrier, said magnet brush contacting said image carrier for thereby developing a latent image formed on said image carrier;

wherein an auxiliary magnetic pole helps a main magnetic pole, which causes the developer to rise and form the magnet brush in a developing region, exert a magnetic force, whereby a half width of said main magnetic pole is reduced, assuming that said developer carrier and said image carrier rotate at peripheral speeds of vd and vp, respectively, a ratio vd/vp is 2.5 or below, the main pole has a flux density whose peak value is 60 mT or above, the carrier of the developer has a saturation magnetization of 35 emu/g or above, and auxiliary magnetic poles opposite to the main magnetic pole are positioned at sides of the main magnetic pole.

4. An image forming apparatus comprising:

an image carrier;

a developer carrier for conveying a developer, which is made up of toner and a carrier, deposited thereon; and magnetic field generating means held stationary within said developer carrier for forming magnet brush on said developer carrier, said magnet brush contacting said image carrier for thereby developing a latent image formed on said image carrier;

wherein an auxiliary magnetic pole helps a main magnetic pole, which causes the developer to rise and form the magnet brush in a developing region, exert a magnetic force, whereby a half width of said main magnetic pole is reduced, assuming that said developer carrier and said image carrier rotate at peripheral speeds of vd and vp, respectively, a ratio vd/vp is 2.5 or below, the main pole has a flux density whose peak value is 60 mT or above, the carrier of the developer has a saturation magnetization of 35 emu/g or above, and the main magnetic pole has a half-width value of 20° or below.

5. In an image forming method using a developer carrier for conveying a developer, which is made up of toner and a carrier, deposited thereon, and magnetic field generating means held stationary within said developer carrier for forming a magnet brush on said developer carrier, said magnet brush contacting an image carrier to thereby develop a latent image formed on said image carrier, an auxiliary magnetic pole exists between a main magnetic pole, which causes said developer to rise and form said magnet brush in a developing region, and a magnetic pole that conveys said developer, an amount of charge to deposit on the toner ranges from 10 $\mu$C/g to 35 $\mu$C/g, and a background potential is 100 V or above.

6. The method as claimed in claim 5, wherein a charge potential is 1,000 V or below.

7. The method as claimed in claim 5, wherein a bias for development is 100 V or above.

8. An image forming apparatus comprising:

an image carrier;

a developer carrier for conveying a developer, which is made up of toner and a carrier, deposited thereon; and magnetic field generating means held stationary within said developer carrier for forming a magnet brush on said developer carrier, said magnet brush contacting said image carrier for thereby developing a latent image formed on said image carrier;

wherein an auxiliary magnetic pole helps a main magnetic pole, which causes the developer to rise and form the magnet brush in a developing region, exert a magnetic force, whereby a half width of said main magnetic pole is reduced, an amount of charge to deposit on the toner ranges from 10 $\mu$C/g to 35 $\mu$C/g, and a background potential is 100 V or above.

9. The apparatus as claimed in claim 8, wherein a charge potential is 1,000 V or below.

10. The apparatus as claimed in claim 8, wherein a bias for development is 100 V or above.

* * * * *